US010280678B1

(12) United States Patent
Rendon, Jr. et al.

(10) Patent No.: US 10,280,678 B1
(45) **Date of Patent: *May 7, 2019**

(54) BREAKOUT SLIDING DOOR SYSTEM WITH PIVOTING ROD

(71) Applicant: Landert Motoren AG, Bülach (CH)

(72) Inventors: Humberto Rendon, Jr., San Antonio, TX (US); Jaime Alonzo Ramirez, San Antonio, TX (US); David Samuel Woodring, San Antonio, TX (US)

(73) Assignee: LANDERT MOTOREN AG, Bulach (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/729,660

(22) Filed: Oct. 10, 2017

Related U.S. Application Data

(63) Continuation-in-part of application No. 15/583,702, filed on May 1, 2017, now abandoned, which is a continuation of application No. 14/919,713, filed on Oct. 21, 2015, now Pat. No. 9,637,970.

(51) Int. Cl.

| | |
|---|---|
| ***E06B 3/50*** | (2006.01) |
| ***E05D 15/48*** | (2006.01) |
| ***E05D 15/54*** | (2006.01) |
| ***E06B 3/26*** | (2006.01) |

(52) U.S. Cl.
CPC ..... *E06B 3/509* (2013.01); *E05D 15/48* (2013.01); *E05D 15/54* (2013.01); *E06B 3/26* (2013.01); *E06B 3/5054* (2013.01); *E05D 2015/485* (2013.01)

(58) Field of Classification Search
CPC ..... E05Y 2800/746; E05Y 2800/25; E05D 2015/482; E05D 15/48; E05D 15/54; E05D 15/58; E06B 3/5072; E06B 3/50
See application file for complete search history.

(56) References Cited

U.S. PATENT DOCUMENTS

| | | | | | |
|---|---|---|---|---|---|
| 704,887 | A * | 7/1902 | Low | E05F 17/00 | 160/181 |
| 3,266,189 | A * | 8/1966 | Eby | E06B 3/4654 | 49/152 |
| 3,318,047 | A * | 5/1967 | Carson | E06B 3/50 | 49/141 |
| 3,354,581 | A * | 11/1967 | Kessner | E06B 3/50 | 49/141 |
| 3,491,483 | A * | 1/1970 | Miller | E05D 15/0604 | 49/141 |
| 3,834,081 | A * | 9/1974 | Catlett | E06B 3/5072 | 49/118 |
| 4,305,227 | A * | 12/1981 | Georgelin | E05D 15/48 | 49/141 |
| 4,438,594 | A * | 3/1984 | Bunzl | E05D 15/58 | 49/125 |

(Continued)

*Primary Examiner* — Justin B Rephann
(74) *Attorney, Agent, or Firm* — Shane Cortesi

(57) ABSTRACT

The present invention relates to a breakout sliding door system for use in retail and other buildings. The system includes at least one door configured to slide open and closed and also breakout in at least one direction when a force is exerted on the doors in order to, for example, allow customers and employees to exit a building in the event of a fire. The system also includes a leveling system configured to keep at least one door level when it breaks out.

29 Claims, 54 Drawing Sheets

(56) References Cited

U.S. PATENT DOCUMENTS 4,503,637 A * 3/1985 Parente ..... E05D 15/06 49/118
4,534,395 A * 8/1985 Carroll ..... E05D 15/264 160/118
4,924,628 A * 5/1990 Ruby ..... E06B 3/4609 49/380
5,242,005 A * 9/1993 Borgardt ..... E05D 15/264 160/118
5,392,834 A * 2/1995 Borgardt ..... E06B 3/481 160/118
5,486,026 A * 1/1996 Borgardt ..... E05B 15/0205 292/71
5,581,944 A * 12/1996 Kornbrekke ..... E05D 11/0081 49/28
5,749,172 A * 5/1998 Isopahkala ..... E05D 15/0604 49/124
5,762,123 A * 6/1998 Kuyama ..... E05D 15/264 160/118
5,832,980 A * 11/1998 Cianciolo ..... E05D 15/58 160/197
6,058,665 A * 5/2000 Halvorson, Jr. ..... E05D 15/48 49/159
6,170,195 B1 * 1/2001 Lim ..... E05D 15/58 49/141
6,422,287 B1 * 7/2002 Wilke ..... E05D 15/58 160/195
6,526,695 B1 * 3/2003 Nguyen ..... E05D 7/1005 49/141
6,618,994 B1 * 9/2003 Nussbaum ..... E05B 53/003 292/171
7,451,802 B2 * 11/2008 Cianciolo ..... E05D 15/08 160/210
7,458,410 B1 * 12/2008 Bronner ..... E05D 15/0656 160/197
7,950,439 B2 * 5/2011 Anderson ..... E05D 15/58 160/195
8,096,342 B2 * 1/2012 Scruggs ..... E05D 15/0626 160/211
8,443,549 B2 * 5/2013 Salvietti ..... E05D 15/48 49/118
8,627,604 B2 * 1/2014 Seymour ..... E05D 15/58 49/125
8,756,865 B2 * 6/2014 Nicholson ..... E05D 15/58 49/142
2004/0025455 A1 * 2/2004 Nubel ..... E05D 15/063 52/204.51
2005/0028946 A1 * 2/2005 Weishar ..... E05D 15/54 160/214
2006/0150512 A1 * 7/2006 Heithe ..... E05B 65/10 49/141
2007/0169899 A1 * 7/2007 Cianciolo ..... E05D 15/08 160/211
2012/0073205 A1 * 3/2012 Hamaker ..... E06B 3/5072 49/163
2012/0255230 A1 * 10/2012 Smith ..... E05D 15/48 49/257

* cited by examiner

BREAKOUT SLIDING DOOR SYSTEM WITH PIVOTING ROD

RELATED APPLICATIONS

This application is a continuation-in-part of U.S. patent application Ser. No. 15/583,702, filed May 1, 2017 and entitled "Double Breakout Sliding Door System", which is a continuation of U.S. patent application Ser. No. 14/919,713, filed Oct. 21, 2015 and entitled "Double Breakout Sliding Door System", the contents of both of which are incorporated herein by reference in their entirety.

BACKGROUND

Technical Field

The present invention relates to automatic sliding door systems.

BACKGROUND OF THE INVENTION

Retail stores in the United States commonly use automatic sliding doors, which consist of a right door and a left door that slide along a sliding plane from a sliding closed position to a sliding open position when, for example, a motion sensor detects a shopper or employee. Fire code regulations generally require that such doors break open outward to allow egress of shoppers or employees from the store in the event of a fire. Such sliding doors typically only break open outward—not inward and hence are referred to herein as single breakout sliding doors.

While such systems are generally designed for the safety of pedestrian traffic, the movement of large or heavily loaded equipment often puts the door at risk of being damaged especially when moving such equipment into the store. Thus, sliding doors that break open outward and inwardly (referred to herein as double breakout sliding doors) are desired in some instances.

In prior art door systems, when a door breaks open outward, the bottom corner of the door that meets the other door when the doors are closed (also referred to as the nose) drops on the ground. This can be problematic in that the doors, which are heavy, must be raised to reset the normal sliding operation of the doors.

BRIEF SUMMARY

The present disclosure provides a sliding door system as described herein. In some embodiments, the sliding door system is a double breakout sliding door system. In other embodiments, the sliding door system is a single breakout sliding door system. Preferably, the sliding door systems allow adjustment of the doors to prevent the nose of the doors from dropping when breaking open outward (referred to herein as the front open position) and inward (referred to herein as the rear open position).

More particularly, the system may include: a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening; a left door comprising a left door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness; a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness; a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width; a top right panel located above the right door, the top right panel connected to the right door and comprising a top right panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right panel height perpendicular to the right door thickness, the top right panel thickness and the top right panel width; a motor; a left rod having a left rod top pivotally attached to the top left panel by a left pivot pin forming a left pivot pin axis and a left rod bottom attached to the left door left side, the left rod extending in a general downward direction from the top left panel at least partially through the left door; and a right rod having a right rod top pivotally attached to the top right panel by a right pivot pin forming a right pivot pin axis and a right rod bottom attached to the right door right side, the right rod extending in a general downward direction from the top right panel at least partially through the right door, wherein the motor is configured to slide the left door and right door in a sliding plane parallel to the system frame width from a sliding open position in which the left and right doors are apart and do not close the system frame opening to a sliding closed position in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein the left door is configured to rotate about the left rod from the sliding plane to a left door front open position when a force is exerted on the left door rear side perpendicular to the left door rear side when the left door is in the sliding plane, wherein the left door is configured to rotate about the left rod from the sliding plane to a left door rear open position when a force is exerted on the left door front side perpendicular to the left door front side when the left door is in the sliding plane, wherein the left door right side is in front of the rectangular door system frame and in front of the left door left side in the left door front open position and wherein the left door right side is to the rear of the rectangular door system frame and to the rear of the left door left side in the left door rear open position, and further wherein the right door is configured to rotate about the right rod from the sliding plane to a right door front open position when a force is exerted on the right door rear side perpendicular to the right door rear side when the right door is in the sliding plane, wherein the right door is configured to rotate about the right rod from the sliding plane to a right door rear open position when a force is exerted on the right door front side perpendicular to the right door front side when the right door is in the sliding plane, wherein the right door left side is in front of the rectangular door system frame and in front of the right door right side in the right door front open position and wherein the right door left side is to the rear of the rectangular door system frame and to the rear of the right door right side in the right door rear open position.

Optionally, the bottom of the left door right side is configured to remain at substantially the same height relative to the rectangular door system frame when the left door rotates about the left rod from the sliding plane to the left door front open position and to the left door rear open position and further wherein the bottom of the left side of the right door is configured to remain at substantially the same height relative to the rectangular door system frame when the right door rotates about the right rod from the sliding plane to the right door front open position and to the right door rear open position. Optionally, the system further comprises a left door top latch extending from the left door top, wherein the system further comprises a top left panel bottom latch extending from the top left panel bottom, wherein the left door top latch and the top left panel bottom latch are configured to mate when the left door is in the sliding plane and further wherein the left door top latch and the top left panel bottom latch are not configured to mate when the left door is in the left door front open position and the left door rear open position. Optionally, the top left panel bottom latch is configured to support the left door when the left door is in the sliding plane and further wherein the top left panel bottom latch is not configured to support the left door when the left door is in the left door front open position and the left door rear open position. Optionally, the left door top latch is adjacent to the left door right side, wherein the left door top latch comprises: i) a left door latch base comprising a left door latch base bottom attached to the left door top and a left door latch base top; ii) a left door latch flange located above the left door latch base and comprising a left door latch flange bottom, a left door latch flange top and a left door latch flange height extending from the left door latch flange bottom to the left door latch flange top; and iii) a left door latch slot located between the left door latch base and the left door latch flange and comprising a left door latch slot height extending from the left door latch base top to the left door latch flange bottom, wherein the top left panel bottom latch is adjacent to the top left panel right side, wherein the top left panel bottom latch comprises: i) a top left panel latch base comprising a top left panel latch base top attached to the top left panel bottom and a top left panel latch base bottom; ii) a top left panel latch flange located below the top left panel latch base and comprising a top left panel latch flange bottom, a top left panel latch flange top and a top left panel latch flange height extending from the top left panel latch flange bottom to the top left panel latch flange top; and iii) a top left panel latch slot located between the top left panel latch base and the top left panel latch flange and comprising a top left panel latch slot height extending from the top left panel latch base bottom to the top left panel latch flange top, wherein the top left panel latch slot height is greater than the left door latch flange height, wherein the left door latch slot height is greater than the top left panel latch flange height, wherein the left door latch flange is configured to be positioned in the top left panel latch slot when the left door is in the sliding plane, and further wherein the top left panel latch flange is configured to be positioned in the left door latch slot when the left door is in the sliding plane.

Optionally, the left door and the top left panel further comprises a ball detent comprising a ball, a recess configured to receive the ball, and a spring connected to the ball and configured to urge the ball toward the recess, and further wherein the ball is configured to move into the recess when the top left panel latch flange is positioned in the left door latch slot and the left door latch flange is positioned in the top left panel latch slot. Optionally, the left rod bottom is configured to be the sole point of attachment of the left door to the top left panel when the left door is in the left door front open position and the left door rear open position. Optionally, the left pivot pin axis and the right pivot pin axis are perpendicular to the system frame front side and the system frame rear side. Optionally, the top left panel further comprises a left adjustment fastener configured to engage the left rod and cause the left rod to pivot along the left pivot pin axis and further wherein the top right panel further comprises a right adjustment fastener configured to engage the right rod and cause the right rod to pivot along the right pivot pin axis. Optionally, pivoting of the left rod along the left pivot pin axis is configured to cause the bottom of the left door right side to move vertically relative to the top left panel and further wherein pivoting of the right rod along the right pivot axis is configured to cause the bottom of the right door left side to move vertically relative to the top right panel. Optionally, the left door comprises a left door frame comprising an interior and further wherein the left rod is located within the left door frame interior and further wherein the right door comprises a right door frame comprising an interior and further wherein the right rod is located within the right door frame interior. Optionally, the left rod bottom is hollow and surrounds a threaded shank of a left threaded bolt comprising a head and the threaded shank, wherein the left rod is fixed to the threaded shank of the left threaded bolt, wherein the left door further comprises a left door bracket located between the head of the left threaded bolt and the left rod bottom, wherein the left door bracket is attached to the left door frame, wherein the left door bracket is configured to rotate about the left rod and the left threaded bolt while the left rod and the left threaded bolt remain stationary as the left door moves from the sliding plane to the left door front open position and the left door rear open position and further wherein the bottom of the right rod is hollow and surrounds a threaded shank of a right threaded bolt comprising a head and the threaded shank, wherein the right rod is fixed to the threaded shank of the right threaded bolt, wherein the right door further comprises a right door bracket located between the head of the right threaded bolt and the bottom of the right rod, wherein the right door bracket is attached to the left door frame, wherein the right door bracket is configured to rotate about the right rod and the right threaded bolt while the right rod and the right threaded bolt remain stationary as the right door moves from the sliding plane to the right door front open position and the right door rear open position. Optionally, the system further comprises a left fastener fixing the left rod to the threaded shank of the left threaded bolt and a right fastener fixing the right rod to the threaded shank of the right threaded bolt. Optionally, the left door frame forms a perimeter around a plurality of left door glazing blocks and further wherein the right door frame forms a perimeter around a plurality of right door glazing blocks. Optionally, the plurality of left door glazing blocks are located between the left door frame and a left door glazing panel and further wherein the plurality of right door glazing blocks are located between the right door frame and a right door glazing panel. Optionally, the system further comprises a left door panel configured to remain fixed relative to the rectangular door system frame when the left door moves from the sliding closed position to the sliding open position, the left door panel located to the left of the left door when the left door is in the sliding closed position, wherein the left door is configured to slide to the rear of the left door panel when the left door slides from the sliding closed position to the sliding open position, wherein the left door panel is configured to move with the left door when the left door moves from the sliding plane to the left door front open position, and further wherein the left door panel is configured to remain fixed relative to the rectangular door system frame when the left door moves from the sliding plane to the left door rear open position. Optionally, the system further comprises a left track located above the top left panel and further wherein the system comprises a left wheel connected to the top left panel and located in the left track and further wherein the left wheel is configured to move along the left track when the top left panel and left door slide from the sliding closed position to the sliding open position and further wherein the system further comprises a right track located above the top right panel and further wherein the system comprises a right wheel connected to the top right panel and located in the right track and further wherein the right wheel is configured to move along the right track when the top right panel and right door slide from the sliding closed position to the sliding open position. Optionally, the motor is configured to move the left wheel along the left track and the right wheel along the right track. Optionally, the system further comprises a sensor in electronic communication with the motor and configured to cause the left door, the top left panel, the right door and the top right panel to move from the sliding plane to the sliding open position when the sensor detects an object in front of the left door and the right door. Optionally, moving the left door from the sliding plane to the left door front open position and the left door rear open position is configured to disable the motor.

In still further embodiments, the present disclosure provides a breakout sliding door system comprising one or more of the following features:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a left door comprising a left door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness;

c) a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness;

d) a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width;

e) a top right panel located above the right door, the top right panel connected to the right door and comprising a top right panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right panel height perpendicular to the right door thickness, the top right panel thickness and the top right panel width;

f) a motor;

g) a left rod having a left rod top pivotally attached to the top left panel by a left pivot pin forming a left pivot pin axis, a left rod bottom attached to the left door left side, and a left rod longitudinal axis extending from the left rod top to the left rod bottom, the left rod extending in a general downward direction from the top left panel at least partially through the left door, the left pivot pin transverse to the left rod longitudinal axis and attached to the top left panel; and h) a right rod having a right rod top pivotally attached to the top right panel by a right pivot pin forming a right pivot pin axis, a right rod bottom attached to the right door right side, and a right rod longitudinal axis extending from the right rod top to the right rod bottom, the right rod extending in a general downward direction from the top right panel at least partially through the right door, the right pivot pin transverse to the right rod longitudinal axis and attached to the top right panel.

Optionally, the motor is configured to slide the left door and right door in a sliding plane parallel to the system frame width from a sliding open position in which the left and right doors are apart and do not close the system frame opening to a sliding closed position in which the left door moves rightwardly and the right door moves leftwardly and in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein, when the left door moves from the sliding plane to a left door front open position when a force is exerted on the left door rear side perpendicular to the left door rear side when the left door is in the sliding plane, i) the left door is configured to rotate around the left rod about a left rotational plane generally perpendicular to the left rod longitudinal axis, ii) the left door is configured to rotate relative to the top left panel and iii) the left rod is configured to remain stationary relative to the top left panel, wherein the left door right side is in front of the rectangular door system frame and in front of the left door left side in the left door front open position, wherein, when the right door moves from the sliding plane to a right door front open position when a force is exerted on the right door rear side perpendicular to the right door rear side when the right door is in the sliding plane, i) the right door is configured to rotate around the right rod about a right rotational plane generally perpendicular to the right rod longitudinal axis, ii) the right door is configured to rotate relative to the top right panel and iii) the right rod is configured to remain stationary relative to the top right panel, and further wherein the right door left side is in front of the rectangular door system frame and in front of the right door right side in the right door front open position.

Optionally, the bottom of the left door right side is configured to remain at substantially the same height relative to the rectangular door system frame when the left door rotates around the left rod from the sliding plane to the left door front open position and further wherein the bottom of the right door left side is configured to remain at substantially the same height relative to the rectangular door system frame when the left door rotates around the left rod from the sliding plane to the left door front open position. Optionally, the left rod bottom is configured to be the sole point of attachment of the left door to the top left panel when the left door is in the left door front open position and further wherein the right rod bottom is configured to be the sole point of attachment of the right door to the top right panel when the right door is in the right door front open position. Optionally, the left pivot pin axis and the right pivot pin axis are perpendicular to the system frame front side and the system frame rear side. Optionally, the top left panel further comprises a left adjustment fastener configured to engage the left rod and cause the left rod to move about the left pivot pin axis in a plane generally perpendicular to the left rotational plane and further wherein the top right panel further comprises a right adjustment fastener configured to engage the right rod and cause the right rod to move about the right pivot pin axis in a plane generally perpendicular to the right rotational plane. Optionally, moving the left rod about the left pivot pin axis is configured to cause the bottom of the left door right side to move vertically relative to the top left panel and further wherein moving the right rod about the right pivot axis is configured to cause the bottom of the right door left side to move vertically relative to the top right panel. Optionally, the left door comprises a left door frame comprising an interior and further wherein the left rod is located within the left door frame interior and further wherein the right door comprises a right door frame comprising an interior and further wherein the right rod is located within the right door frame interior. Optionally, the left rod bottom is hollow and surrounds a threaded shank of a left threaded bolt comprising a head and the threaded shank, wherein the left rod is fixed to the threaded shank of the left threaded bolt, wherein the left door further comprises a left door bracket located between the head of the left threaded bolt and the left rod bottom, wherein the left door bracket is attached to the left door frame, wherein the left door bracket is configured to rotate about the left rod and the left threaded bolt while the left rod and the left threaded bolt remain stationary as the left door moves from the sliding plane to the left door front open position and further wherein the bottom of the right rod is hollow and surrounds a threaded shank of a right threaded bolt comprising a head and the threaded shank, wherein the right rod is fixed to the threaded shank of the right threaded bolt, wherein the right door further comprises a right door bracket located between the head of the right threaded bolt and the bottom of the right rod, wherein the right door bracket is attached to the left door frame, wherein the right door bracket is configured to rotate about the right rod and the right threaded bolt while the right rod and the right threaded bolt remain stationary as the right door moves from the sliding plane to the right door front open position. Optionally, the system further comprises a left fastener fixing the left rod to the threaded shank of the left threaded bolt and a right fastener fixing the right rod to the threaded shank of the right threaded bolt. Optionally, the system further comprises a left door top latch extending from the left door top, wherein the system further comprises a top left panel bottom latch extending from the top left panel bottom, wherein the left door top latch and the top left panel bottom latch are configured to mate when the left door is in the sliding plane and further wherein the left door top latch and the top left panel bottom latch are not configured to mate when the left door is in the left door front open position. Optionally, the top left panel bottom latch is configured to support the left door when the left door is in the sliding plane and further wherein the top left panel bottom latch is not configured to support the left door when the left door is in the left door front open position. Optionally, the left rod is attached to a left spring having a top end attached to the left rod bottom and a bottom end attached to the left door frame and further wherein the rotation of the left door around the left rod about the left rotational plane generally perpendicular to the left rod longitudinal axis when the left door moves from the sliding plane to the left door front open position beyond a pre-determined angle is configured to cause said left spring to bias the left door to the sliding plane, and further wherein the right rod is attached to a right spring having a top end attached to the right rod bottom and a bottom end attached to the right door frame and further wherein the rotation of the right door around the right rod about the right rotational plane generally perpendicular to the right rod longitudinal axis when the right door moves from the sliding plane to the right door front open position beyond a pre-determined angle is configured to cause said right spring to bias the right door to the sliding plane. Optionally, the left door further comprises a lock system comprising a depressible panic bar coupled to a gear coupled to a top lock rod, and further wherein the depressible panic bar has a resting state in which the left door is unable to move from the sliding plane to the left door front open position and a depressed state in which the left door is able to move from the sliding plane to the left door front open position, and further wherein depressing the panic bar when the panic bar is in the resting state is configured to cause the panic bar to rotate the gear and further wherein rotation of the gear is configured to cause the top lock rod to move downwardly so that the left door may move from the sliding plane to the front open position. Optionally, the lock system further comprises a bottom lock rod coupled to the gear and further wherein depressing the panic bar when the panic bar is in the resting state is configured to cause the panic bar to rotate the gear and further wherein rotation of the gear is configured to cause the bottom lock rod to move upwardly. Optionally, the lock system further comprises a bottom lock pin located below the bottom lock rod and having a bottom lock pin height, a bottom lock pin upper flange and a bottom lock pin lower flange and a bottom lock pin tip located at a bottom of the bottom lock pin, a bottom lock recess configured to receive the bottom lock pin tip, a bracket comprising an upper portion fixed to the bottom lock rod and a lower portion located below the upper portion and having an aperture receiving the bottom lock pin, the lower portion configured to slide along a portion of the bottom lock pin height between the bottom lock pin upper flange and bottom lock pin lower flange, and further wherein the lock system comprises a bottom lock inactive state in which the bottom lock pin tip is located above the bottom lock recess and in which depressing the panic bar is configured to cause the gear to rotate and move the bottom lock rod upwardly and further wherein moving the bottom lock rod upwardly is configured to cause the bracket to move upwardly toward the bottom lock pin upper flange without moving the bottom lock pin upwardly and a bottom lock active state in which the bottom lock pin tip is located in the bottom lock recess and in which depressing the panic bar is configured to cause the gear to rotate and move the bottom lock rod upwardly and further wherein moving the bottom lock rod upwardly in the active state is configured to cause the bracket to move the bottom lock pin upper flange upwardly and the bottom lock pin upwardly (to a positive locked position) so that the bottom lock pin tip moves out of the bottom lock recess. Optionally, when the bottom lock pin tip is in the bottom lock recess, the left door is unable to move from the sliding plane to the left door front open position and the left door is unable to move from the sliding closed position to the sliding open position. Optionally, the lock system further comprises a depressible bottom lock button configured to move the bottom lock from the inactive state to the active state, a moveable support, a spring flange located on the bottom lock pin and a bottom lock spring having a bottom end confronting the spring flange, and further wherein depressing the bottom lock button while the bottom lock is in the inactive state is configured to cause i) the moveable support to move, ii) the bottom end of the bottom lock spring to move downwardly, iii) the bottom lock pin to move downwardly; and iv) to move the bottom lock to the active state. Optionally, the system further comprises a cover plate and a hinge, the cover plate configured to pivot along the hinge from a closed position in which the cover plate covers the depressible bottom lock button to an open position in which the cover plate does not cover the depressible bottom lock button. Optionally, the bottom lock rod and the top lock rod are at least partially located on the right side of the left door. Optionally, the top lock rod extends into the top panel when the door is in the sliding plane and the panic bar is in the resting state. Optionally, the system further comprises a left door panel configured to remain fixed relative to the rectangular door system frame when the left door moves from the sliding closed position to the sliding open position, the left door panel located to the left of the left door when the left door is in the sliding closed position, wherein the left door is configured to slide to the rear of the left door panel when the left door slides from the sliding closed position to the sliding open position, and further wherein the left door panel is configured to move with the left door when the left door moves from the sliding plane to the left door front open position. Optionally, the system further comprises a left track located above the top left panel and further wherein the system comprises a left wheel connected to the top left panel and located in the left track and further wherein the left wheel is configured to move along the left track when the top left panel and left door slide from the sliding closed position to the sliding open position and further wherein the system further comprises a right track located above the top right panel and further wherein the system comprises a right wheel connected to the top right panel and located in the right track and further wherein the right wheel is configured to move along the right track when the top right panel and right door slide from the sliding closed position to the sliding open position. Optionally, the motor is configured to move the left wheel along the left track and the right wheel along the right track.

In still further embodiments, the present disclosure provides a breakout sliding door system comprising at least one door. More particularly, the system may include one or more of the following features:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a door comprising a front side, a rear side, a door thickness extending from the front side to the rear side, a left side, a right side, a width extending from the left side to the right side, the width perpendicular to the thickness, a top, a bottom, and a height extending from the top to the bottom, the height perpendicular to the width and the thickness;

c) a top panel located above the door, the top panel connected to the door and comprising a top panel left side, a top panel right side, a top panel top, a top panel bottom located below the system frame top, a top panel height extending from the top panel top to the top panel bottom, a top panel front side, a top panel rear side, and a top panel thickness extending from the top panel front side to the top panel rear side, the top panel height perpendicular to the door thickness, the top panel thickness and the top panel width;

d) a motor; and e) a rod having a rod top pivotally attached to the top panel by a pivot pin forming a pivot pin axis, a rod bottom attached to the door, and a rod longitudinal axis extending from the rod top to the rod bottom, the rod extending in a general downward direction from the top panel at least partially through the door, the pivot pin transverse to the rod longitudinal axis and attached to the top panel, wherein the motor is configured to slide the door in a sliding plane parallel to the system frame width from a sliding open position to a sliding closed position, wherein the top panel is configured to slide with the door from the sliding open position to the sliding closed position, wherein, when the door moves from the sliding plane to a door front open position when a force is exerted on the door rear side perpendicular to the door rear side when the door is in the sliding plane, i) the door is configured to rotate around the rod about a rotational plane generally perpendicular to the rod longitudinal axis, ii) the door is configured to rotate relative to the top panel and iii) the rod is configured to remain stationary relative to the top panel, wherein the door right side or the door left side is in front of the rectangular door system frame in the door front open position.

The system may include one or more features of the two door system described above.

BRIEF DESCRIPTION OF THE DRAWINGS

in FIG. 1, the left and right doors are level relative to the top left panel, the top right panel and the ground and in the sliding open position.

in FIG. 2, the left and right doors are level relative to the top left panel, the top right panel and the ground and, as compared to FIG. 1, the left door and the right door have moved along the sliding plane from the sliding open position to the sliding closed position.

in FIG. 3, the left and right doors are level relative to the top left panel, the top right panel and the ground and in the sliding open position.

in FIG. 4, the left and right doors are level relative to the top left panel, the top right panel and the ground and in the rear open position.

in FIG. 5, the left and right doors are level relative to the top left panel, the top right panel and the ground and in the front open position.

in FIG. 7, the rear portion of the left side of the frame of the left door is removed and a portion of the rear of the top left panel is removed.

in FIG. 8A, the upper lock of the door is locked and the ball of the detent is located in the recess.

FIG. 9C shows how the top left panel bottom latch and the left door top latch mate when the left door is in the sliding plane.

in FIG. 10 the left door is level relative to the top left panel and the ground and in the sliding plane.

in FIG. 11 the left door is level relative to the top left panel and the ground and between the sliding plane and the left door front open position.

in FIG. 12 the left door is level relative to the top left panel and the ground and between the sliding plane and the left door front open position.

in FIG. 13 the left door is level relative to the top left panel and the ground and in the left door front open position.

in FIG. 14 the left door is level relative to the top left panel and the ground and in the left door rear open position.

in FIG. 15, a portion of the rear of the left side of the frame of the left door is removed and a portion of the rear of the top left panel is removed.

in FIG. 16, a portion of the rear of the left side of the frame of the left door is removed and a portion of the rear of the top left panel is removed, the left door is not level relative to the top left panel and the ground and a line and arrows show how the left rod may be pivoted by adjusting a left adjustment fastener.

in FIG. 17, the ball of the detent is located in the recess.

in FIG. 18, the ball of the detent is not located in the recess.

in FIG. 19, the left door is located between the sliding plane and the left door front open position.

in FIG. 20, the rear portion of the left side of the frame of the left door is removed and a portion of the rear of the top left panel is removed.

in FIG. 21, the left side of the frame of the left door is removed in order to better show the left rod and left door bracket.

in FIG. 22, the left side of the frame of the left door is partially removed in order to better show the left rod and left door bracket.

in FIG. 23, the left side of the frame of the left door is partially removed in order to better show the left rod and left door bracket.

in FIG. 23A, the left door bracket has rotated slightly relative to the left rod as compared to FIG. 22A.

in FIG. 24, the left side of the frame of the left door is partially removed in order to better show the left rod and left door bracket.

in FIG. 24A, the left door bracket has rotated relative to the left rod as compared to FIG. 22A and FIG. 23A.

in FIG. 30, the door is level relative to the top panel and the ground, and is in the sliding plane; in FIG. 30 a portion of the left side of the frame of the door is removed to show the rod and spring.

in FIG. 31, the door is level relative to the top panel and the ground, and is in the sliding plane and a portion of the left side of the frame of the door is removed to show the rod and spring.

in FIG. 34 the door is in the sliding plane.

in FIG. 35 the door is in the front open position.

in FIG. 36, the door is level relative to the top panel and the ground, and is in the sliding plane.

in FIG. 46, the bottom lock button has not been pushed/activated and thus the slip-joint slides along the height of the bottom portion of the bottom lock rod without lifting bottom pin when the panic bar is pushed, and bottom pin is above the lock recess.

in FIG. 47, the bottom lock button has been pushed/activated and the bottom pin is in the lock recess.

in FIG. 48, the bottom lock button has not been pushed/activated, the bottom pin is above the lock recess, and the arrows show movement of the slip-joint along the height of the bottom portion of the bottom lock rod when the panic bar is pushed.

in FIG. 49, the bottom lock button has not been pushed/activated, and the bottom pin is above the lock recess.

in FIG. 50, the bottom lock button has been pushed/activated, the panic bar has not been pushed, and the bottom pin is in the lock recess, preventing the door from moving from the sliding plane to the front open position as well as preventing the door from sliding from the sliding closed position to the sliding open position.

in FIG. 51, the bottom lock button was previously pushed/activated, and in FIG. 51 the panic bar has been pushed, and the bottom pin is above the lock recess, allowing the door to move from the sliding plane to the front open position.

in FIG. 57, a close-up of the bottom lock is shown and the bottom pin is above the recess because the bottom lock button has not been pushed/activated.

in FIG. 60, the door is level relative to the top panel and the ground, and is in the sliding plane; in FIG. 60 a portion of the left side of the frame of the door is removed to show the rod and spring.

in FIG. 61, the door is level relative to the top panel and the ground, and is in the sliding plane; in FIG. 61 a portion of the left side of the frame of the door is removed to show the rod and spring.

in FIG. 62, a portion of the top panel has been removed to better show the lock and the top lock is in the locked position preventing the door from moving from the sliding plane to the front open position.

in FIG. 63, the top rod has moved vertically downward and the cam has rotated, allowing the door to move from the sliding plane to the front open position.

in FIG. 64, the top rod and cam are in the same position as in FIG. 62 and the top lock is in the locked position; in FIG. 64, the door is in the sliding plane.

in FIG. 65, the top rod and cam are in the same position as in FIG. 63 and the top lock is in the unlocked position; in FIG. 65, the door is not in the sliding plane.

DETAILED DESCRIPTION

Figure 1:
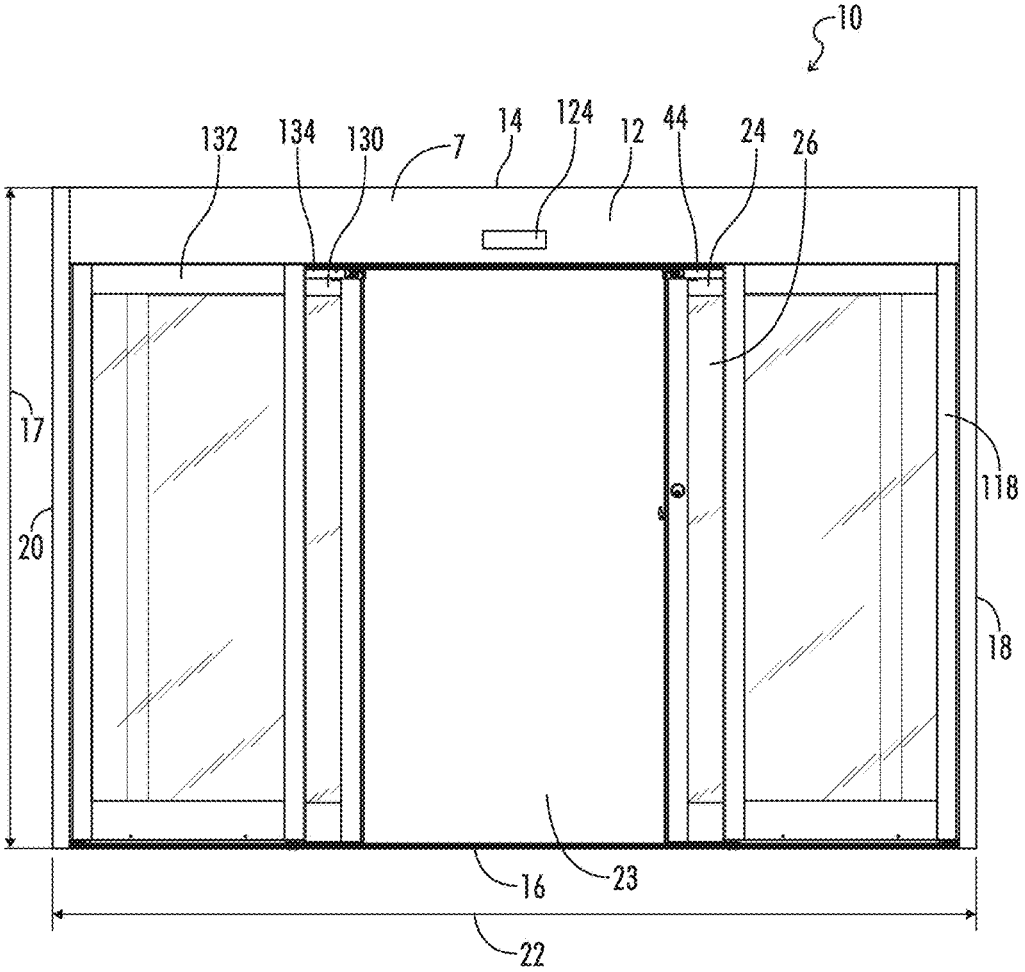
FIG. 1 illustrates a front, elevation view of a double breakout sliding door system of one embodiment of the present invention.

With reference to FIGS. 1-29, the present invention provides a double breakout sliding door system designated by the numeral 10. In the drawings, not all reference numbers are included in each drawing for the sake of clarity.

Referring further to FIGS. 1-29, in some embodiments, the double breakout sliding door system 10 includes a rectangular door system frame 12 comprising a system frame front side 7, a system frame rear side 8, a system frame thickness 9 extending from the system frame front side 7 to the system frame rear side 8, a system frame top 14, a system frame bottom 16, a system frame height 17 extending from the system frame top 14 to the system frame bottom 16, a system frame left side 18, a system frame right side 20, and a system frame width 22 extending from the system frame left side 18 to the system frame right side 20, the rectangular door system frame 12 defining a system frame opening 23. It will be appreciated that the system frame bottom 16 may be the ground, as shown in FIGS. 1-5, for example. (The terminology "door system frame" is also referred to as merely a "door frame" in the art; the extra word "system" is used herein to differentiate the door system frame/door frame 12 from the left door frame 102—i.e., the frame that forms part of the left door 24—which is later described herein).

The double breakout sliding door system 10 further includes a left door 24 comprising a left door front side 26, a left door rear side 28, a left door thickness 30 extending from the left door front side 26 to the left door rear side 28, a left door left side 32, a left door right side 34, a left door width 36 extending from the left door left side 32 to the left door right side 34, the left door width 36 perpendicular to the left door thickness 30, a left door top 38, a left door bottom 40, and a left door height 42 extending from the left door top 38 to the left door bottom 40, the left door height 42 perpendicular to the left door width 36 and the left door thickness 30, the left door width 36 parallel to the system frame width 22, when the left door 24 is in the sliding plane (as described below).

Figure 2:
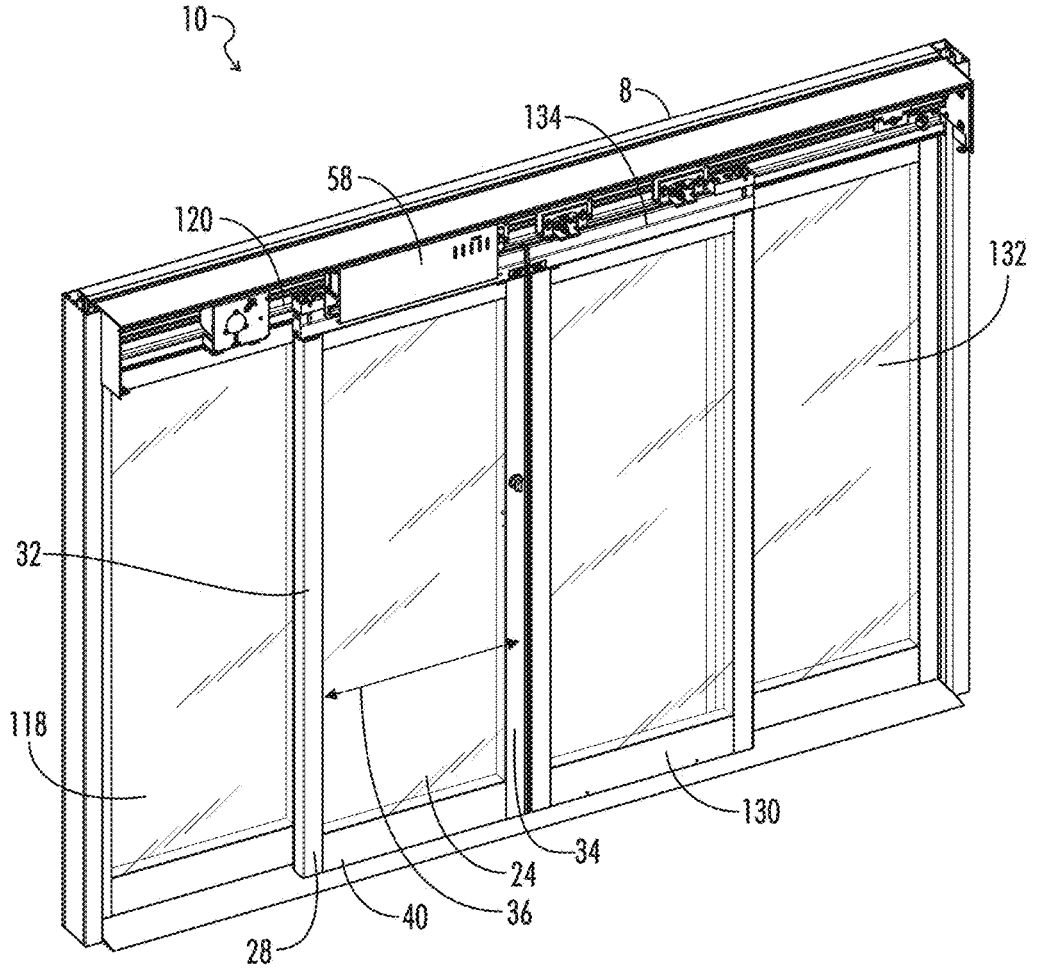
FIG. 2 illustrates a rear, perspective view of the double breakout sliding door system of FIG. 1.

In the present application, it will be understood that the adjectives "left" and "right" are used to label components such as the doors, panels, and rods by viewing the double breakout sliding door system 10 from the rear, as shown in FIG. 2.

The double breakout sliding door system 10 optionally further includes a right door 130. The right door 130 is optionally a mirror image of the left door 24, except that for the locks 126 and 128, for example, as later described. Given the duplicity of the components and design, the parts of the right door 130 are not numbered in the drawings.

The double breakout sliding door system 10 optionally further includes a top left panel 44 (known in the art as a "carrier") located above the left door 24, the top left panel 44 connected to the left door 24 and comprising a top left panel left side 45, a top left panel right side 47, a top left panel width 49 extending from the top left panel left side 45 to the top left panel right side 47, a top left panel top 46, a top left panel bottom 48 located below the system frame top 14 and the system frame opening 23, a top left panel height 50 extending from the top left panel top 46 to the top left panel bottom 48, a top left panel front side 52, a top left panel rear side 54, and a top left panel 56 thickness extending from the top left panel front side 52 to the top left panel rear side 54, the top left panel height 50 parallel to the left door height 42 when the left door 24 is in the sliding plane and perpendicular to the left door thickness 30 and the top left panel thickness 56 and the top left panel width 49. The top left panel 44 may be comprised of two or more discrete parts (e.g., a block 136 mounted on top of a top left panel frame piece 138, which may be for example comprised of extruded aluminum) and may have a variable height 50, as best seen in FIGS. 6-8, 10, 10A, 11-16, 19, 19A, 20, 20A, 21, 22, 23, 23A, 24, and 26-29.

The double breakout sliding door system 10 optionally further includes a top right panel 134. The top right panel 134 is optionally a mirror image of the top left panel 44, except for the top lock 128, for example, as later described. Given the duplicity of the components and design, the parts of the top right panel 134 are not numbered in the drawings.

The double breakout sliding door system 10 optionally further includes a motor 58.

Figure 20:
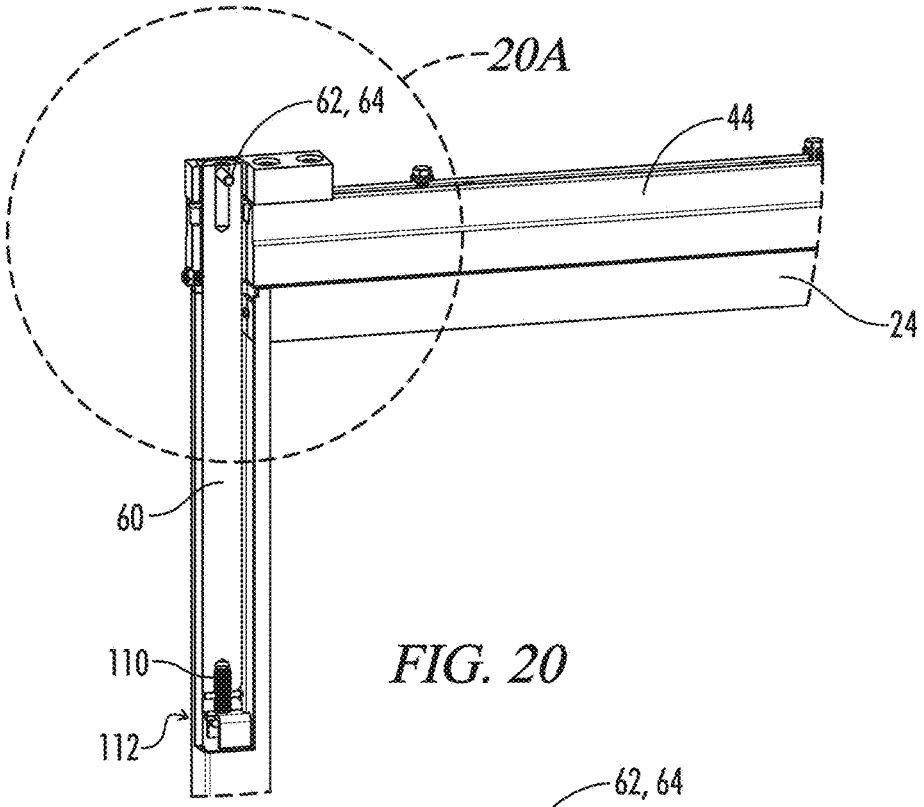
FIG. 20 illustrates a rear, perspective view of the left door and top left panel of the double breakout sliding door system of FIG. 1 and the left door is level relative to the top left panel and the ground and in the sliding plane.
Figure 20A:
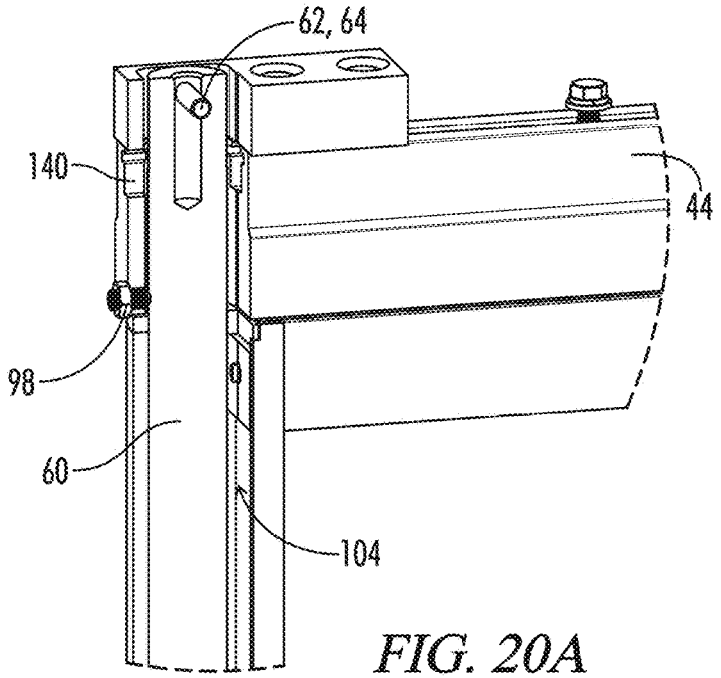
FIG. 20A illustrates a rear, perspective, close-up view of the circled area labelled 20A in FIG. 20.
Figure 21:
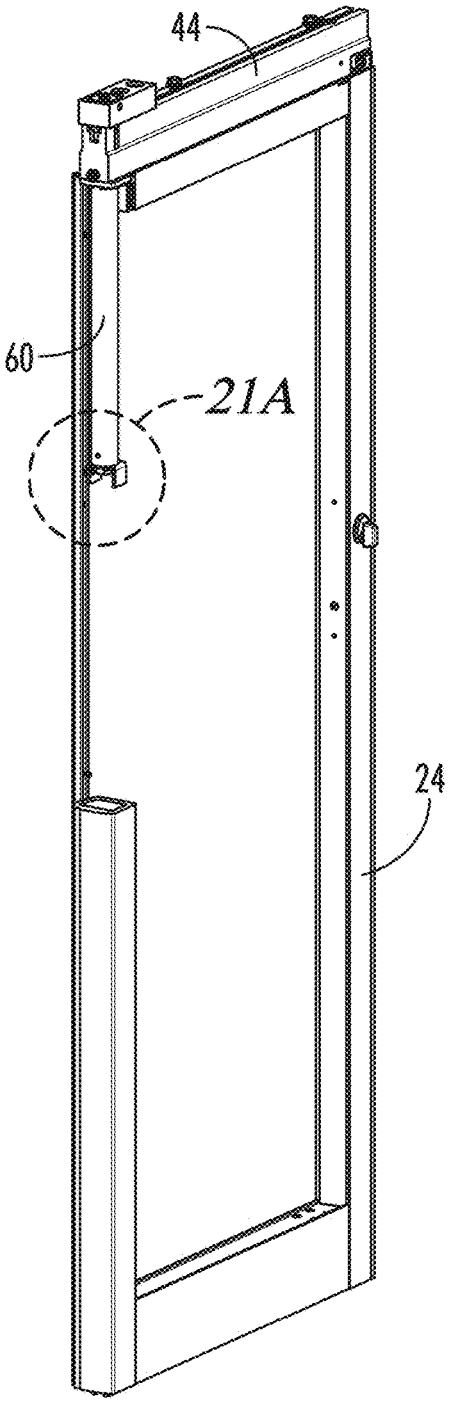
FIG. 21 illustrates a rear, perspective view of the left door and the top left panel of the double breakout sliding door system of FIG. 1 and the left door is level relative to the top left panel and the ground and in the sliding plane.
Figure 21A:
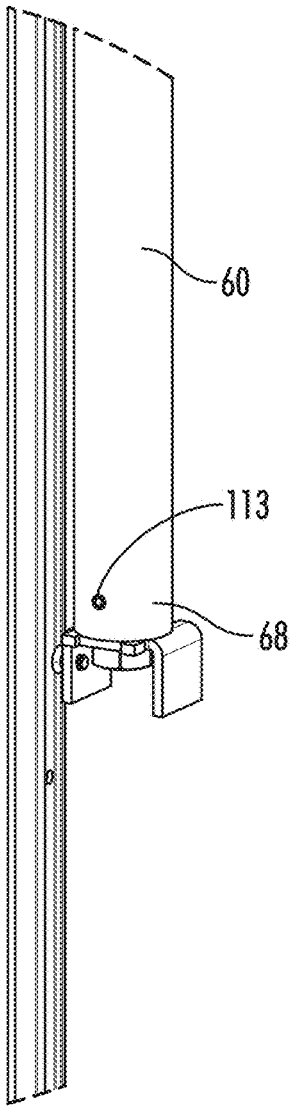
FIG. 21A illustrates a rear, perspective, close-up view of the circled area labelled 21A in FIG. 21.
Figure 22:
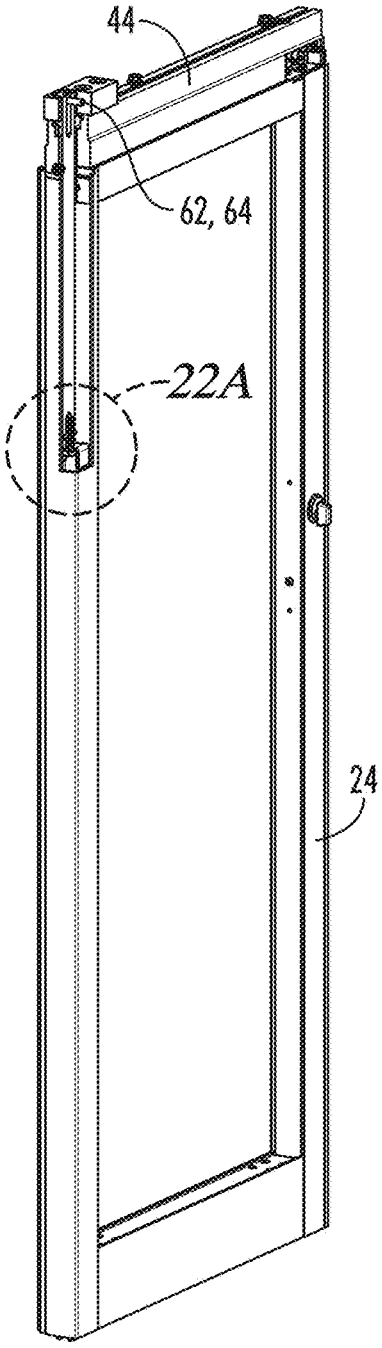
FIG. 22 illustrates a rear, perspective view of the left door and the top left panel of the double breakout sliding door system of FIG. 1 and the left door is level relative to the top left panel and the ground and in the sliding plane.
Figure 22A:
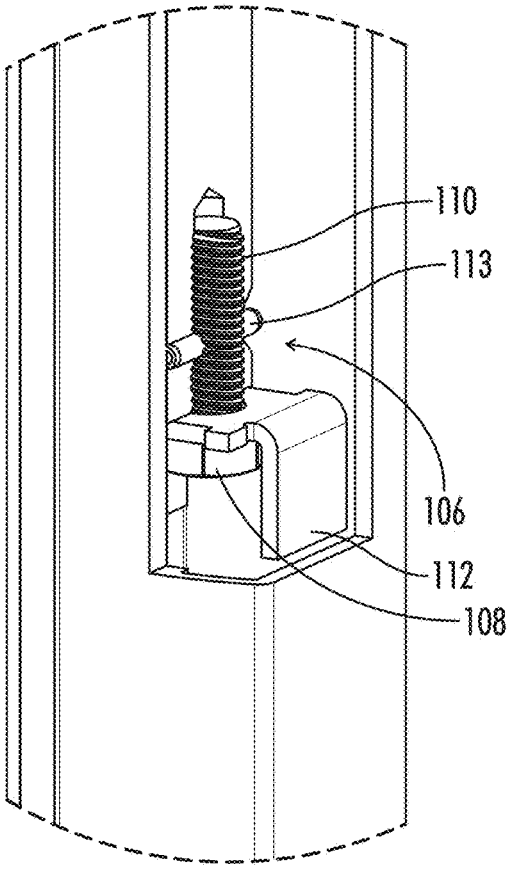
FIG. 22A illustrates a rear, perspective, close-up view of the circled area labelled 22A in FIG. 22.
Figure 23:
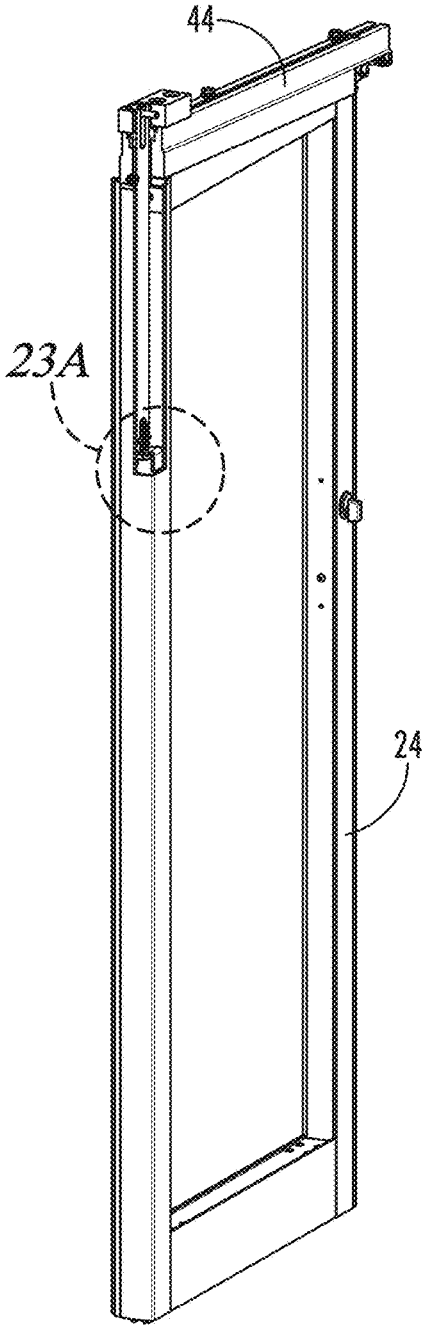
FIG. 23 illustrates a rear, perspective view of the left door and the top left panel of the double breakout sliding door system of FIG. 1 and the left door is level relative to the top left panel and the ground and between the sliding plane and the left door front open position.
Figure 23A:
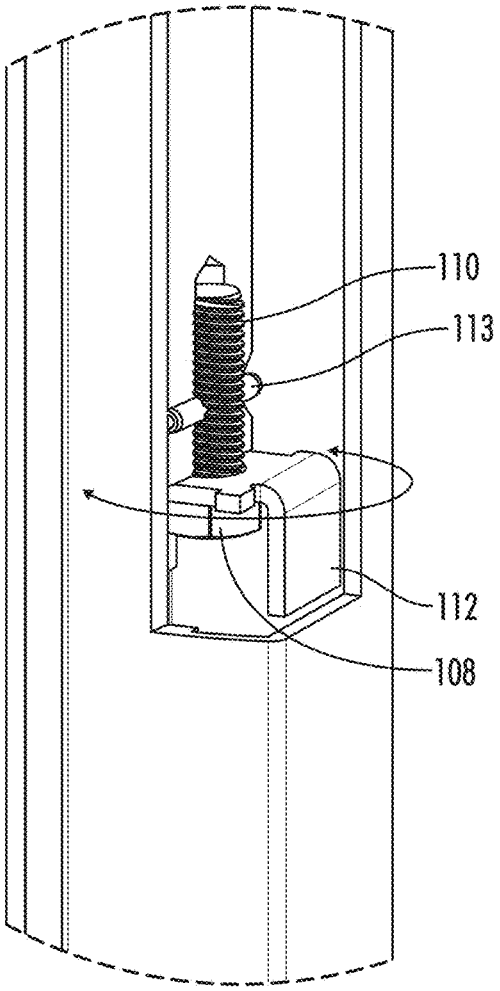
FIG. 23A illustrates a rear, perspective, close-up view of the circled area labelled 23A in FIG. 23.

The double breakout sliding door system 10 optionally further includes a left rod 60 having a left rod top 66 pivotally attached to the top left panel 44 by a left pivot pin 62 forming a left pivot pin axis 64 and a left rod bottom 68 attached to the left door left side 32, the left rod 60 extending in a general downward direction from the top left panel 44 at least partially through the left door 24. The left rod 60 optionally is generally cylindrical in shape. It will be understood that the left pivot pin 62 and left pivot pin axis 64 do not have to be at the very top end of the left rod 60 and that the attachment point of the left rod 60 to the left door 24 does not have to be at the very bottom end of the left rod 60—rather the left pivot pin 62 and left pivot pin axis 64 are attached to the left rod top 66 (i.e., attached adjacent to the top end of the left rod 60) and the attachment point of the left rod 60 to the left door 24 is at the left rod bottom 68 (i.e., adjacent to the bottom end of the left rod 60). As best seen in FIG. 20A, the left rod 60 passes through a slot 140 that extends from the top left panel 44 at least partially through the left door 24.

The double breakout sliding door system 10 optionally further includes a right rod (not shown). The right rod is optionally a mirror image of the left rod 60. Given the duplicity of the components and design, the right rod parts are not numbered in the drawings.

Figure 3:
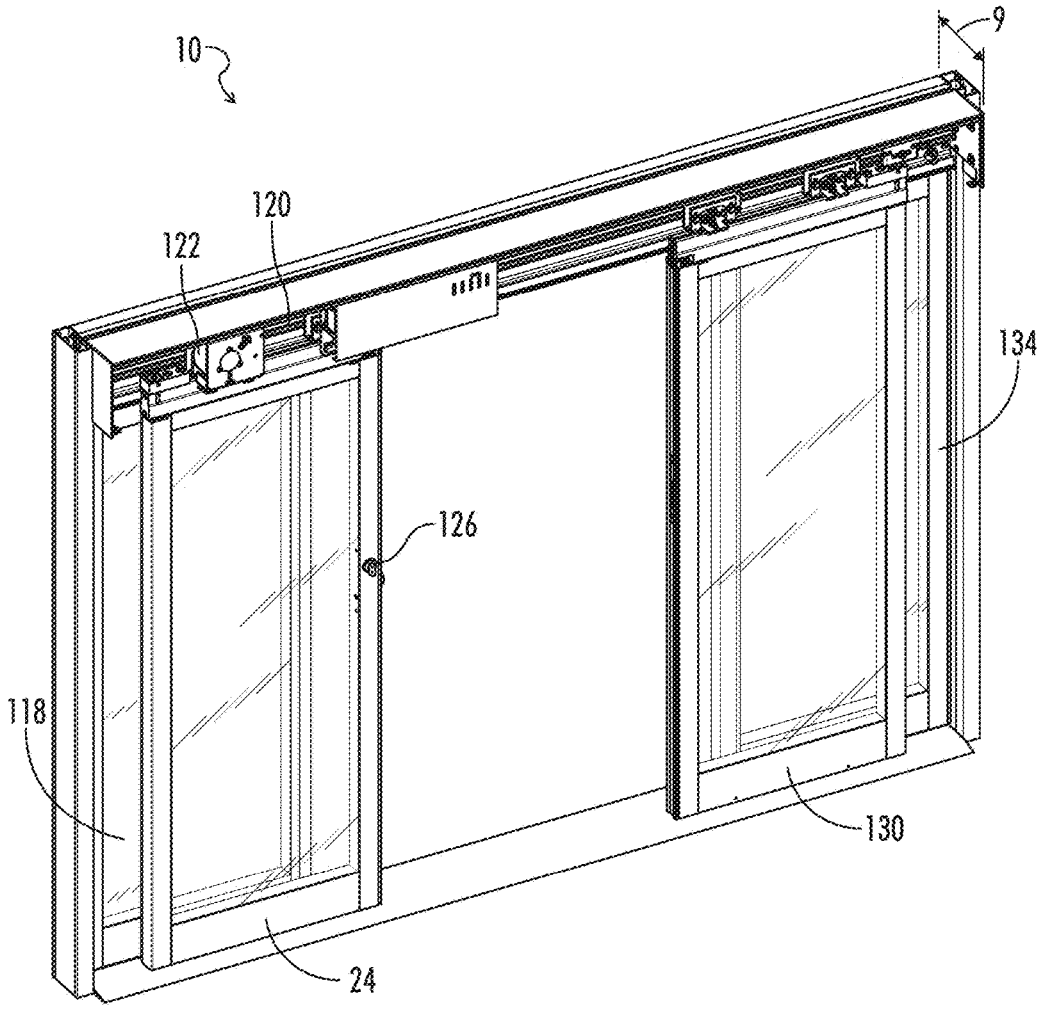
FIG. 3 illustrates a rear, perspective view of the double breakout sliding door system of FIG. 1.

Optionally, the motor 58 is configured to slide the left door 24 and right door 130, i.e., move the left door 24 and right door 130 horizontally along a sliding plane parallel to the system frame width 22, from a sliding open position in which the left door 24 and right door 130 are apart and do not close the system frame opening 23 (as illustrated in FIGS. 1 and 3) to a sliding closed position in which the left door 24 and right door 130 meet to close the system frame opening 23 (as illustrated in FIG. 2). It will be appreciated that when the left door 24 is in the sliding plane, the left door width 36 is parallel to the system frame width 22.

Optionally, the top left panel 44 is configured to slide with the left door 24 from the sliding open position to the sliding closed position and the top right panel 134 is configured to slide with the right door 130 from the sliding open position to the sliding closed position.

Figure 4:
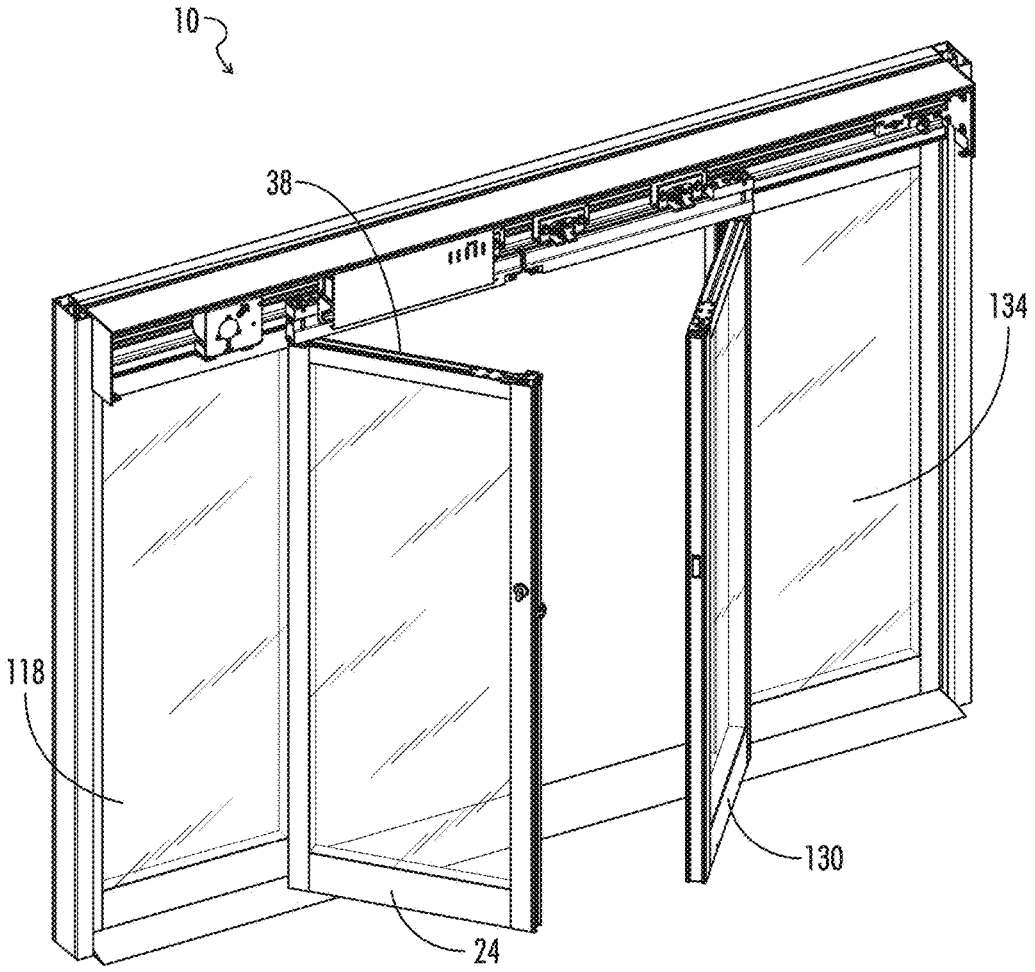
FIG. 4 illustrates a rear, perspective view of the double breakout sliding door system of FIG. 1.
Figure 5:
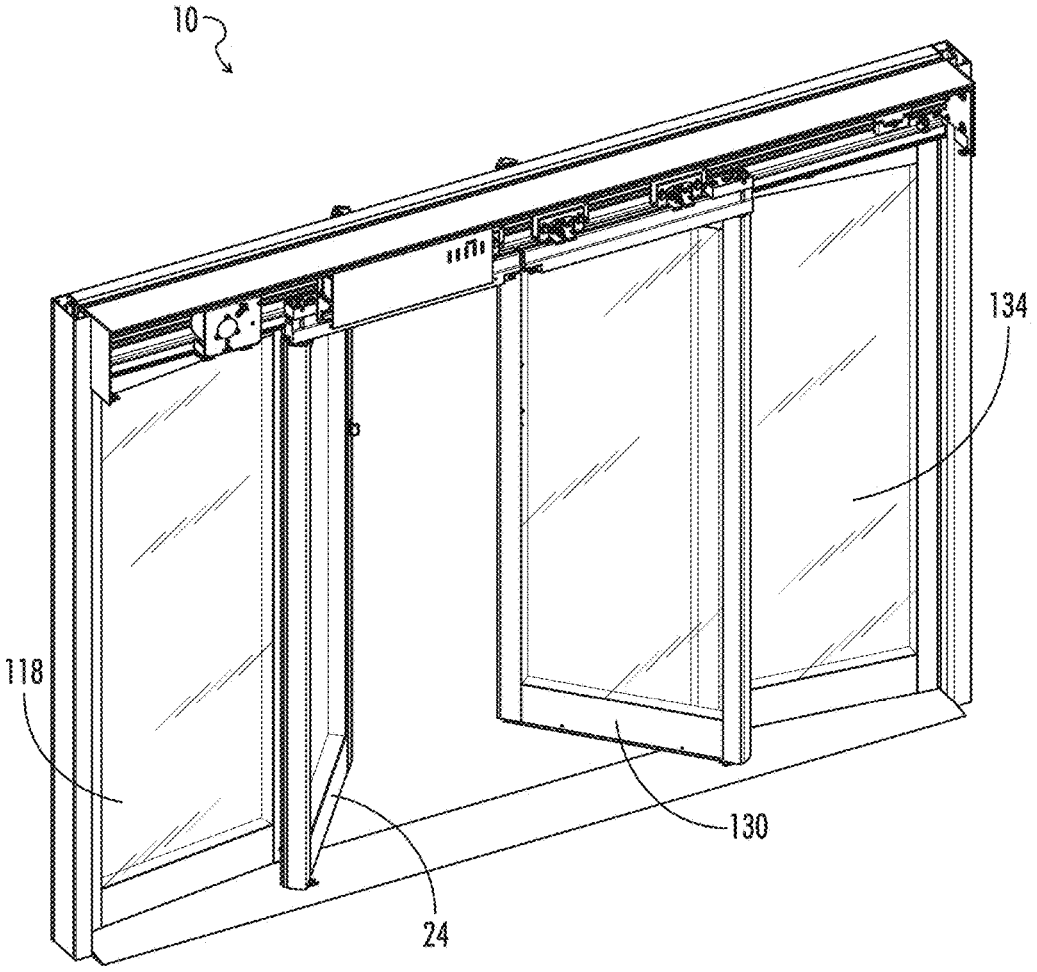
FIG. 5 illustrates a rear, perspective view of the double breakout sliding door system of FIG. 1.
Figure 6:
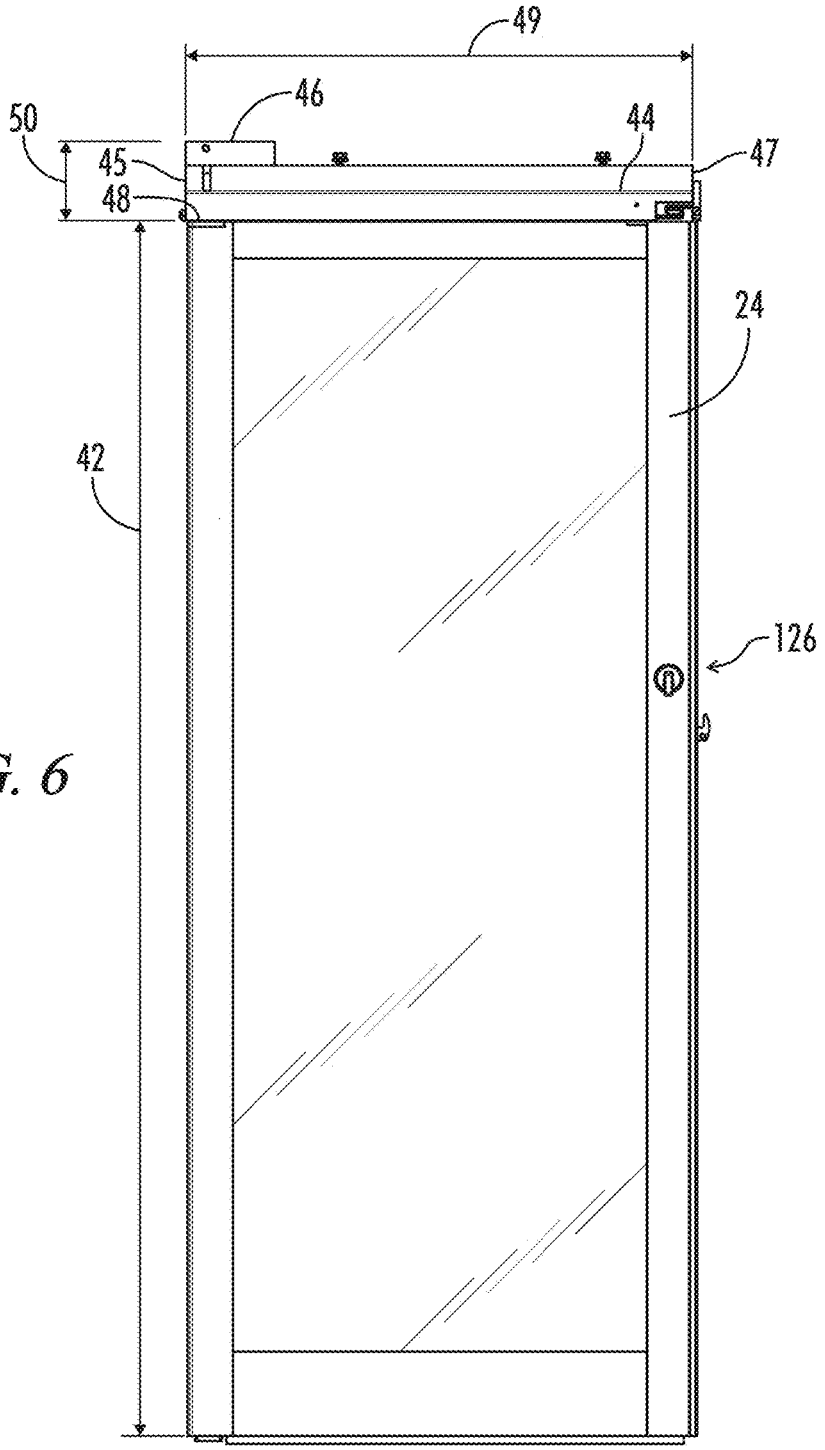
FIG. 6 illustrates a rear, elevation view of the left door and the top left panel of the double breakout sliding door system of FIG. 1 and the left door is level relative to the top left panel and the ground and in the sliding plane.
Figure 7:
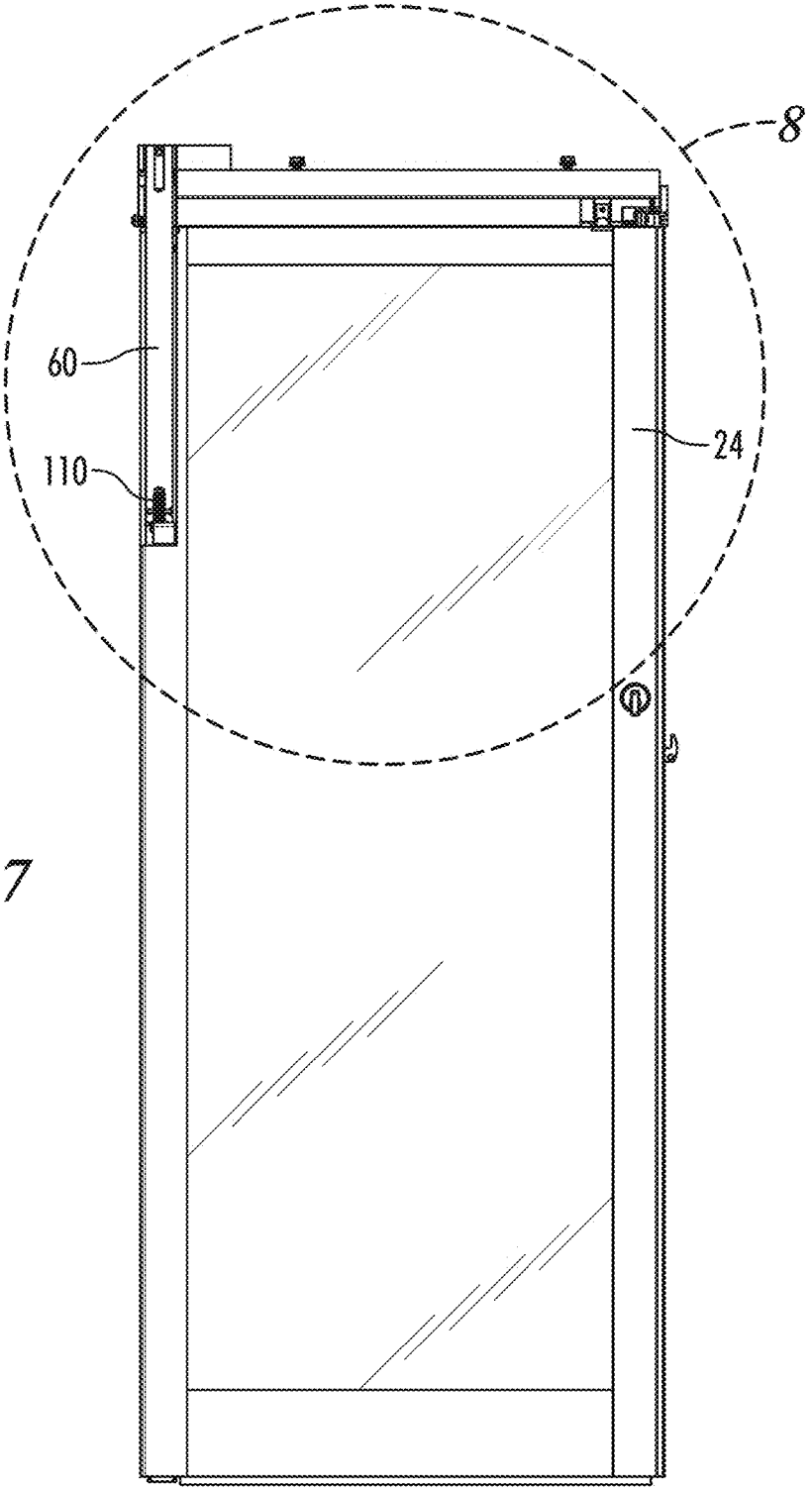
FIG. 7 illustrates a rear, elevation view of the left door and the top left panel of FIG. 6.
Figure 8:
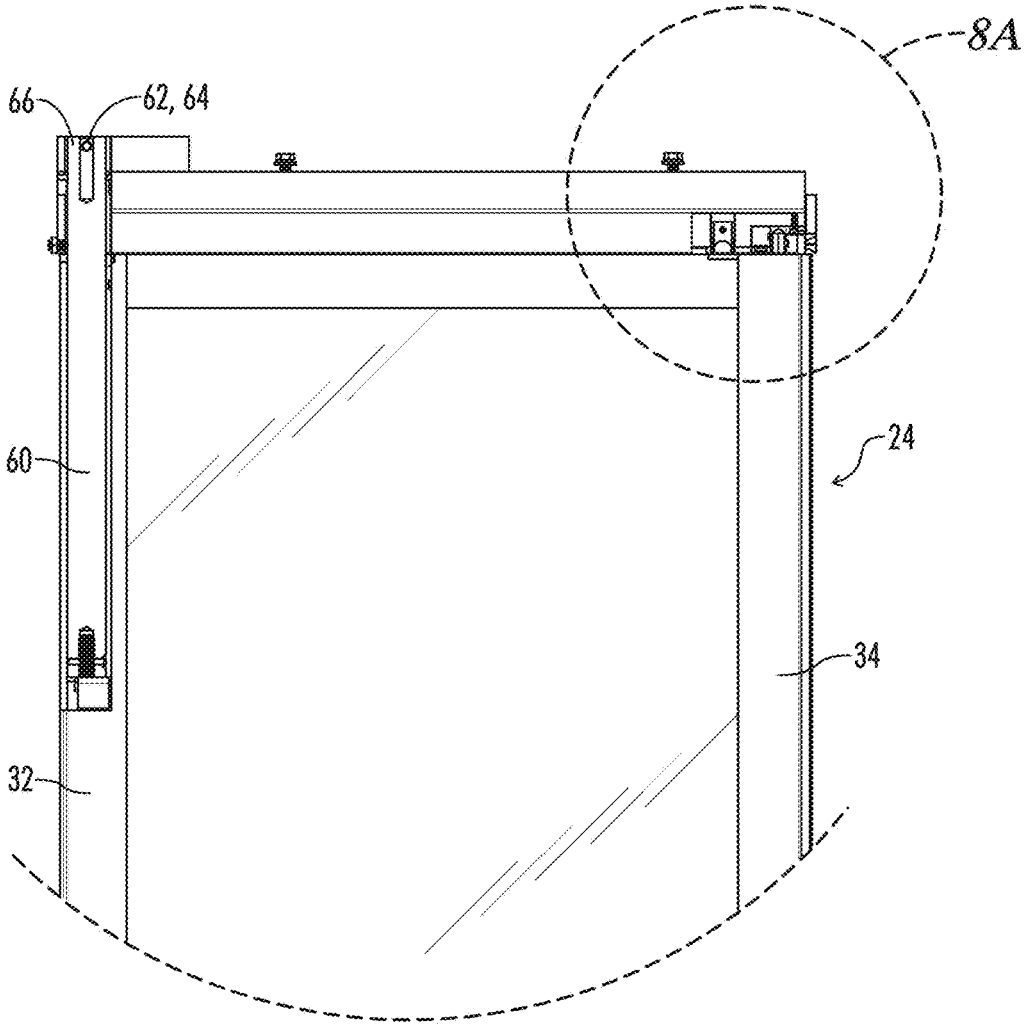
FIG. 8 illustrates a rear, elevation close-up view of the circled area labeled 8 in FIG. 7.
Figure 8A:
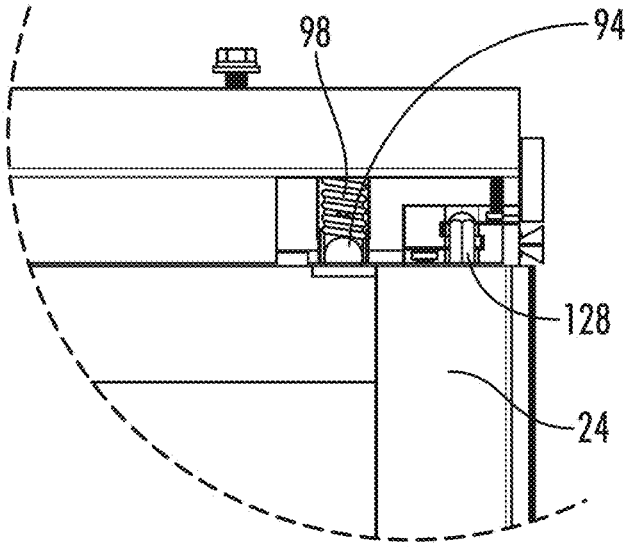
FIG. 8A illustrates a rear, elevation close-up view of the circled area labelled 8A in FIG. 8.
Figure 8B:
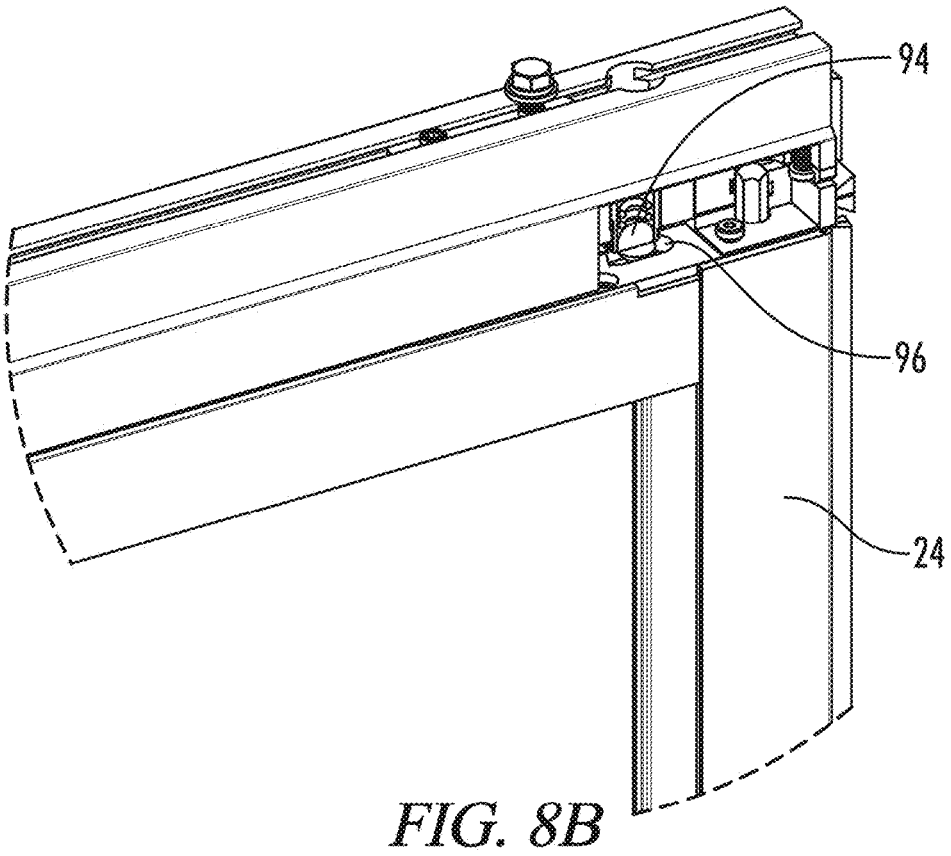
FIG. 8B illustrates a rear, perspective close-up view of the circled area labelled 8A in FIG. 8.
Figure 13:
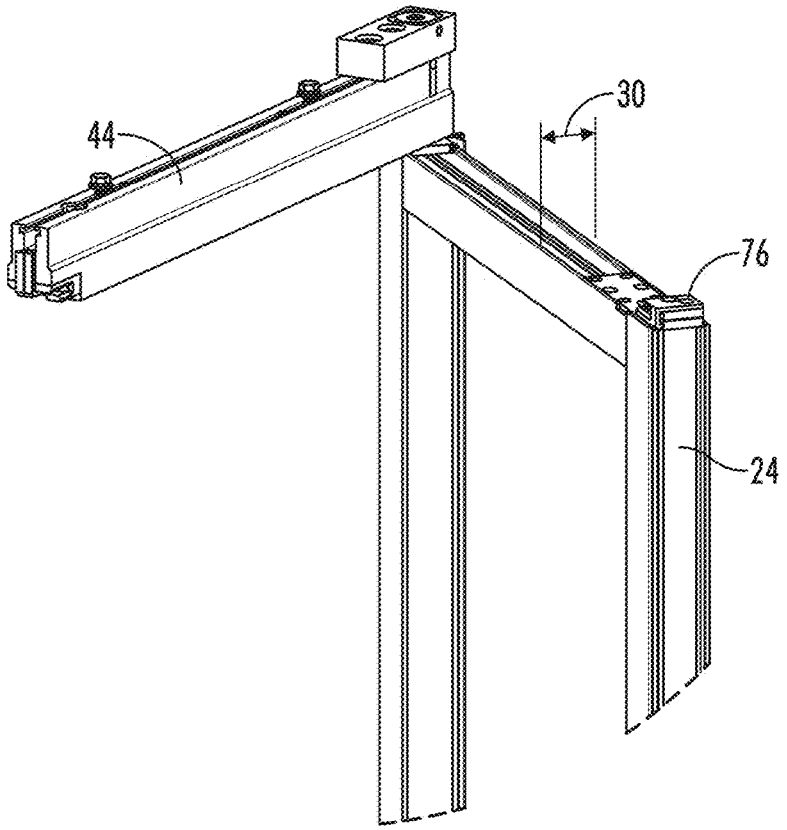
FIG. 13 illustrates a front, perspective view of the left door and the top left panel of the double breakout sliding door system of FIG. 1.
Figure 14:
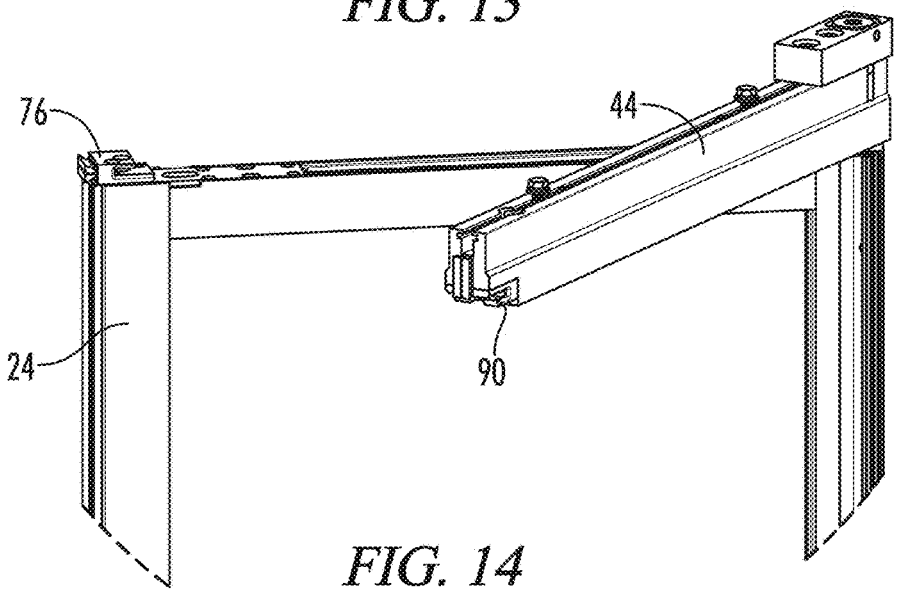
FIG. 14 illustrates a front, perspective view of the left door and the top left panel of the double breakout sliding door system of FIG. 1.
Figure 15:
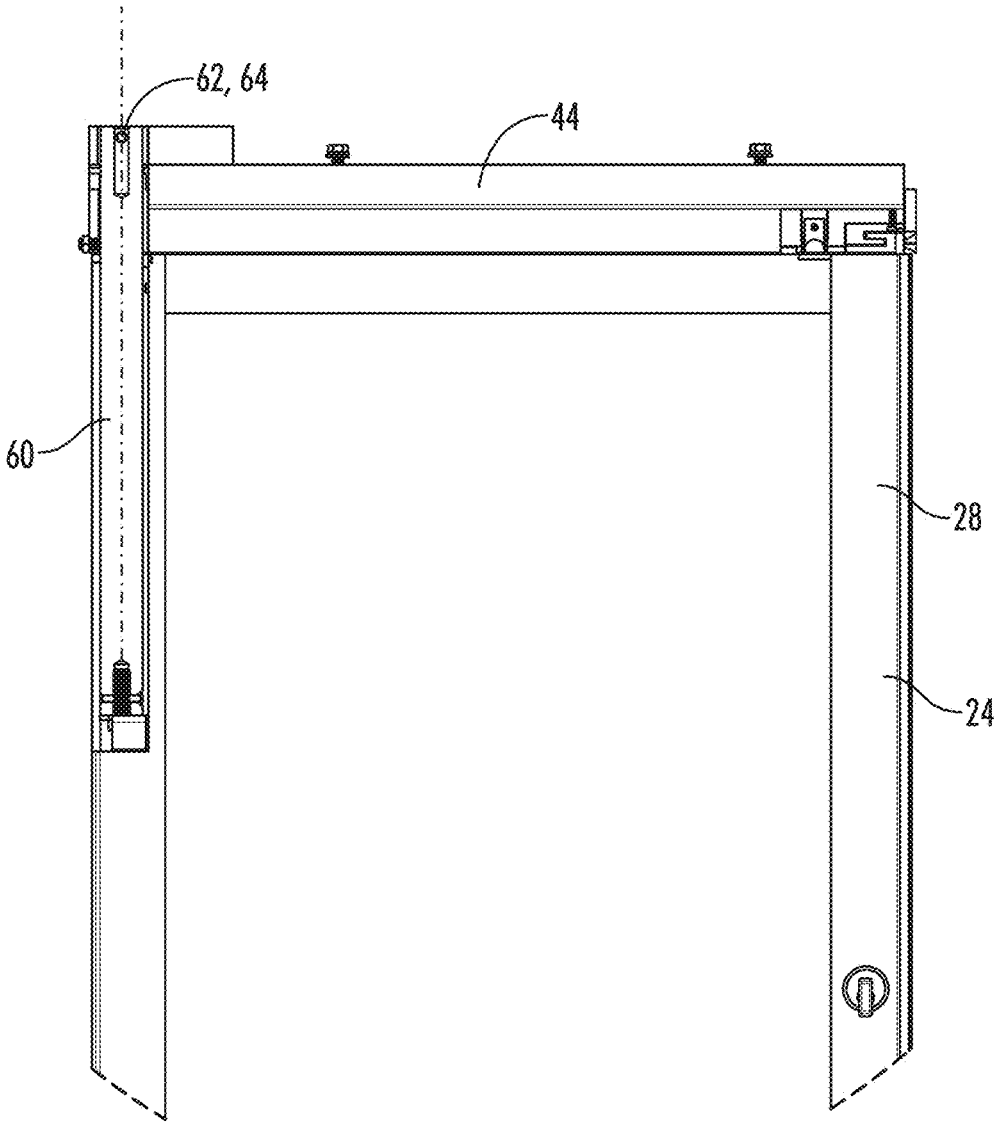
FIG. 15 illustrates a rear, elevation view of the left door and the top left panel of the double breakout sliding door system of FIG. 1 and the left door is level relative to the top left panel and the ground and in the sliding plane.
Figure 24:
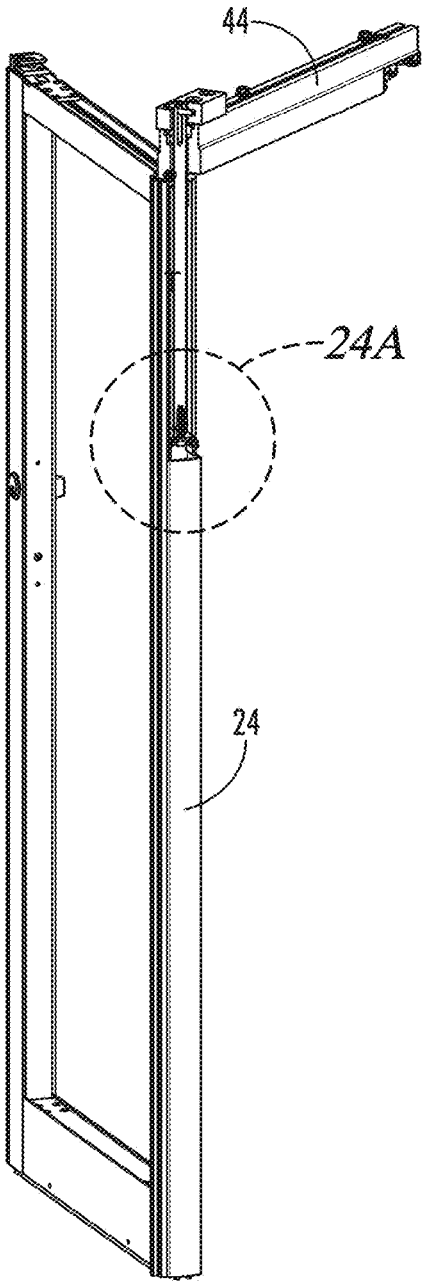
FIG. 24 illustrates a side, perspective view of the left door and the top left panel of the double breakout sliding door system of FIG. 1 and the left door is level relative to the top left panel and the ground and in the left door front open position.
Figure 24A:
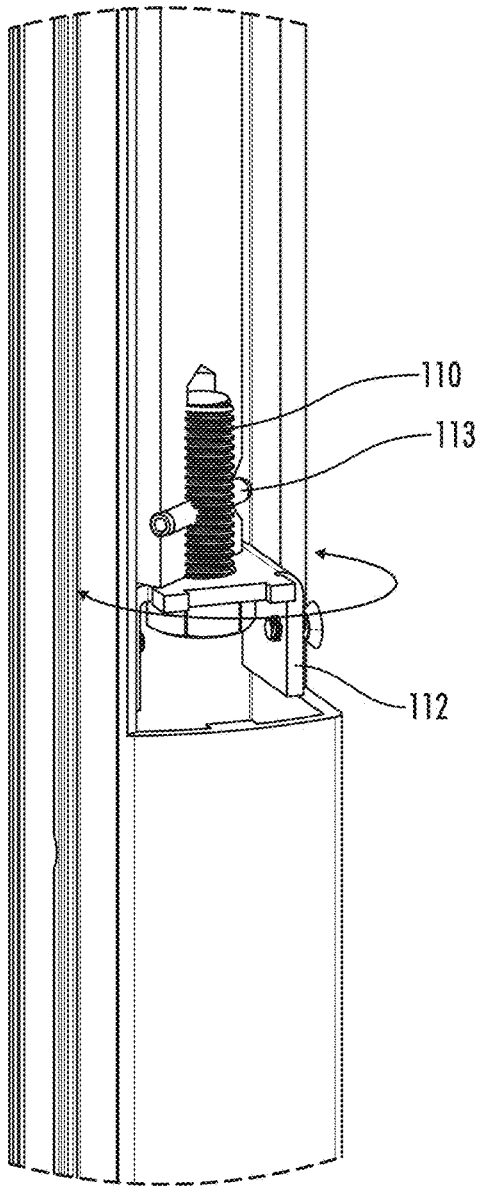
FIG. 24A illustrates a side, perspective, close-up view of the circled area labelled 24A in FIG. 24.
Figure 25:
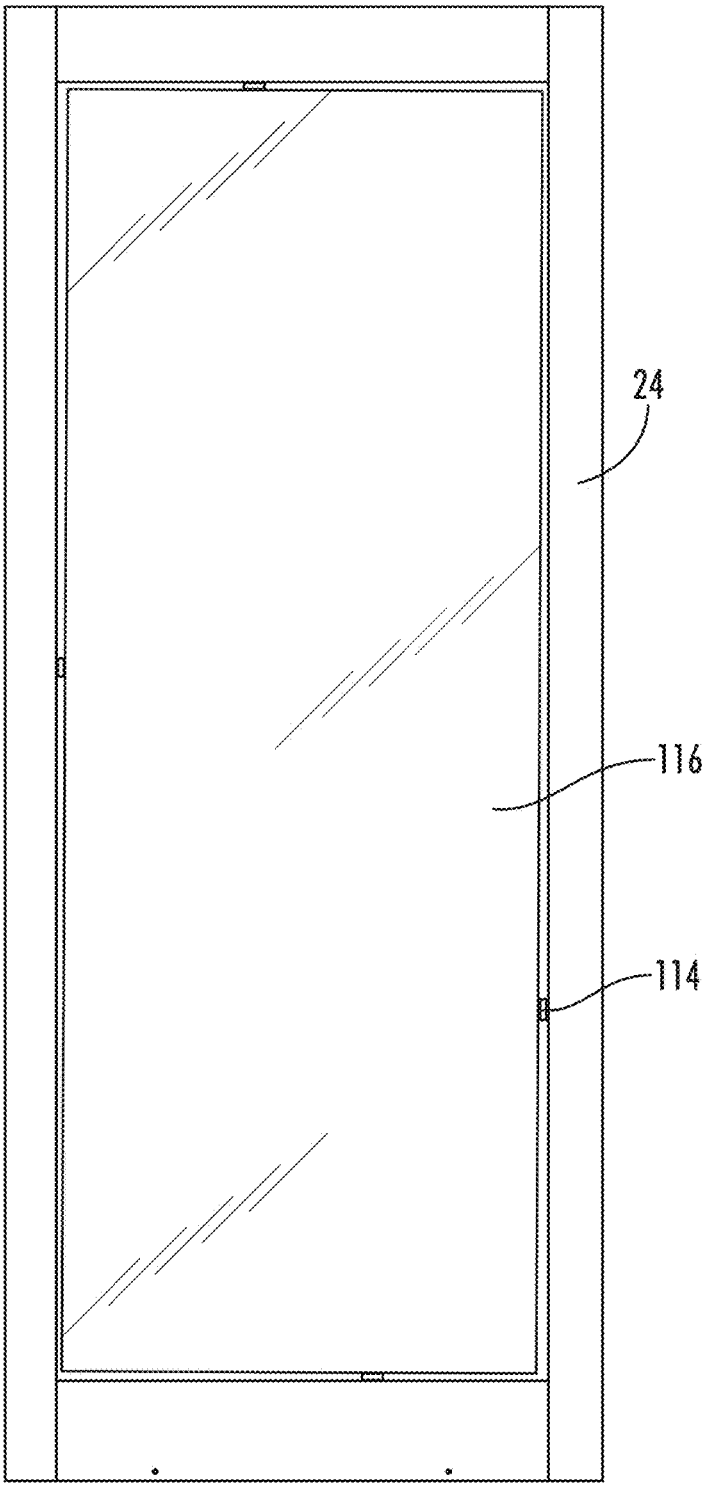
FIG. 25 illustrates a schematic view of a left door of another embodiment of the present invention that includes a plurality of glazing blocks and a glazing panel.
Figure 26:
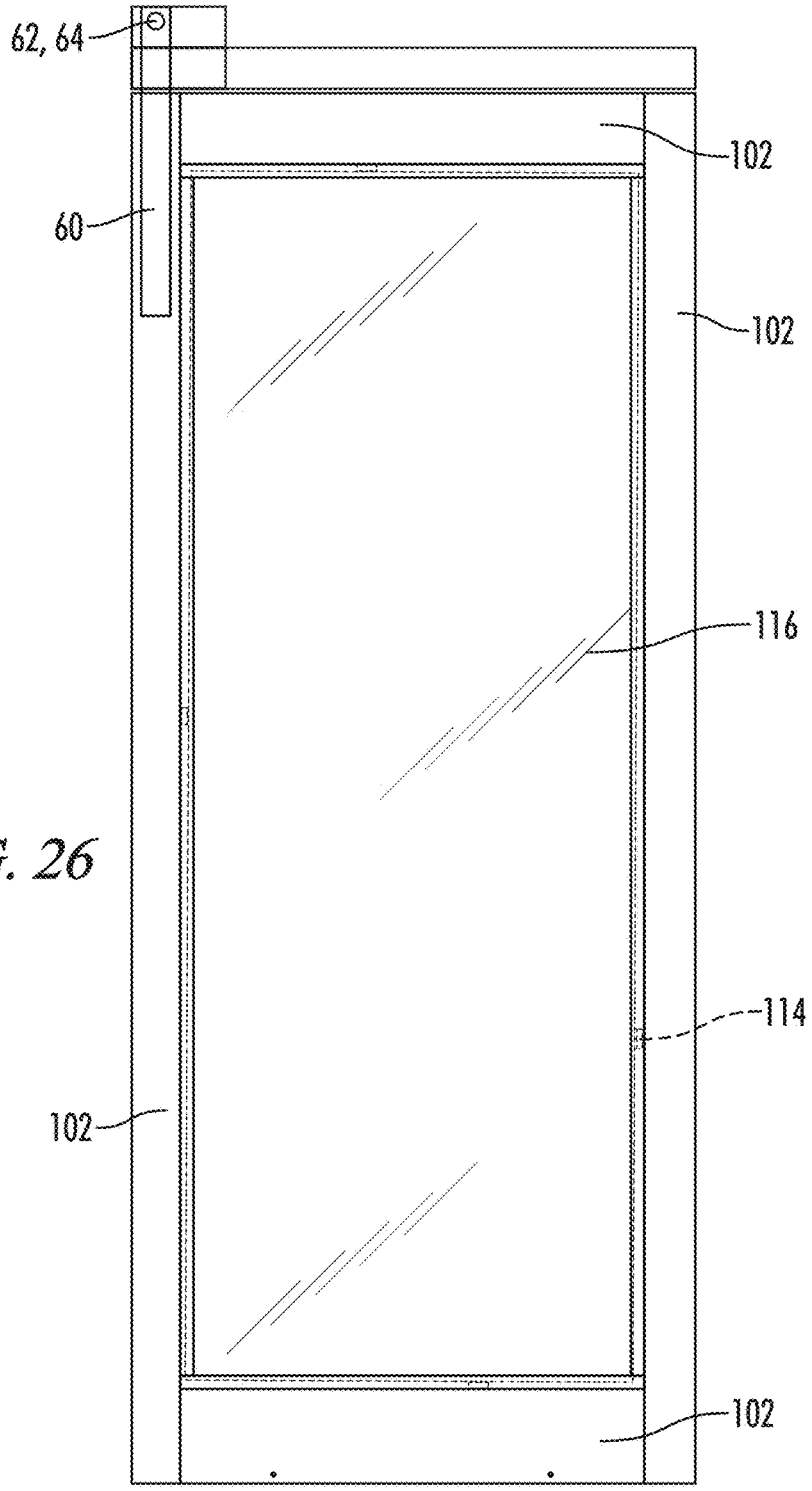
FIG. 26 illustrates a schematic view of the left door of FIG. 25 with the front of a portion of the top left panel and the left door frame removed to show the left rod.

Optionally, the left door 24 is configured to pivot (e.g., rotate) about the left rod 60 from the sliding plane to a left door front open position (as illustrated in FIGS. 5, 13 and 24) and to a left door rear open position (as illustrated in FIGS. 4 and 14) when a force is exerted on the left door perpendicular to the left door front side 26 and left door rear side 28 (i.e. pushing on the front side 26 or rear side 28), when the left door 24 is in the sliding plane. Optionally, the left door right side 34 is in front of the rectangular door system frame 12 and in front of the left door left side 32 in the left door front open position (as illustrated in FIGS. 5, 13 and 24) and the left door right side 34 is to the rear of the rectangular door system frame 12 and to the rear of the left door left side 32 in the left door rear open position (as illustrated in FIGS. 4 and 14). Optionally, when the left door 24 is in the left door front open position, the left door width 36 is approximately 60-90 degrees, preferably approximately 90 degrees (i.e., perpendicular) relative to the system frame width 22 and when the left door 24 is in the left door rear open position, the left door width 36 is approximately 60-90 degrees, preferably approximately 90 degrees (i.e., perpendicular) relative to the system frame width 22.

Optionally, the right door 130 is configured to pivot similarly.

Optionally, the bottom 40 of the left door right side 34 is configured to remain at substantially the same height (and level relative to the ground and the top left panel 44) when the left door 24 pivots about the left rod 60 from the sliding plane to the left door front open position and to the left door rear open position and the right door 130 is similarly configured to remain level. Thus, the left door 24 breaks open in two directions while remaining level relative to the top left panel 44 and the ground. (As explained in the Background, the prior art systems are primarily designed to break open in one direction—not two—and the prior art systems typically allow the nose of the door (the bottom of the left door right side) to touch the ground when breaking open).

Figure 9A:
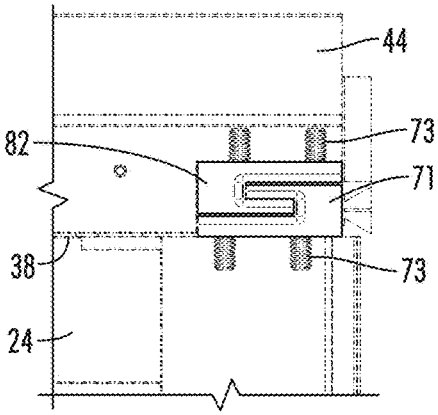
FIG. 9A illustrates a rear, elevation close-up view of the left door top and the top left panel bottom of FIG. 1; the top left panel and the left door are partially transparent in order to show the latch fasteners attaching the top left panel bottom latch to the top left panel and the left door top latch to the left door.
Figure 9B:
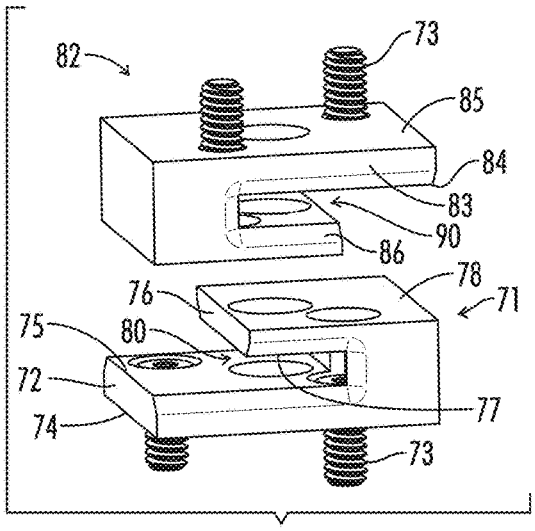
FIG. 9B illustrates a rear, exploded view of the latch fasteners, and top left panel bottom latch and left door top latch of FIG. 9A.
Figure 9C:
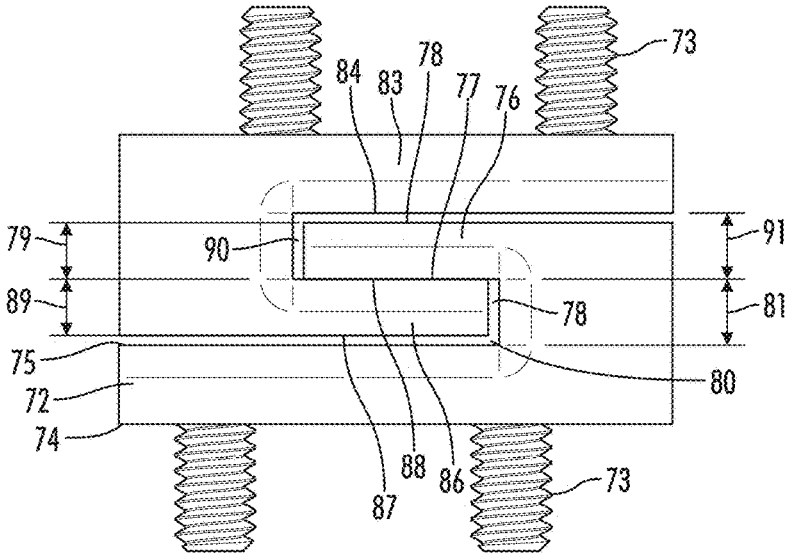
FIG. 9C illustrates a rear, elevation close-up view of the latch fasteners, and top left panel bottom latch and left door top latch of FIG. 9A.
Figure 10:
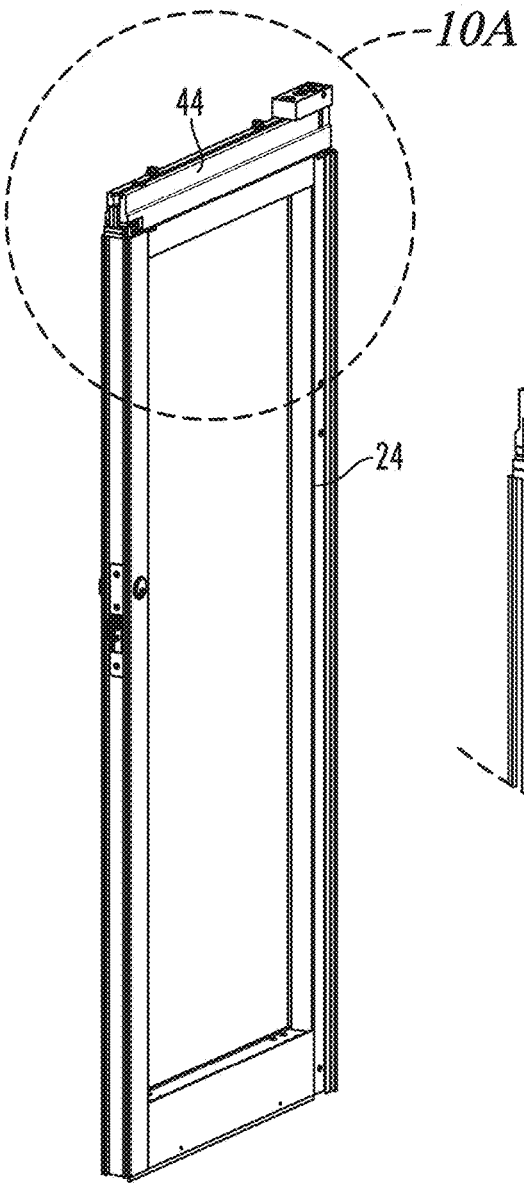
FIG. 10 illustrates a front, perspective view of the left door and the top left panel of the double breakout sliding door system of FIG. 1.
Figure 10A:
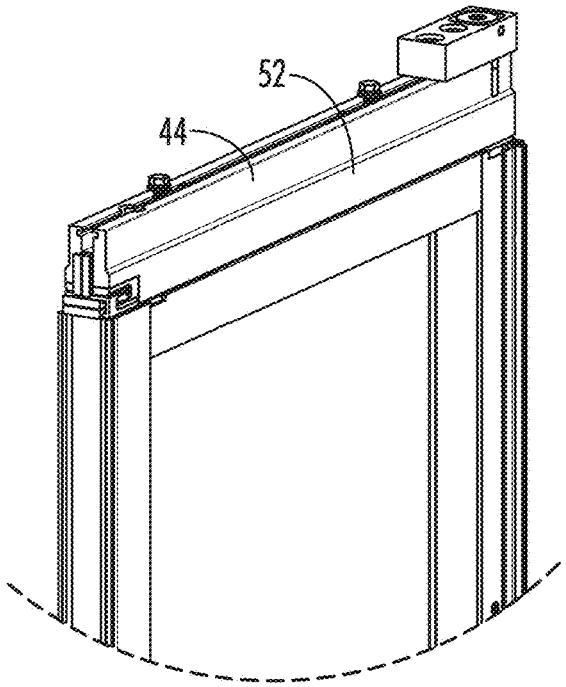
FIG. 10A illustrates a front, perspective close-up view of the circled area labelled 10A in FIG. 10.
Figure 11:
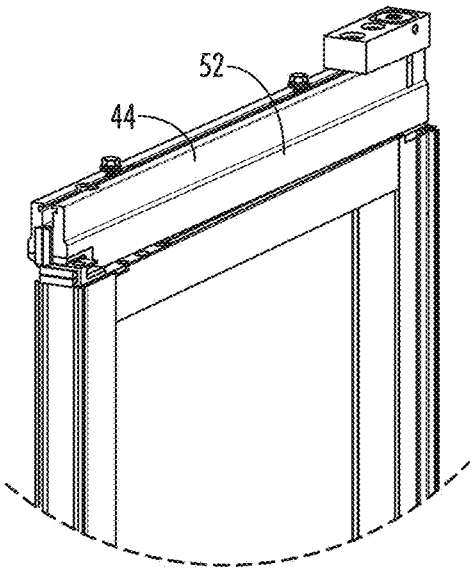
FIG. 11 illustrates a front, perspective view of the left door and top left panel of the double breakout sliding door system of FIG. 1.
Figure 12:
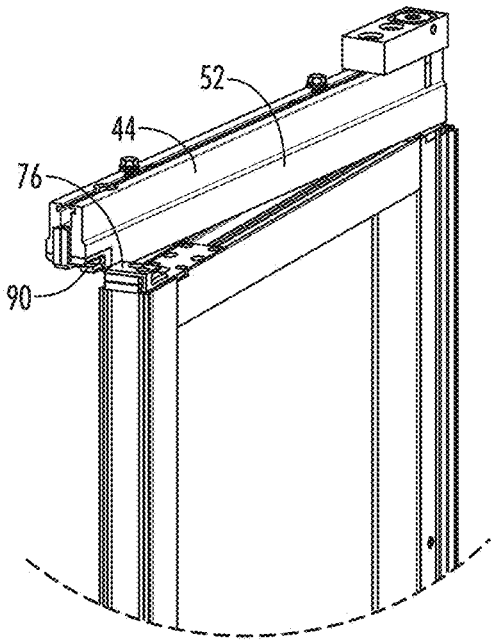
FIG. 12 illustrates a front, perspective view of the left door and top left panel of the double breakout sliding door system of FIG. 1.

Optionally, the left door 24 and top left panel 44 interlock through the use of mating latches 71 and 82 when the left door 24 is in the sliding plane. (This interlocking latch feature in addition to the left rod 60 supports the left door 24 when the left door 24 is in the sliding plane). More particularly, in some embodiments, the left door 24 further comprises a left door top latch 71 attached to the left door 24 via latch fasteners 73. The left door top latch 71 is adjacent (i.e., at or near) the left door right side 20 and the left door top latch 71 has a left door latch base 72 that has a left door latch base bottom 74 attached to the left door top 38 and a left door latch base top 75. The left door top latch 71 further includes a left door latch flange 76 that is located above the left door latch base 72 and includes a left door latch flange bottom 77, a left door latch flange top 78 and a left door latch flange height 79 extending from the left door latch flange bottom 77 to the left door latch flange top 78. The left door top latch 71 further includes a left door latch slot 80 that is located between the left door latch base 72 and the left door latch flange 76 and that has a left door latch slot height 81 extending from the left door latch base top 75 to the left door latch flange bottom 77. In such embodiments, the top left panel 44 further comprises a top left panel bottom latch 82 attached to the top left panel 44 via latch fasteners 73. The top left panel bottom latch 82 is adjacent (i.e., at or near) the top left panel right side 47 and the top left panel bottom latch 82 has a top left panel latch base 83 that has a top left panel latch base top 85 attached to the top left panel bottom 48 and a top left panel latch base bottom 84. The top left panel bottom latch 82 further includes a top left panel latch flange 86 that is located below the top left panel latch base 83 and includes a top left panel latch flange bottom 87, a top left panel latch flange top 88 and a top left panel latch flange height 89 extending from the top left panel latch flange bottom 87 to the top left panel latch flange top 88. The top left panel bottom latch 82 further includes a top left panel latch slot 90 that is located between the top left panel latch base 83 and the top left panel latch flange 86 and that has a top left panel latch slot height 91 extending from the top left panel latch base bottom 84 to the top left panel latch flange top 88. The top left panel bottom latch 82 may be located in a cut-out of the top left panel 44, as best seen in FIGS. 9A, 10, 10A, and 11-16. The top left panel latch slot height 91 is slightly greater than the left door latch flange height 79, which allows the left door latch flange 76 to nest inside the top left panel latch slot 90 when the left door 24 is in the sliding plane, as best seen in FIG. 9C. Similarly, the left door latch slot height 81 is slightly greater than the top left panel latch flange height 89, which allows the top left panel latch flange 86 to nest inside the left door latch slot 80 when the left door 24 is in the sliding plane, as best seen in FIG. 9C, which in turn allows the top left panel 44 to support the left door 24 when the left door 24 is in the sliding plane, as best seen in FIGS. 10, 10A, 15, and 29. Optionally the left door latch slot 80 and top left panel latch slot 90 are generally U-shaped, best seen in FIGS. 9A, 9B, and 9C. The top left panel latch slot 90 extends from the top left panel front side 52 to the top left panel rear side 54, which allows the left door latch flange 76 to pass through when the left door 24 moves from the sliding plane (in which the left door 24 is supported by the top left panel bottom latch 82) to the left door front open position and the left door rear open position. Similarly, the left door latch slot 80 extends from the left door front side 26 to the left door rear side 28, which allows the top left panel latch flange 86 to pass through when the left door 24 moves from the sliding plane to the left door rear open position and the left door front open position. The user is able to align the top left panel bottom latch 82 with the left door top latch 71 using the left adjustment fastener 100, which, as explained below, causes the left rod 60 to pivot about the left pivot pin 62 and left pivot pin axis 64. (Again, the right door 130 and top right panel 134 may include similar interlocking features).

The double breakout sliding door system 10 optionally further includes a ball detent mechanism to alert the user that the latches 71 and 82 are properly aligned—i.e., the left door latch flange 76 is nested in the top left panel latch slot 90 and the top left panel latch flange 86 is nested in the left door latch slot 80. For example, the left door 24 and the top left panel 44 may include a ball detent comprising a ball 94, a recess 96 configured to receive the ball 94, and a spring 98 connected to the ball 94 and configured to urge the ball 94 toward the recess 96, and the ball 94 is configured to move into the recess 96 when the top left panel latch flange 86 is nested in the left door latch slot 80 and the left door latch flange 76 is nested in the top left panel latch slot 90.

Figure 27:
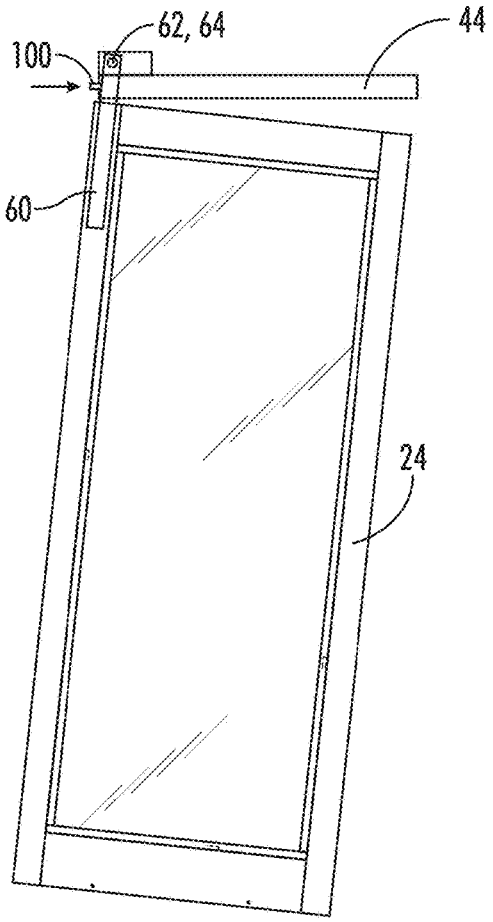
FIG. 27 illustrates a schematic view of the left door of FIG. 25 and illustrates how the left rod is configured to raise and lower the left door.
Figure 28:
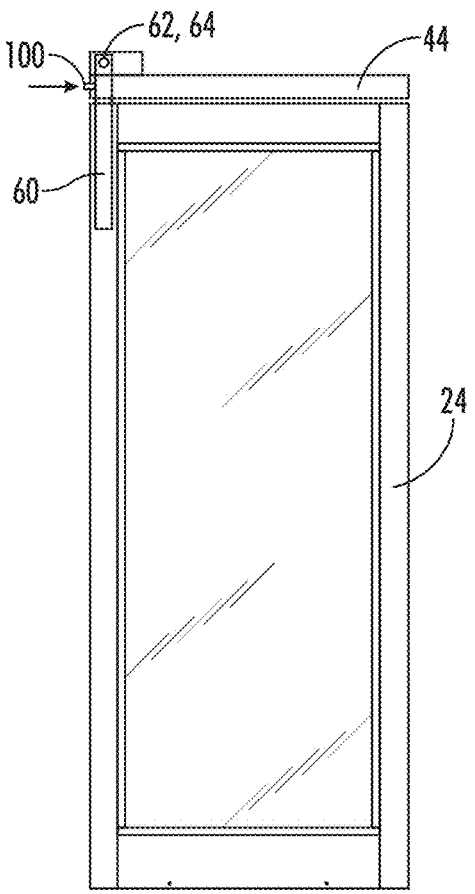
FIG. 28 illustrates a schematic view of the left door of FIG. 25 in which the left adjustment fastener has been used to level the left door relative to the top left panel and the ground.
Figure 29:
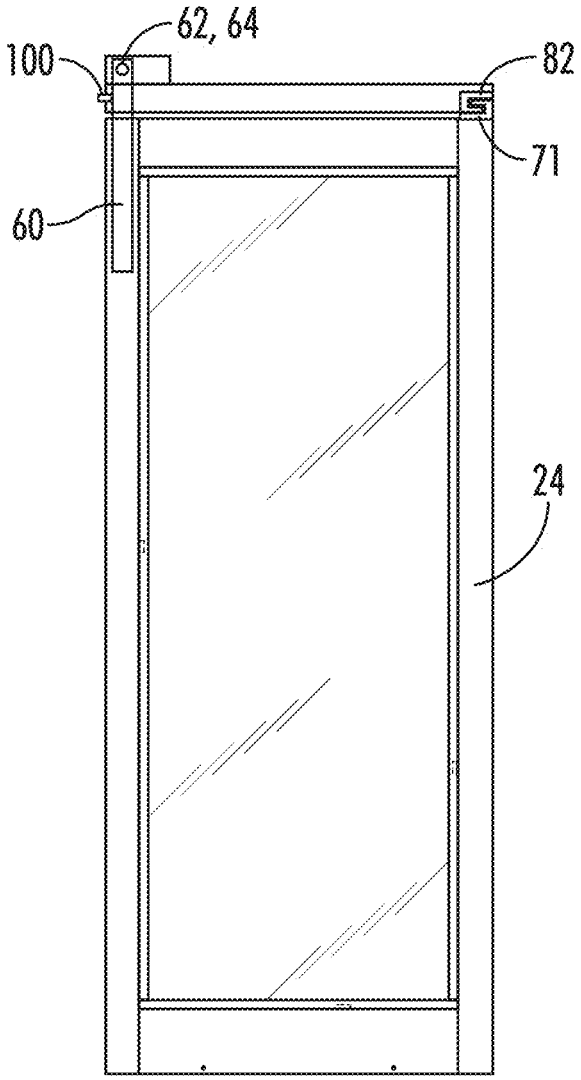
FIG. 29 illustrates a schematic view of the left door of FIG. 25 in which the left door is held up via the left rod as well as the left door latch flange positioned in the top left panel latch slot.

Optionally, the left rod bottom 60 is configured to be the sole point of attachment of the left door 24 to the top left panel 44 when the left door 24 is in the left door front open position and the left door rear open position, as best seen in FIG. 27.

Optionally, the left pivot pin axis 64 is perpendicular to the system frame front side 7 and system frame rear side 8.

Figure 16:
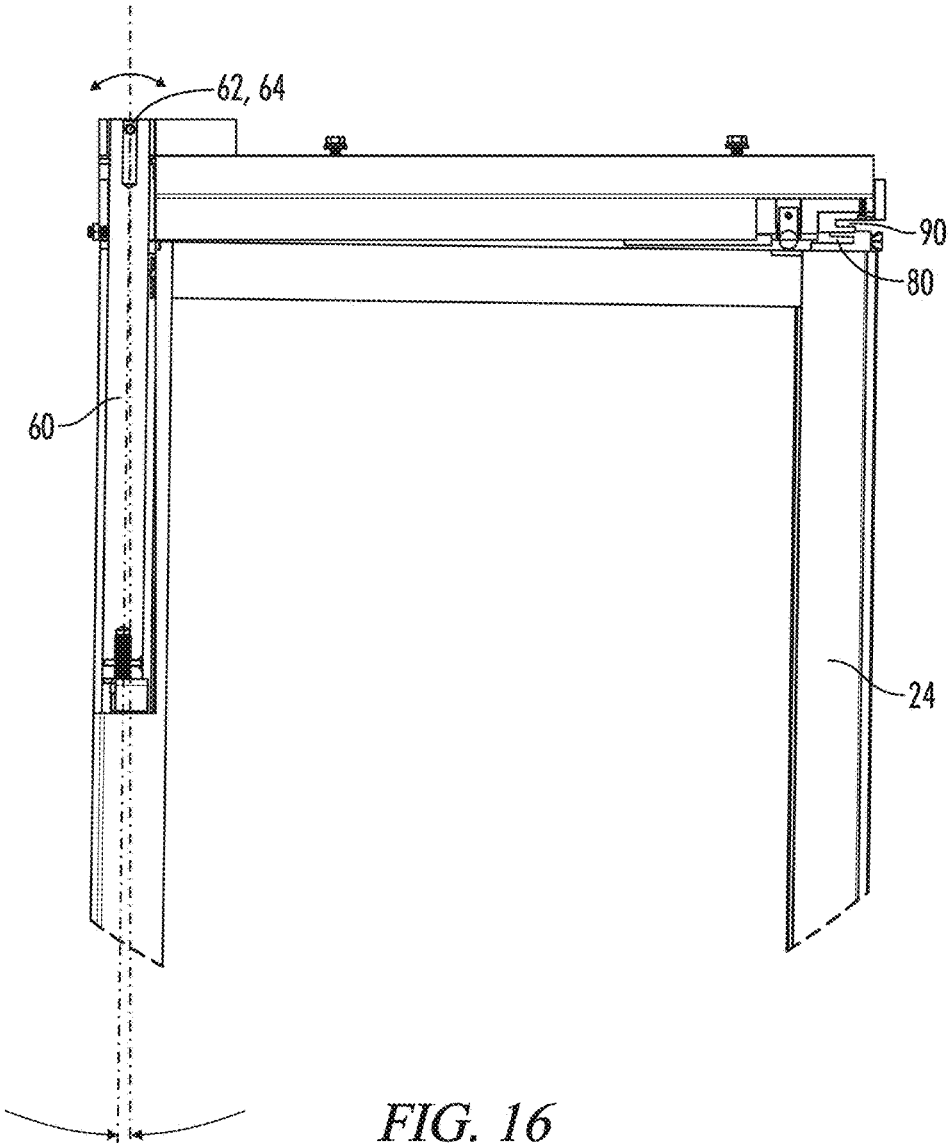
FIG. 16 illustrates a rear, elevation view of the left door and the top left panel of the double breakout sliding door system of FIG. 1.
Figure 17:
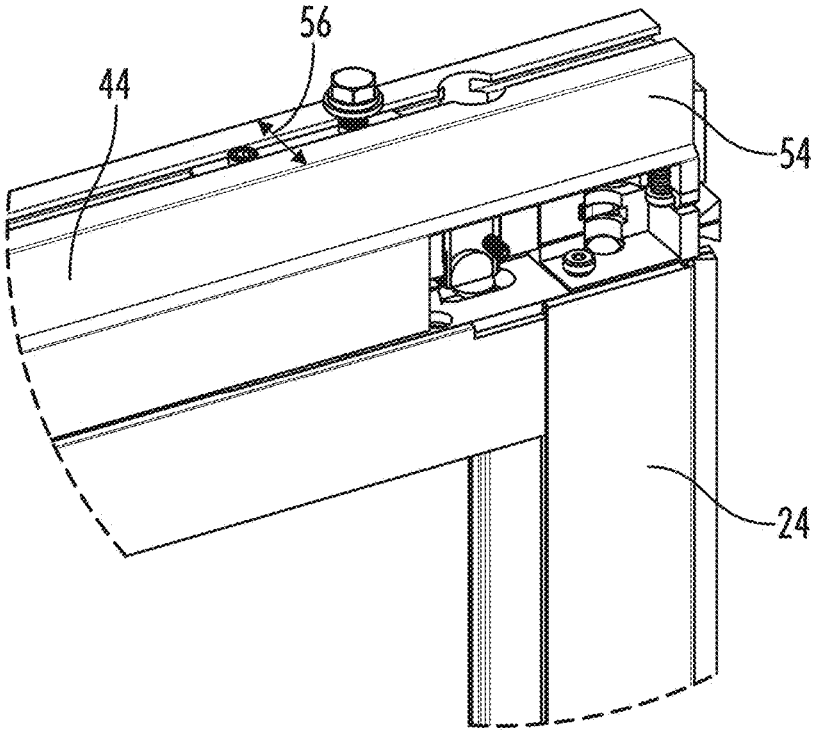
FIG. 17 illustrates a rear, perspective view of the left door and the top left panel of the double breakout sliding door system of FIG. 1.
Figure 18:
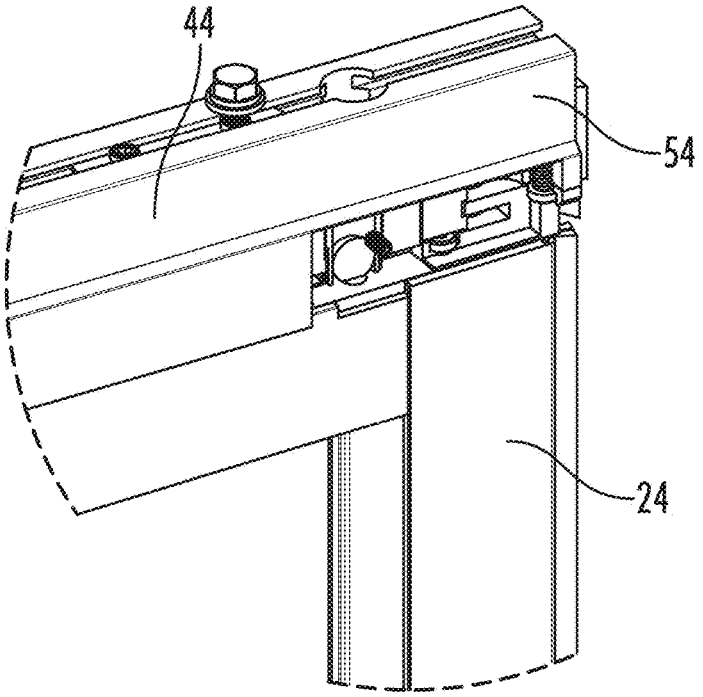
FIG. 18 illustrates a rear, perspective view of the left door and the top left panel of the double breakout sliding door system of FIG. 1.
Figure 19:
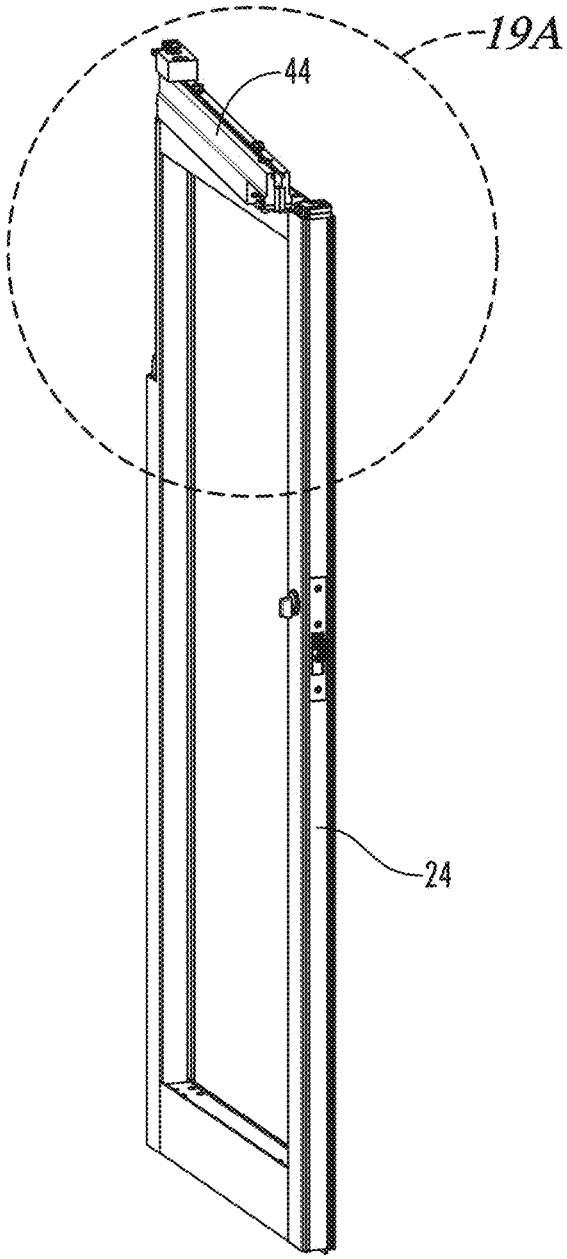
FIG. 19 illustrates a side, perspective view of the left door and the top left panel of the double breakout sliding door system of FIG. 1.
Figure 19A:
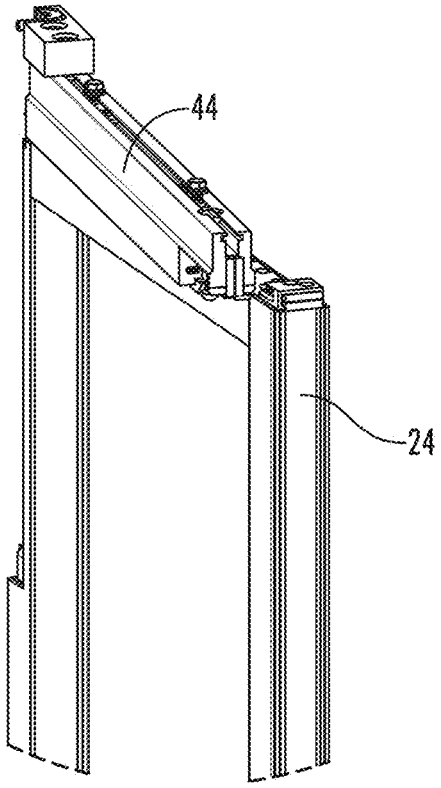
FIG. 19A illustrates a side, perspective, close-up view of the circled area labelled 19A in FIG. 19.

Optionally, the top left panel 44 further comprises a left adjustment fastener 100 configured to engage the left rod 60 and cause the left rod 60 to pivot along the left pivot pin axis 64, as best seen in FIGS. 16 and 27. The left adjustment fastener 100 may be, for example, a jack screw (e.g., a set screw). The left adjustment fastener 100 is preferably located on the left side of top left panel 44. Again, the top right panel 134 may include a similar adjustment fastener. Pivoting of the left rod 60 along the left pivot pin axis 64 is configured to cause the bottom 40 of the left door right side 34 to move vertically (i.e., up or down) relative to the top left panel 44 and the ground, which allows the user to adjust the distance from the bottom 40 of the left door right side 34 to the ground so that the bottom 40 of the left door right side 34 does not drop (relative to the ground and rectangular door system frame 12) when the left door 24 moves from the sliding plane to the left door front open position and the left door rear open position. It will be appreciated that when the bottom 40 of the left door right side 34 moves vertically, it may also move horizontally, which is apparent from FIG. 16.

Optionally, the left door 24 comprises a frame 102 and a transparent or semi-transparent material (e.g., glass or plastic)—i.e., a window. The left door frame 102 may include a left door frame interior 104 and the left rod 60 may be located within the left door frame interior 104. Again, the right door 130 may have similar features. Optionally, the bottom 68 of the left rod 60 is hollow and surrounds a threaded shank 110 of a left threaded bolt 106 that includes a head 108 and the threaded shank 110, wherein the left rod 60 is fixed to the threaded shank 110 of the left threaded bolt 106, wherein the left door 24 further comprises a left door bracket 112 located between the head 108 of the left threaded bolt 106 and the left rod bottom 68, wherein the left door bracket 112 is attached to the left door frame 102, wherein the left door bracket 112 is configured to rotate about the left rod 60 and the left threaded bolt 106 while the left rod 60 and the left threaded bolt 106 remain stationary as the left door 24 moves from the sliding plane to the left door front open position and the left door rear open position. Again, the right door 130 can include similar features. Bolts can be any suitable material, including for example, metal or nylon. The double breakout sliding door system 10 optionally further includes a left fastener 113 fixing the left rod 60 to the threaded shank 110 of the left threaded bolt 106. A right fastener may also be included for the right door 130. Optionally, the left door frame 102 forms a perimeter around a plurality of left door glazing blocks 114 (e.g., glass blocks) and the plurality of left door glazing blocks 114 are located between the left door frame 102 and a left door glazing panel 116, as shown in FIGS. 25-29. The purpose of the glazing blocks 114 is that the left door frame 102 may be comprised of aluminum and the glazing blocks 114 give structural integrity to the left door 24 so that the left door 24 moves when turning the left adjustment fastener 100. Again, the right door 130 may include similar features. In other embodiments, the left door 24 may not include left door glazing blocks 114 or left door glazing panel 116, and instead may be solely comprised of non-transparent/non-semi-transparent material—e.g., metal.

The double breakout sliding door system 10 optionally further includes a door lock 126 comprising a bar or hook extending from the left door 24 to the right door 130 and configured to fix the left door 24 relative to the right door 130. Optionally, the system 10 further includes at least one top lock 128 comprising a bar extending from the top of a door 24 or 130 to the bottom of a top panel 44 or 134 and configured to fix the door 24 or 130 relative to the top panel 44 or 134.

The double breakout sliding door system 10 optionally includes a left track 120 located above the top left panel 44 and a left wheel 122 connected to the top left panel 44 and located in the left track 120 and the left wheel 122 is configured to move along the left track 120 when the top left panel 44 and the left door 24 slide from the sliding closed position to the sliding open position. The right door 130 may include similar features. Optionally, the motor 58 is configured to move the left wheel 122 along the left track 120. It will be appreciated that references herein to the singular embrace the plural. Thus, the double breakout sliding door system 10 may include one or more left wheels 122.

The double breakout sliding door system 10 optionally further includes one or more motion sensors 124 (preferably two motion sensors that are adjacent to the system frame front and rear sides 7 and 8) in electronic communication with the motor 58 and configured to cause the left door 24 and the top left panel 44, the right door 130 and the top right panel 134 to move from the sliding closed position to the sliding open position when the sensor 124 detects an object, such as a human or shopping cart, in front of or to the rear of the left door 24 and the right door 130.

The double breakout sliding door system 10 optionally further includes a left door panel 118 configured to remain fixed relative to the rectangular door system frame 12 when the left door 24 moves from the sliding closed position to the sliding open position, the left door panel 118 located to the left of the left door 24 when the left door 24 is in the sliding closed position. In such a case, the left door 24 is configured to slide to the rear of the left door panel 118 when the left door 24 slides from the sliding closed position to the sliding open position, the left door panel 118 is configured to move with the left door 24 when the left door 24 moves from the sliding plane to the left door front open position, and the left door panel 118 is configured to remain fixed relative to the rectangular door system frame 12 when the left door 24 moves from the sliding plane to the left door rear open position. A right door panel 134 having similar features may also be included.

Although the left door 24 and right door 130 may include a door lock 126 and top lock 128, there may be no similar locking system on the left door panel 118. Thus, the double breakout sliding door system 10 optionally further includes a left door panel interlocking device located on the rear 28 of the left door 24 which hooks into the left door panel 118 thereby preventing the left door panel 118 from being opened when the left door 24 is in the sliding closed position, regardless of whether the door lock 126 and top lock 128 are engaged. If one was to attempt to move the left door 24 from the sliding closed position to the rear open position, the left door panel interlocking device would actually bind up inside the left door panel 118 preventing the left door 24 from fully moving to the rear open position. So, there is a timing issue at stake here. In order for the left door 24 to move to the rear open position in embodiments with a left door panel interlocking device, the left door 24 must not be in the sliding closed position (i.e., the left door 24 must be in the sliding plane at either the sliding open position or between the sliding closed position and the sliding open position) to disengage the hook of the left door panel interlocking device (open at least one inch for example). Because this is an automatic door with a motion sensor 124, the motion sensor 124 will have detected any person or other object (and have caused the left wheel 122 and motor 58 to move the left door 24 in the sliding plane to either the sliding open position or between the sliding closed position and the sliding open position) before the object can get close enough to the left door 24 to touch it. Therefore, the left door 24 will always be at least slightly slid open (i.e., between the sliding open position and the sliding closed position) by the time a force is exerted on the left door 24 perpendicular to the left door front side 26 and left door rear side 28. As a result, the left door panel interlocking device does not impede the left door 24 from moving to the left door rear open position when the motor 58, motion sensor 124 and left wheel 122 are working correctly.

Optionally, moving the left door 24 from the sliding plane to the left door front open position and the left door rear open position is configured to disable the motor 58, as a safety feature. (Again, the same may be true with the right door 130 as it moves from the sliding plane to the right door front open position and the right door rear open position). To disable the motor 58, the double breakout sliding door system 10 may include a rear breakout sensor 142 that detects presence and is triggered when the left door 24 moves to the rear open position to disable the motor 58. (In some embodiments, the rear breakout sensor 142 is an infrared sensor that includes a transmitter that transmits the infrared beam and a receiver that receives the infrared beam, similar to the infrared setup used on a garage door. When the receiver no longer receives the beam, it knows that the left door 24 is in the left door rear open position and disables the motor 58). Similarly, to disable the motor 58 when the left door 24 moves to the left door front open position, there may be a front breakout senor 144 located in the left door panel 118 that detects when the left door 24 moves to the left door front open position.

The Embodiments of FIGS. 30-68

FIGS. 30-68 illustrate a system 200 having a similar design to FIGS. 1-29 except that only a single door 202 is shown, the door 202 breaks open only in the forward direction, the front open position (i.e., a single breakout sliding door), and due to the fact that the door 202 breaks open in only one direction, a different latch is used. It will be understood that while only a single door 202 is shown, as with the double breakout system 10 of FIGS. 1-29, the single breakout door system 200 of FIGS. 30-68 may include two doors 202 (a left door and right door) as well as two corresponding top panels 206 (a left top panel and a right top panel). The door system 200 of FIGS. 30-68 may include one or more features of the embodiment of FIGS. 1-29, including those described with particularity below and shown in FIGS. 30-68. It will be understood that other features such as the system frame, the motor and the panels of FIGS. 1-29 (which may be included in the single breakout design of FIGS. 30-68) are not shown in FIGS. 30-68 for simplicity.

More particularly, the system 200 includes a rod 208, which may have a rod top 210 pivotally attached to the top panel 206 by a pivot pin 212 forming a pivot pin axis 214 and a rod bottom 216 attached to the door 202 (e.g., the door left or right side) and a rod longitudinal axis 218 extending from the rod top 210 to the rod bottom 216. The rod 208 may extend in a generally downward direction from the top panel 206 at least partially through the door 202. The pivot pin 212 may be transverse to the rod longitudinal axis 218 and attached to the top panel 206. (If two doors 202 are used, each door 202 may be attached to a rod 208, and each rod top 210 may be attached to a top panel 206).

Optionally, when the door 202 moves from the sliding plane to the door front open position when a force is exerted on the door rear side 222 perpendicular to the door rear side 222 when the door 202 is in the sliding plane, i) the door 202 is configured to rotate around the rod 208 about a rotational plane generally perpendicular to the rod longitudinal axis 218, ii) the door 202 is configured to rotate relative to the top panel 206 and iii) the rod 208 is configured to remain stationary relative to the top panel 206.

Figure 30:
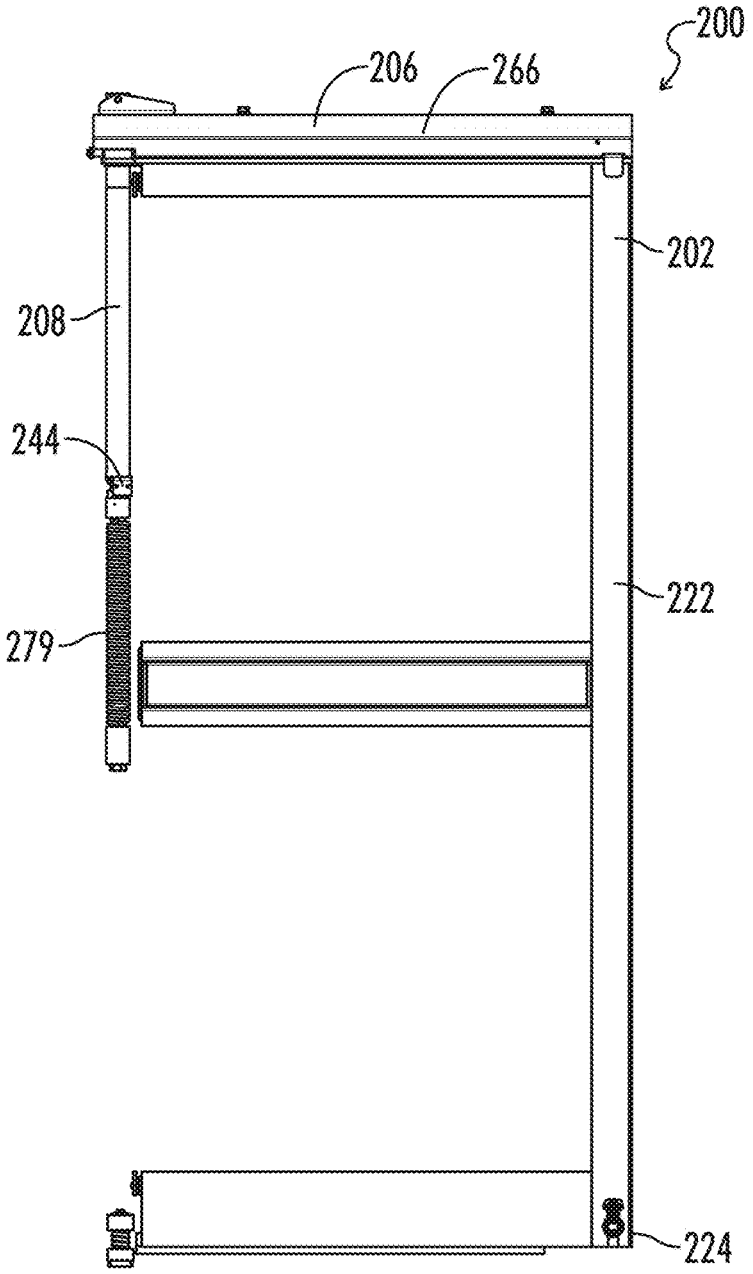
FIG. 30 illustrates a rear, elevation view of a single breakout sliding door system of one embodiment of the present invention.
Figure 31:
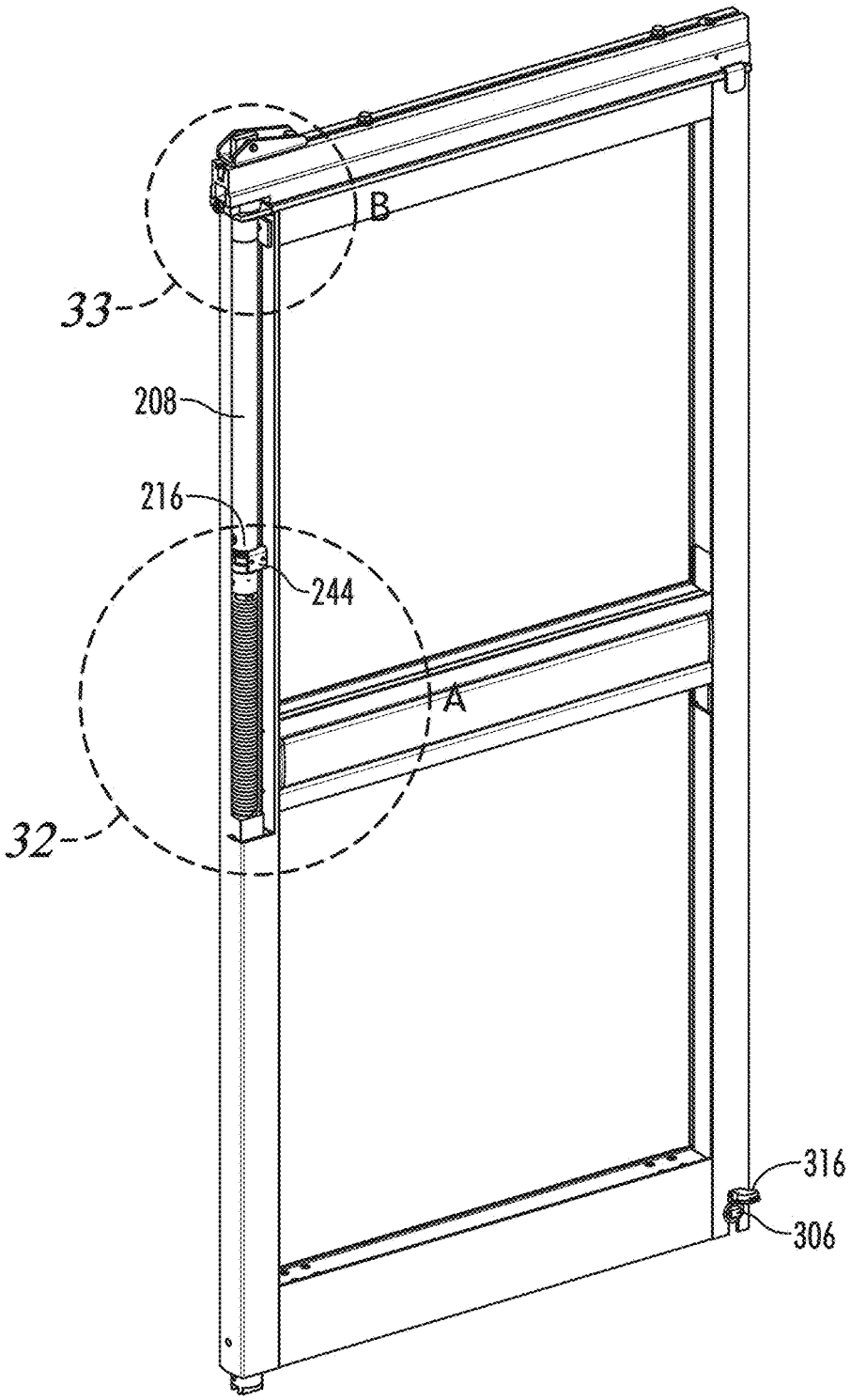
FIG. 31 illustrates a rear elevation view of the single breakout sliding door of FIG. 30.
Figure 32:
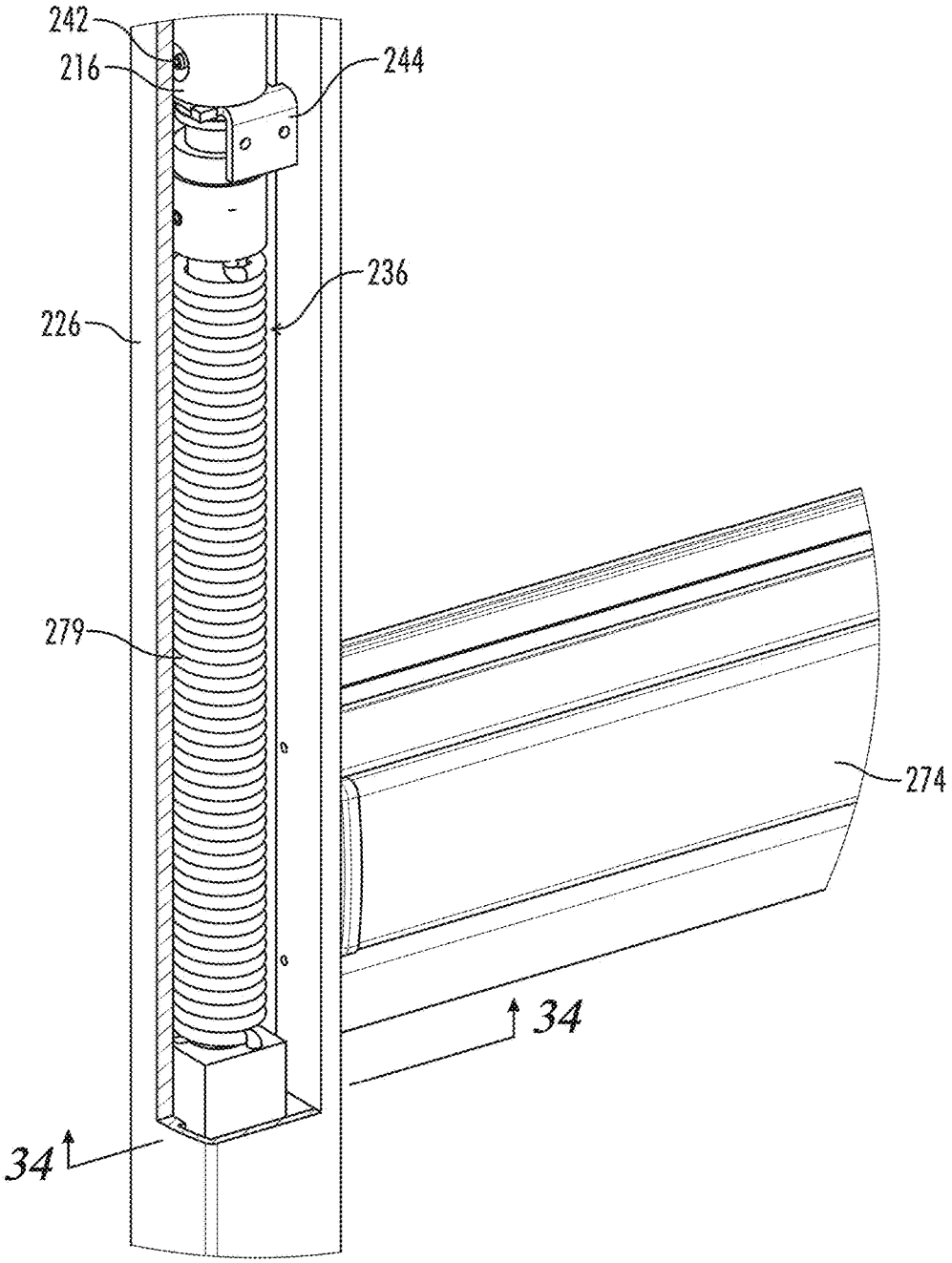
FIG. 32 illustrates a rear elevation view of the circled area labelled 32 in FIG. 31.
Figure 33:
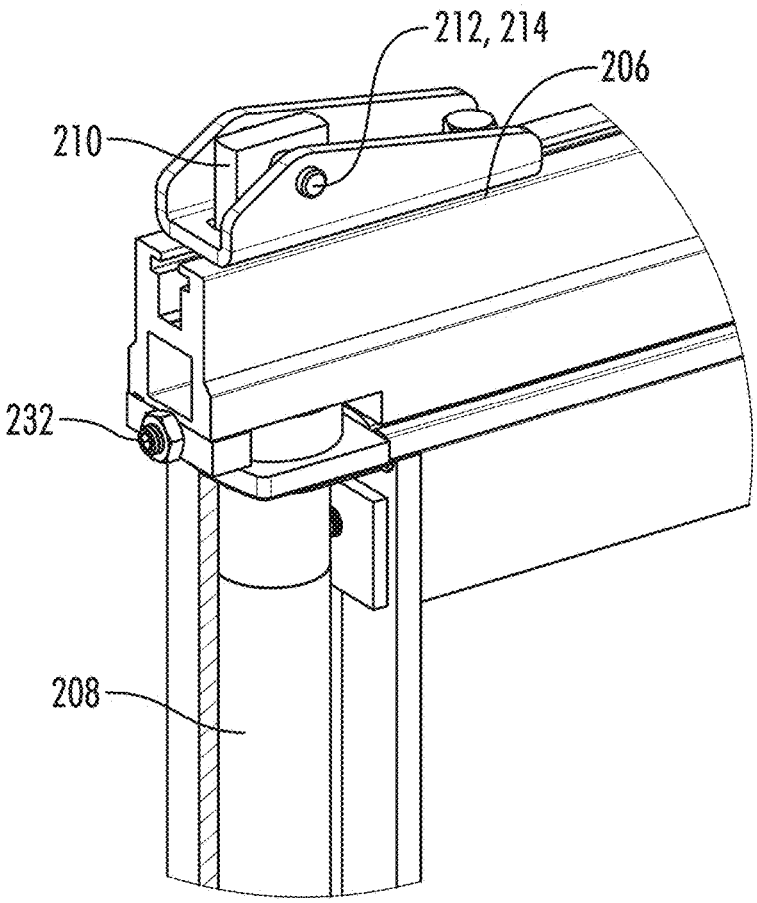
FIG. 33 illustrates a rear elevation view of the circled area labelled 33 in FIG. 31.
Figure 34:
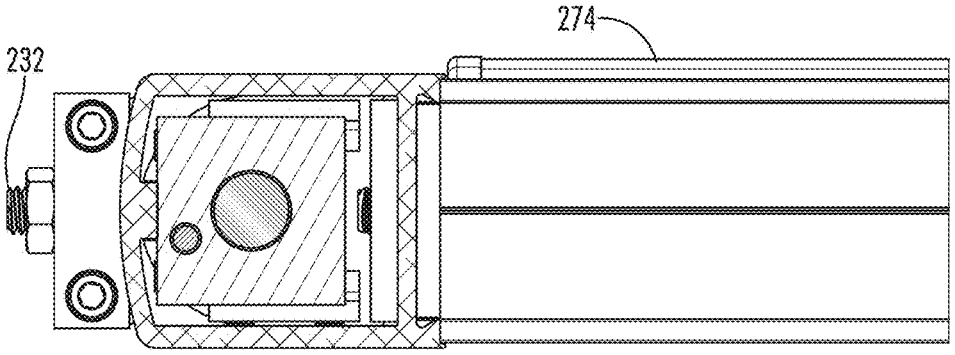
FIG. 34 illustrates a cross-sectional view of the spring, rod and door taken along line 34-34 of FIG. 32.
Figure 35:
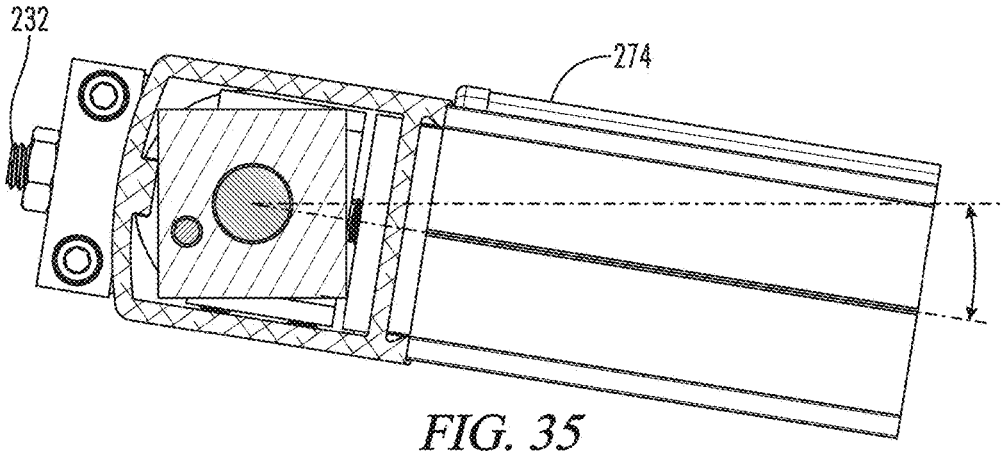
FIG. 35 illustrates a cross-sectional view of the spring, rod and door taken along line 34-34 of FIG. 32.
Figure 36:
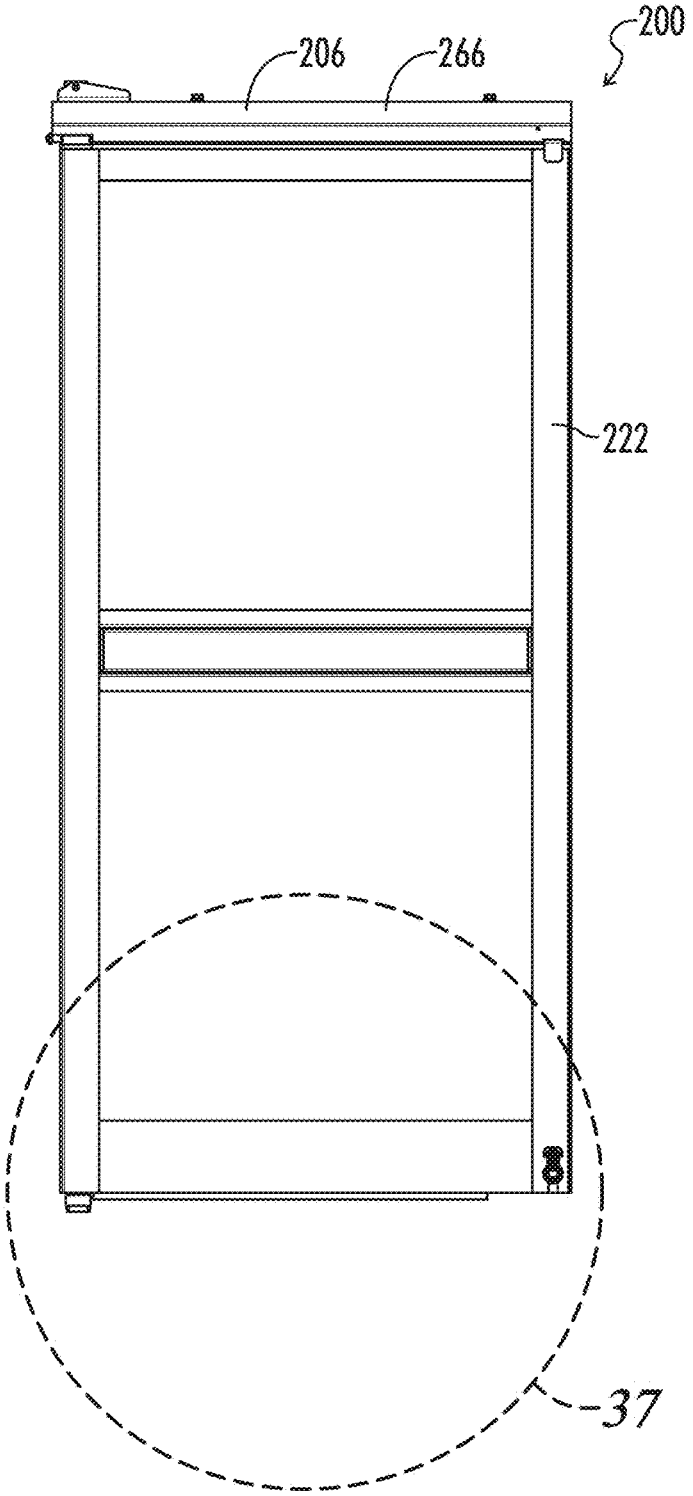
FIG. 36 illustrates a rear elevation view of the single breakout sliding door system of FIG. 30.
Figure 37:
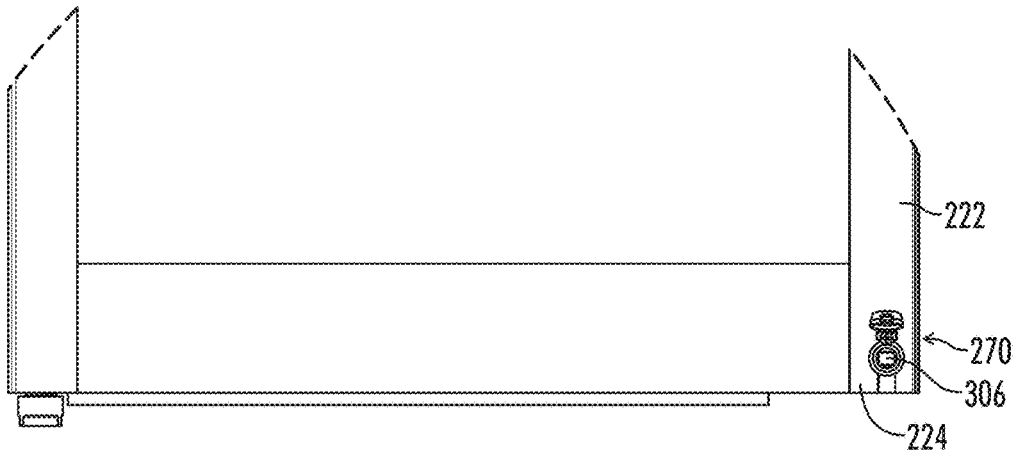
FIG. 37 illustrates a rear elevation view of the circled area labelled 37 in FIG. 36.
Figure 38:
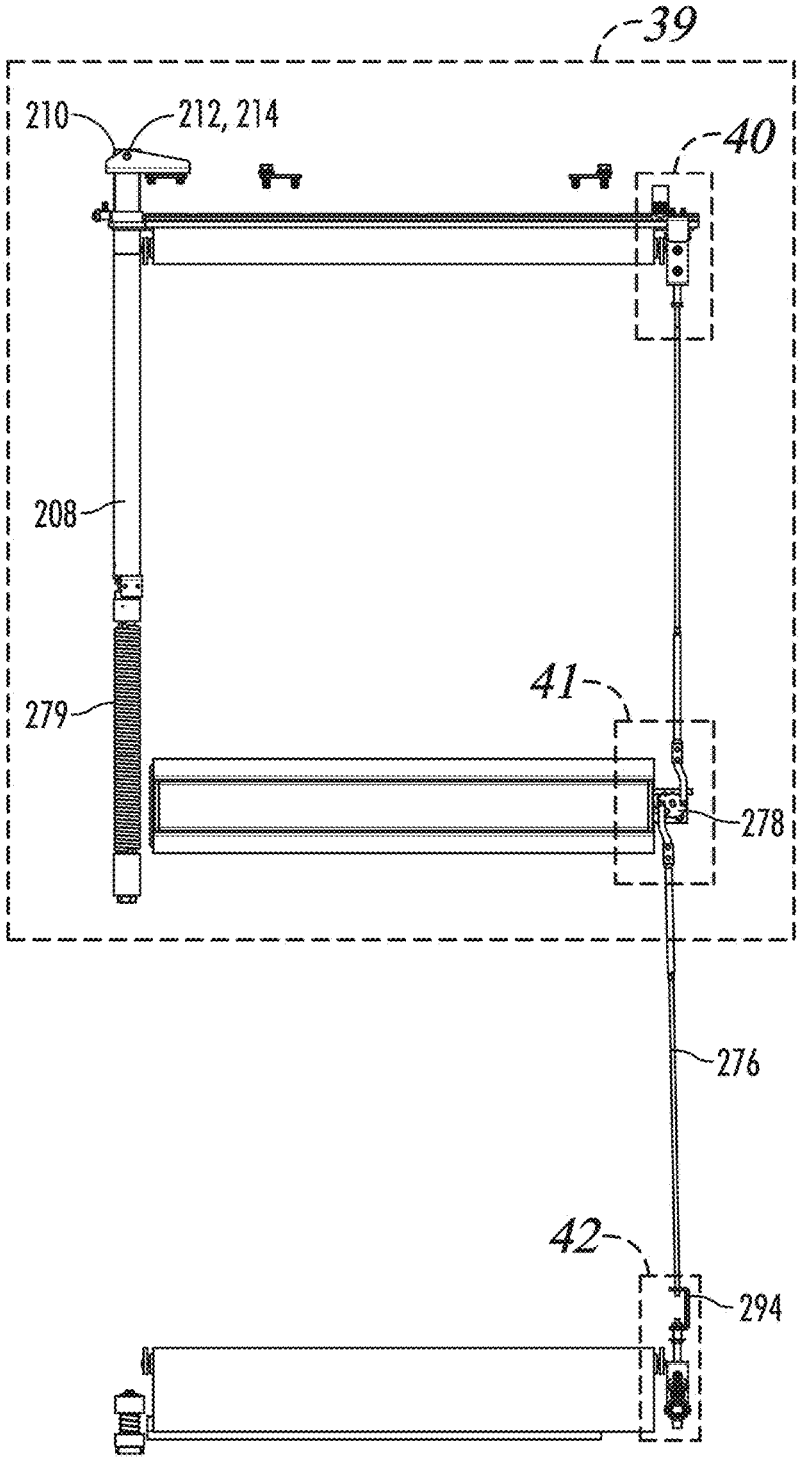
FIG. 38 illustrates a rear elevation view of the door of FIG. 30 with a portion of the left side of the frame of the door removed to show the rod and the right side of the frame of the door removed to show the lock system.

Optionally, the bottom 224 of the door side opposite the rod 208 (i.e., the right side as shown in FIG. 30 for example) is configured to remain at substantially the same height relative to the rectangular door system 200 frame when the door 202 rotates around the rod 208 from the sliding plane to the door 202 front open position. Optionally, the rod bottom 216 is configured to be the sole point of attachment of the door 202 to the top panel 206 when the door 202 is in the door 202 front open position. Optionally, the pivot pin axis 214 is perpendicular to the system frame front side and the system frame rear side.

Optionally, the top panel 206 further comprises an adjustment fastener 232 configured to engage the rod 208 and cause the rod 208 to move about the pivot pin axis 214 in a plane generally perpendicular to the rotational plane. Optionally, moving the rod 208 about the pivot pin axis 214 is configured to cause the bottom 224 of the door side opposite the rod 208 (e.g., the right side as shown in FIG. 30) to move vertically relative to the top panel 206. Optionally, the door 202 comprises a door frame 226 comprising an interior 236 and further wherein the rod 208 is located within the door frame interior 236.

Optionally, the rod bottom 216 is hollow and surrounds a threaded shank of a threaded bolt comprising a head and the threaded shank and the rod 208 is fixed to the threaded shank of the threaded bolt. The threaded bolt, threaded bolt head and the threaded bolt shank are not specifically shown in FIGS. 30-68 but these features are described and shown with specificity in FIGS. 1-29, see for example FIGS. 20, 22A, 23A and 24A. Optionally, the door 202 further comprises a door bracket 244 located between the head of the threaded bolt and the rod bottom 216, the door bracket 244 is attached to the door frame 226, and the door bracket 244 is configured to rotate about the rod 208 and the threaded bolt while the rod 208 and the threaded bolt remain stationary as the door 202 moves from the sliding plane to the door 202 front open position. Optionally, the system 200 further comprises a fastener 242 fixing the rod 208 to the threaded shank of the threaded bolt. Optionally, the door frame 226 forms a perimeter around a plurality of door glazing blocks (not shown). Optionally, the plurality of door glazing blocks (not shown) are located between the door frame 226 and a door glazing panel (not shown). The rod bottom 216 may further be connected to a spring 279. The purpose of the spring 279, which is optional and is generally only used on a single breakout system, is to return the door 202 from the front open position to the sliding plane so that the door 202 does not have to be manually reset into the sliding plane, as shown by comparing FIG. 35 with FIG. 34. Without the adjustment fastener 232 leveling of the door side bottom/nose 224 opposite to the rod 208, even a spring-loaded return may force the door 202 partially closed and the door 202 will always require some manual human intervention to fully return the door 202 to the sliding plane. Thus, the advantage of the adjustment fastener 232 is that it allows the spring 279 to fully reset the door 202 without manual human intervention.

Figure 53:
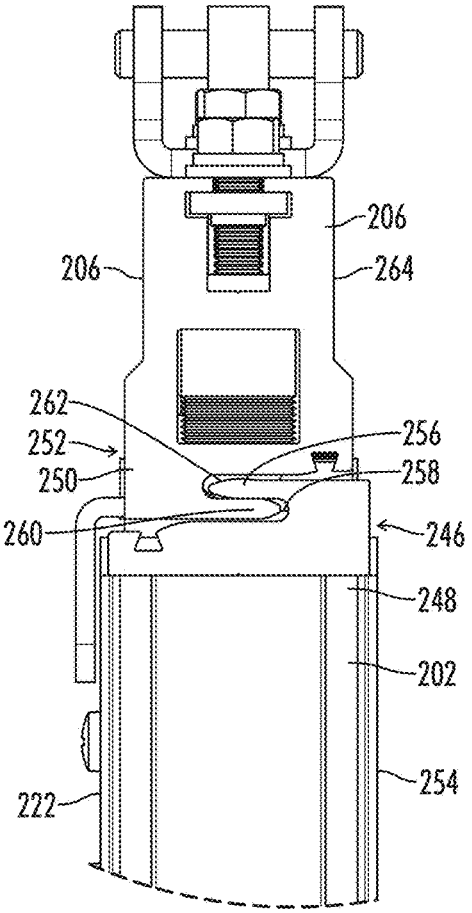
FIG. 53 illustrates a right side elevation view of the circled area labelled 53 in FIG. 52.
Figure 54:
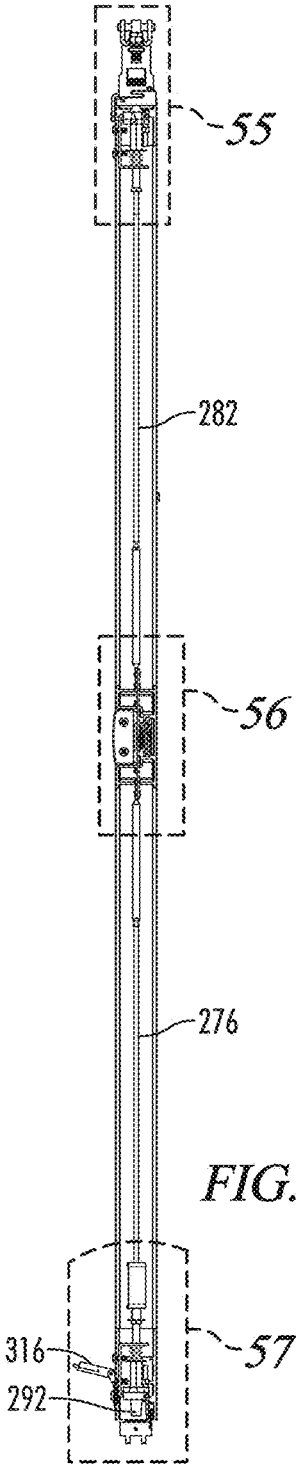
FIG. 54 illustrates a right side elevation view of the single breakout sliding door system of FIG. 30, with the right side of the door frame removed.
Figure 55:
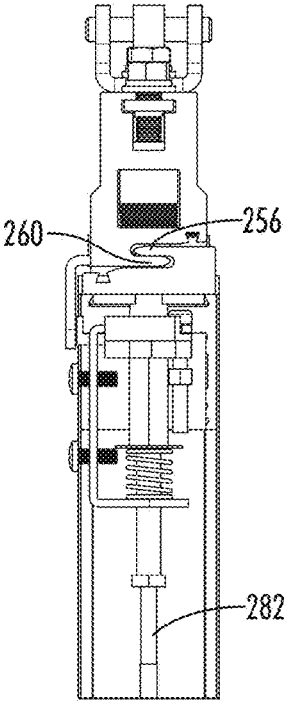
FIG. 55 illustrates a right side elevation view of the rectangular area labelled 55 in FIG. 54.
Figure 56:
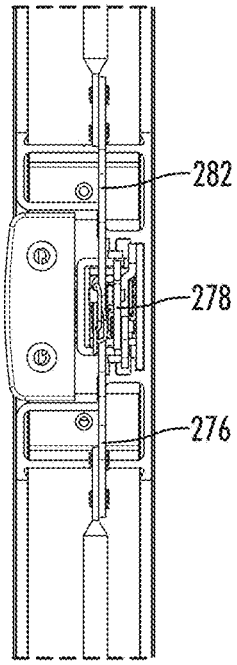
FIG. 56 illustrates a right side elevation view of the rectangular area labelled 56 in FIG. 54.

Optionally, the system 200 further comprises a door top latch 246 extending from the door top 248, a top panel bottom latch 250 extending from the top panel bottom 252, the door top latch 246 and the top panel bottom latch 250 are configured to mate when the door 202 is in the sliding plane and the door top latch 246 and the top panel bottom latch 250 are not configured to mate when the door 202 is in the door front open position. Optionally, the top panel bottom latch 250 is configured to support the door 202 when the door 202 is in the sliding plane and the top panel bottom latch 250 is not configured to support the door 202 when the door 202 is in the door front open position. The door top latch 246 and the top panel bottom latch 250 are best seen in FIGS. 53, 55, 64, 65 and 67 where the single breakout feature is apparent. Similar to the previous embodiment, the door top latch 246 may include a door top flange 256 for example and a door top slot 258 located below the door top flange 256 and above the door top 248 and the top panel bottom latch 250 may include a top panel flange 260 that is configured to locate in the door top slot 258 when the door 202 is in the sliding plane and a top panel slot 262 that is configured to receive the door top flange 256 when the door 202 is in the sliding plane, as seen in FIG. 53, for example. Unlike the previous embodiment, the top panel slot 262 does not extend from the top panel front side 264 to the top panel rear side 266 and the door top slot 258 does not extend from the door front side 254 to the door rear side 222, as seen in FIG. 53, for example.

Optionally, the door bottom 224 further comprises a door bottom lock 270 having a locked position in which the door bottom lock 270 prevents the door 202 from moving from the door 202 sliding plane to the door front open position and also prevents the door 202 from moving from the sliding closed position to the sliding open position and an unlocked position in which the door bottom lock 270 allows the door 202 to move from the door sliding plane to the door front open position and to move from the sliding closed position to the sliding open position. A purpose of the bottom lock 270 is that it can be used in events of extreme weather such as a hurricane to provide further protection. Optionally, a shield 272 is used to prevent a user from accidentally kicking and engaging the bottom lock 270.

Figure 39:
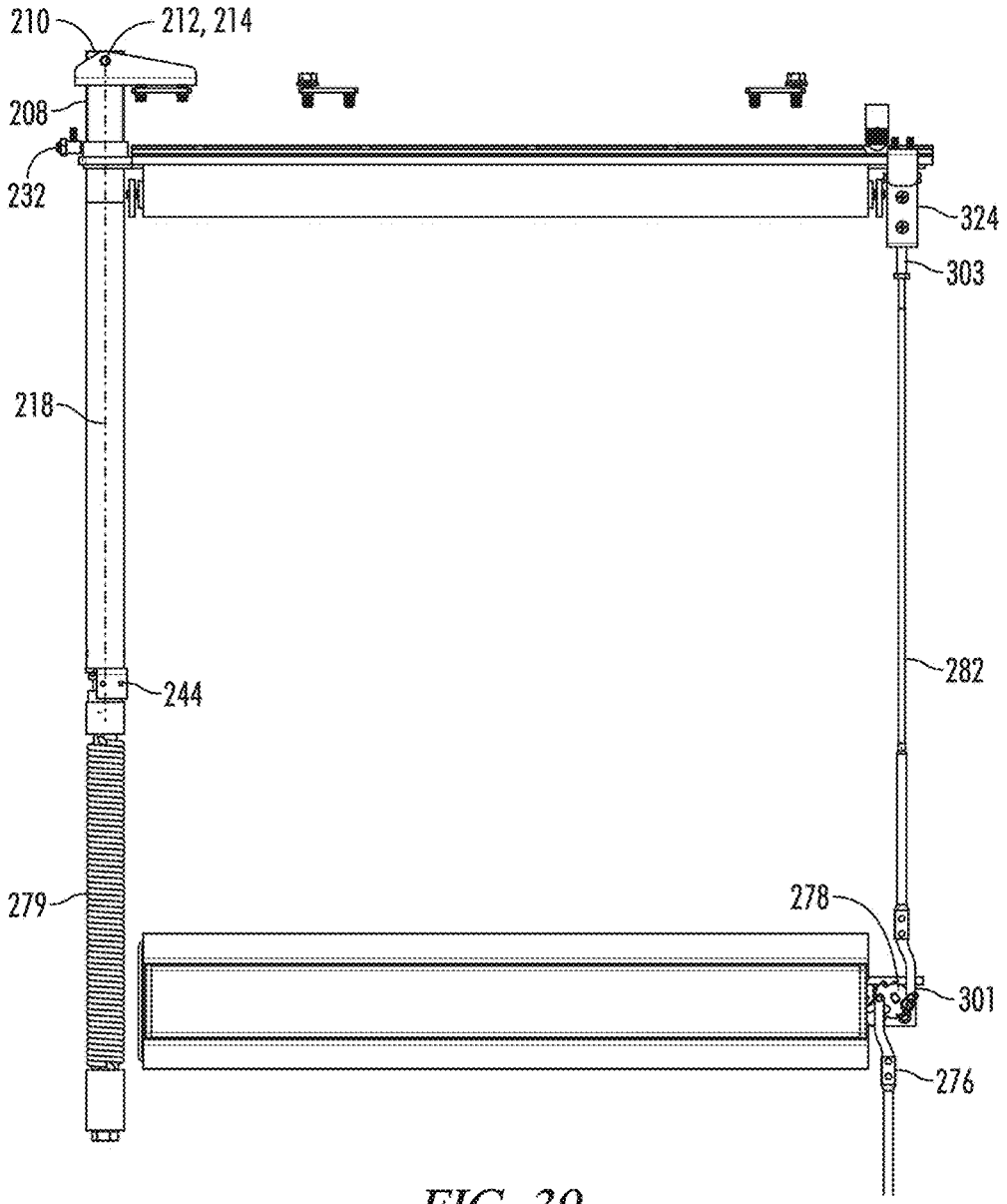
FIG. 39 illustrates a rear elevation view of the rectangular area labelled 39 in FIG. 38.
Figure 40:
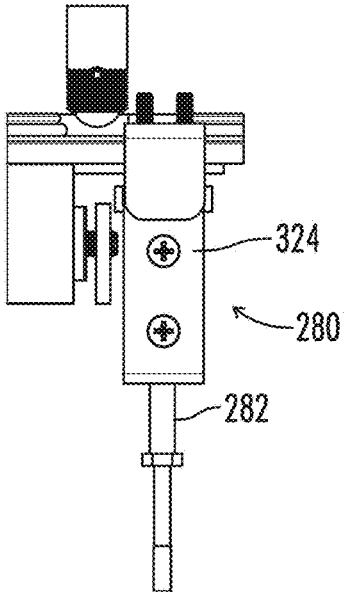
FIG. 40 illustrates a rear elevation view of the door of the rectangular area labelled 40 in FIG. 38.
Figure 41:
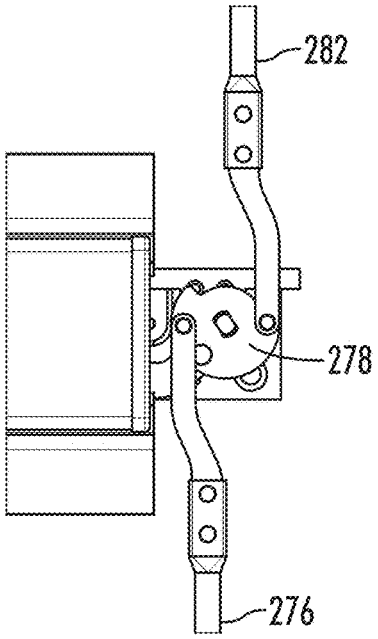
FIG. 41 illustrates a rear elevation view of the rectangular area labelled 41 in FIG. 38.
Figure 42:
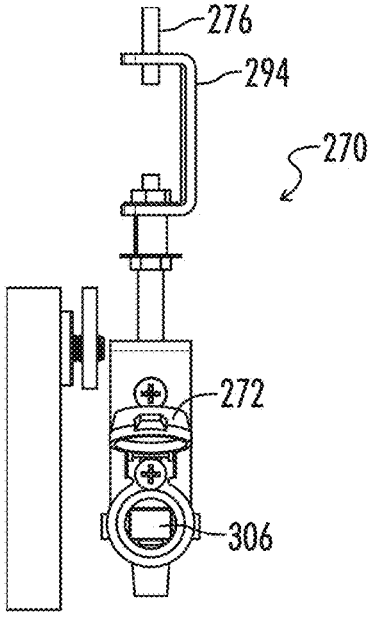
FIG. 42 illustrates a rear elevation view of the rectangular area labelled 42 in FIG. 38.
Figure 43:
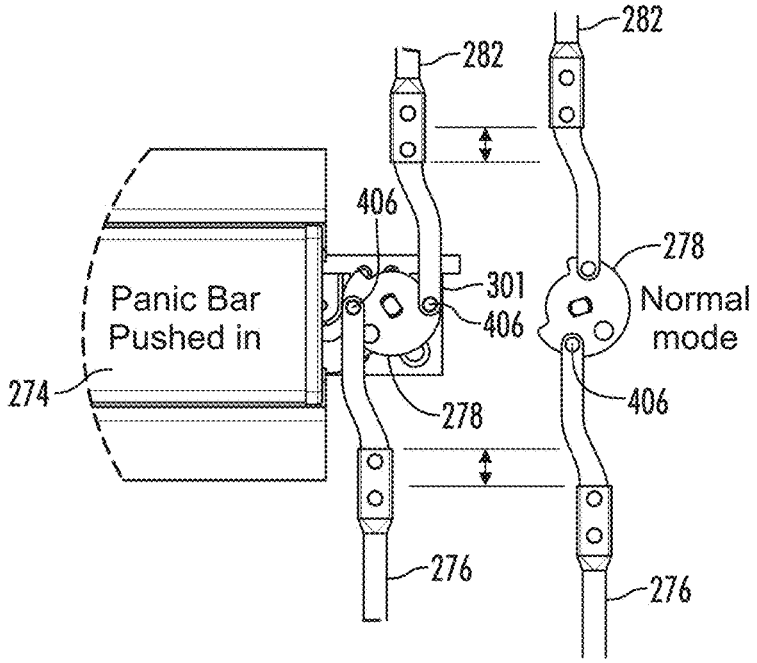
FIG. 43 illustrates two rear elevation views of the panic bar and gear of the single breakout sliding door system of FIG. 30; two views are shown with the left view representing the gear when the panic bar has been pushed in and the right view representing the normal mode (i.e., when the panic bar has not been pushed).
Figure 44:
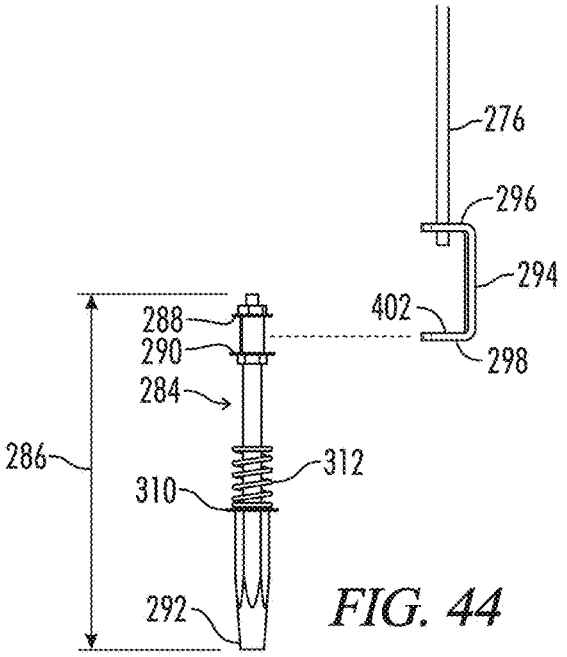
FIG. 44 illustrates a rear prtially exploded view of the bottom lock rod and slip-joint of the single breakout sliding door system of FIG. 30.
Figure 45:
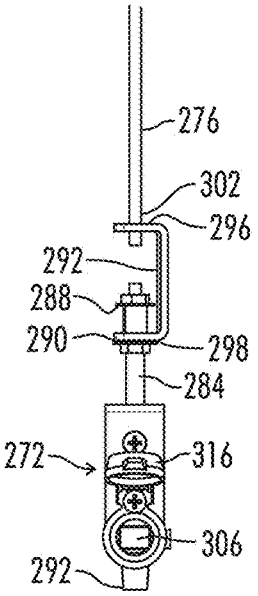
FIG. 45 illustrates a rear elevation view of the bottom lock rod and slip-joint of the single breakout sliding door system of FIG. 30.
Figure 46:
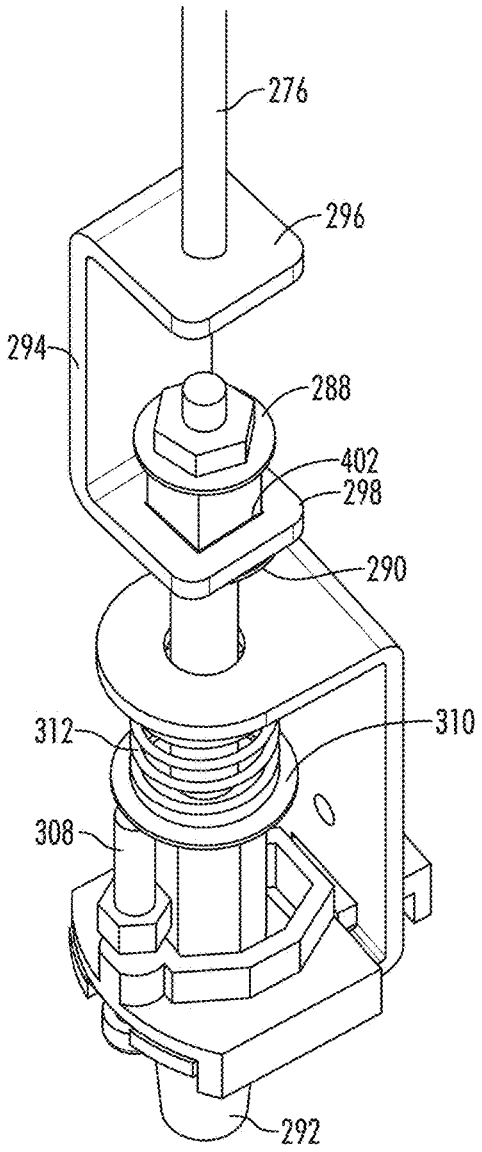
FIG. 46 illustrates a rear perspective view of the bottom lock rod and slip-joint of the single breakout sliding door system of FIG. 30, with a portion of the right side of the door frame removed to better illustrate the internal components.
Figure 47:
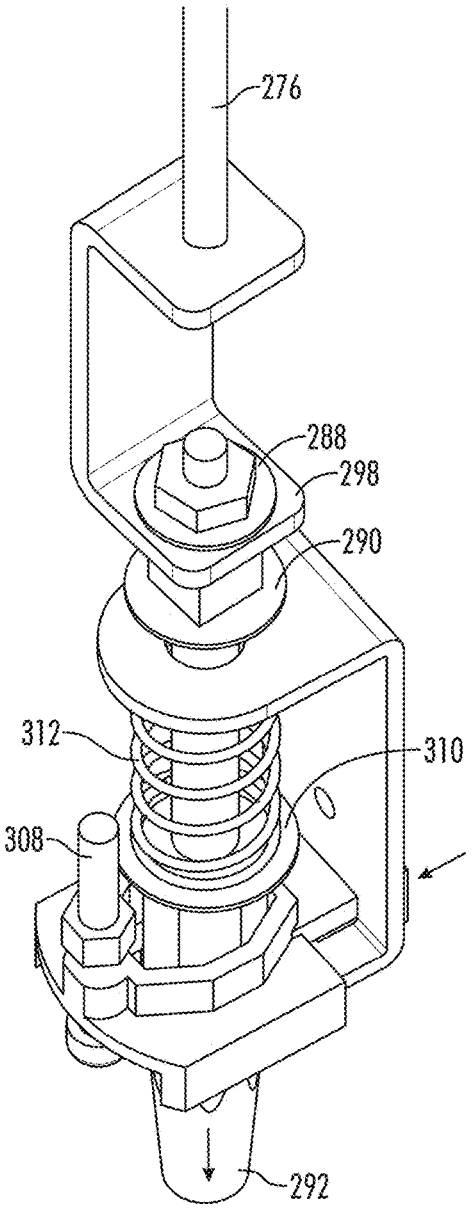
FIG. 47 illustrates a rear perspective view of the bottom lock rod and slip-joint of the single breakout sliding door system of FIG. 30, with a portion of the right side of the door frame removed to better illustrate the internal components.

Optionally, the door 202 further comprises a depressible panic bar 274 operatively connected to the bottom lock 270 and the top lock 280 (which is described below). Depressing the panic bar 274 is configured to rotate gear 278, moving top lock rod 282 downwardly and bottom lock rod 276 upwardly, and thereby cause the top lock 280 to move from the locked position to the unlocked position and cause the door bottom lock 270 if the bottom lock pin tip 292 is in the bottom lock recess 294 to move from the locked position to the unlocked position. The connectivity is seen in FIGS. 39, 41 and 43 for example, where rods 282 and 276 and a gear 278 are shown. Movement of the top lock 280 and bottom lock 270 is described with better specificity below.

Figure 48:
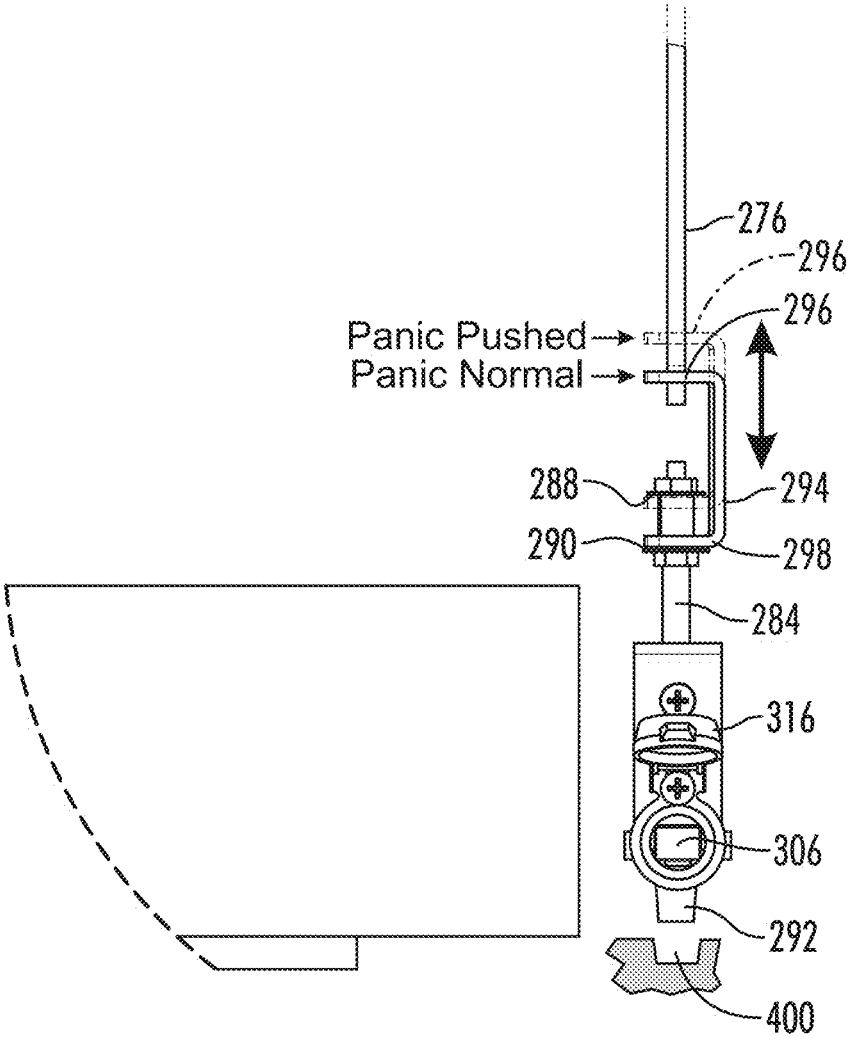
FIG. 48 illustrates a rear elevation view of the bottom lock rod and slip-joint of the single breakout sliding door system of FIG. 30, with a portion of the right side of the door frame removed to better illustrate the internal components.
Figure 49:
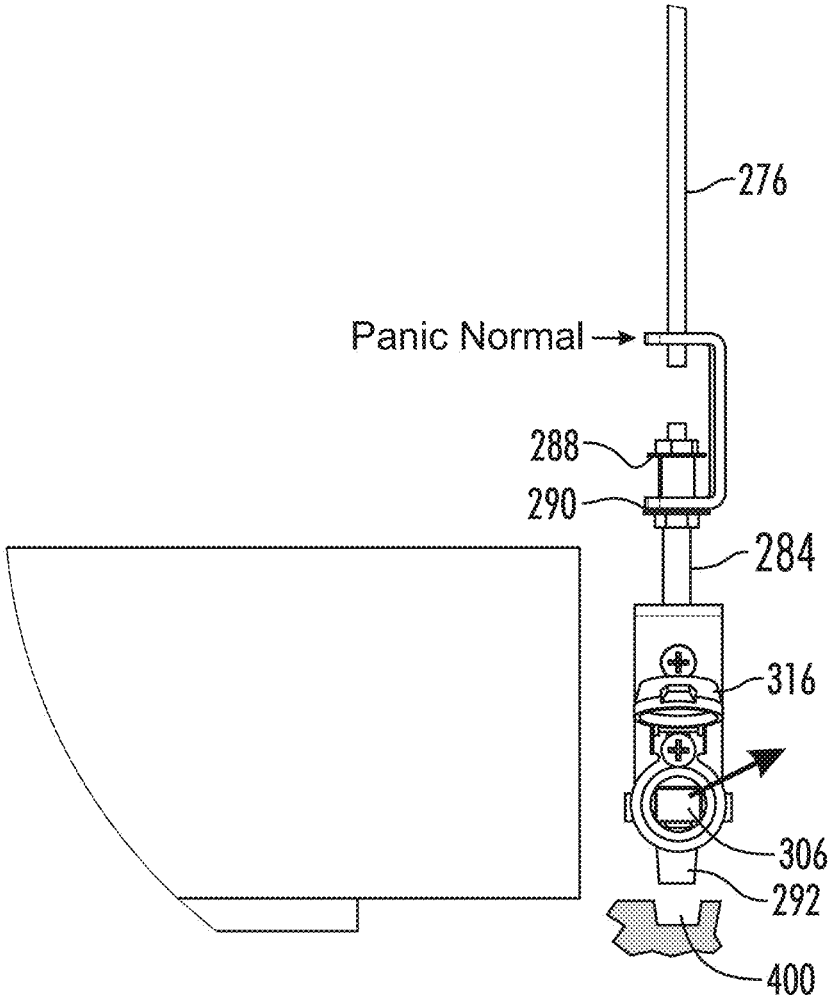
FIG. 49 illustrates a rear elevation view of the bottom lock rod and slip-joint of the single breakout sliding door system of FIG. 30, with a portion of the right side of the door frame removed to better illustrate the internal components.
Figure 50:
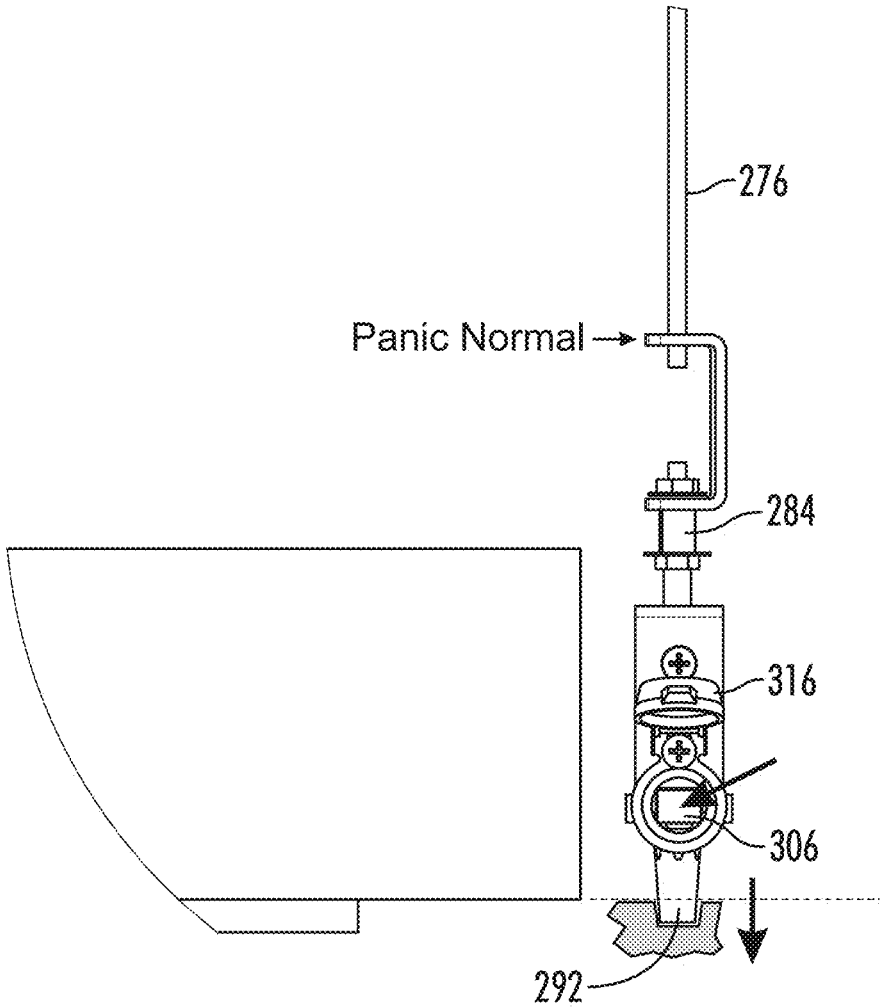
FIG. 50 illustrates a rear elevation view of the bottom lock rod and slip-joint of the single breakout sliding door system of FIG. 30, with a portion of the right side of the door frame removed to better illustrate the internal components.
Figure 51:
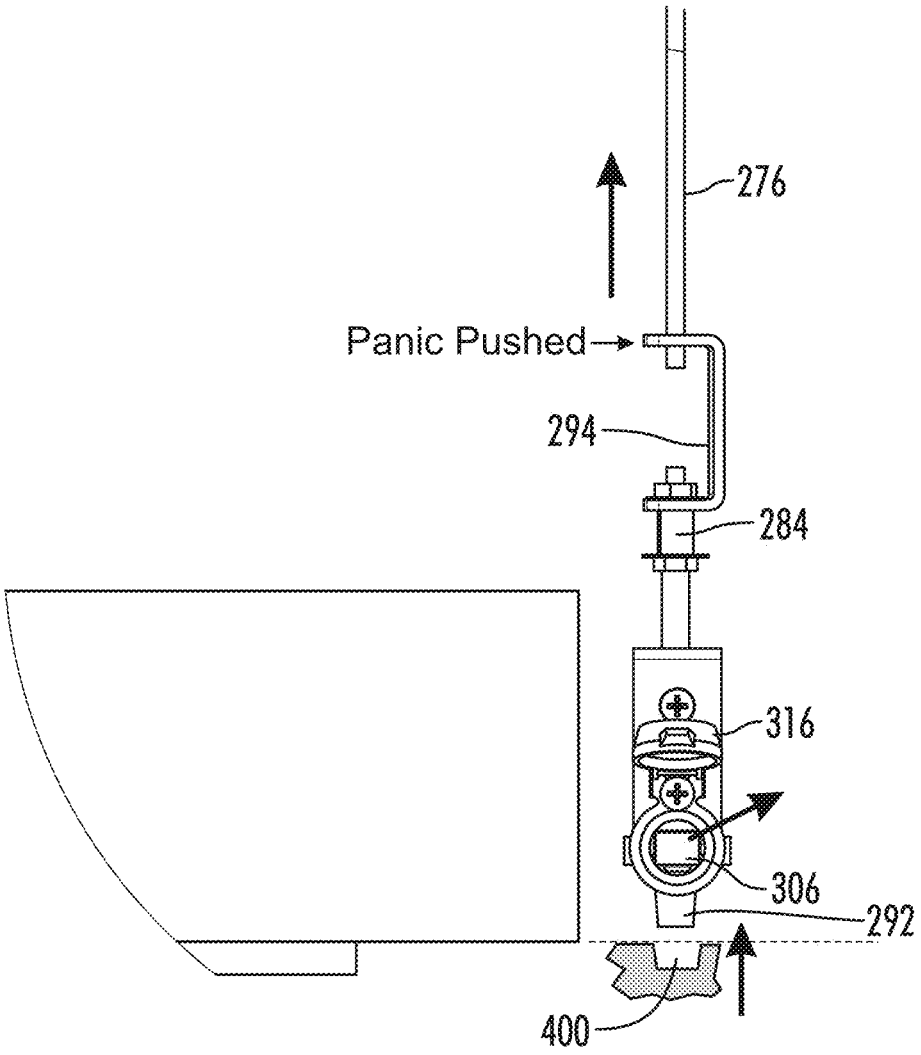
FIG. 51 illustrates a rear elevation view of the bottom lock rod and slip-joint of the single breakout sliding door system of FIG. 30, with a portion of the right side of the door frame removed to better illustrate the internal components.
Figure 52:
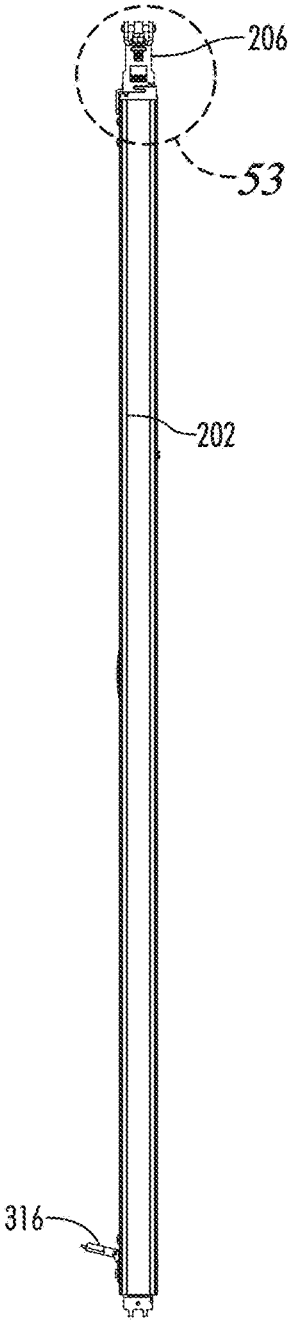
FIG. 52 illustrates a right side elevation view of the single breakout sliding door system of FIG. 30.
Figure 57:
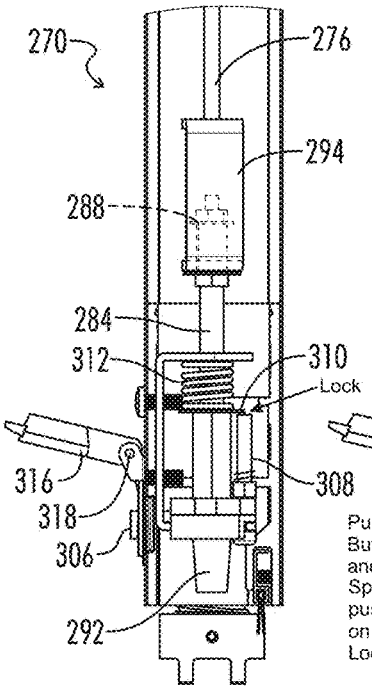
FIG. 57 illustrates a right side elevation view of the rectangular area labelled 57 in FIG. 54.
Figure 58:
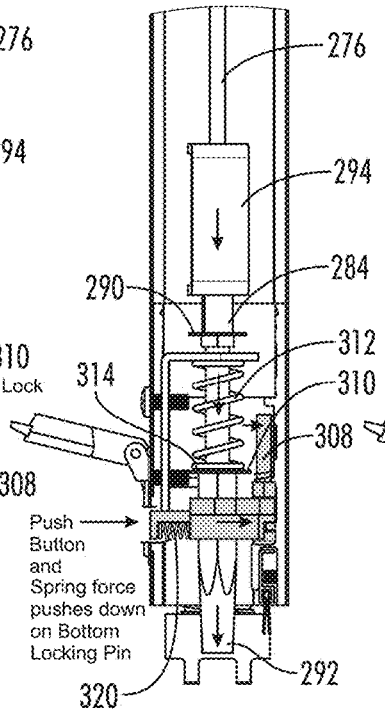
FIG. 58 illustrates a right side close-up elevation view of the bottom lock of FIG. 57, in FIG. 58, the bottom lock button has been pushed inward/activated, causing the spring force to push down on the bottom pin so that the bottom pin enters the lock recess.
Figure 59:
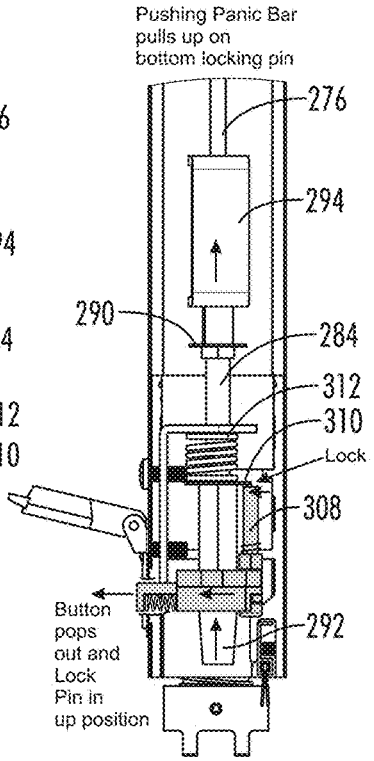
FIG. 59 illustrates a right side close-up elevation view of the bottom lock of FIG. 58, in FIG. 59, the panic bar has been pushed, which causes the bottom pin to move upwardly out of the lock recess and also causes the bottom lock button to return to the start position shown in FIG. 57, locking the bottom pin above the bottom lock recess.
Figure 60:
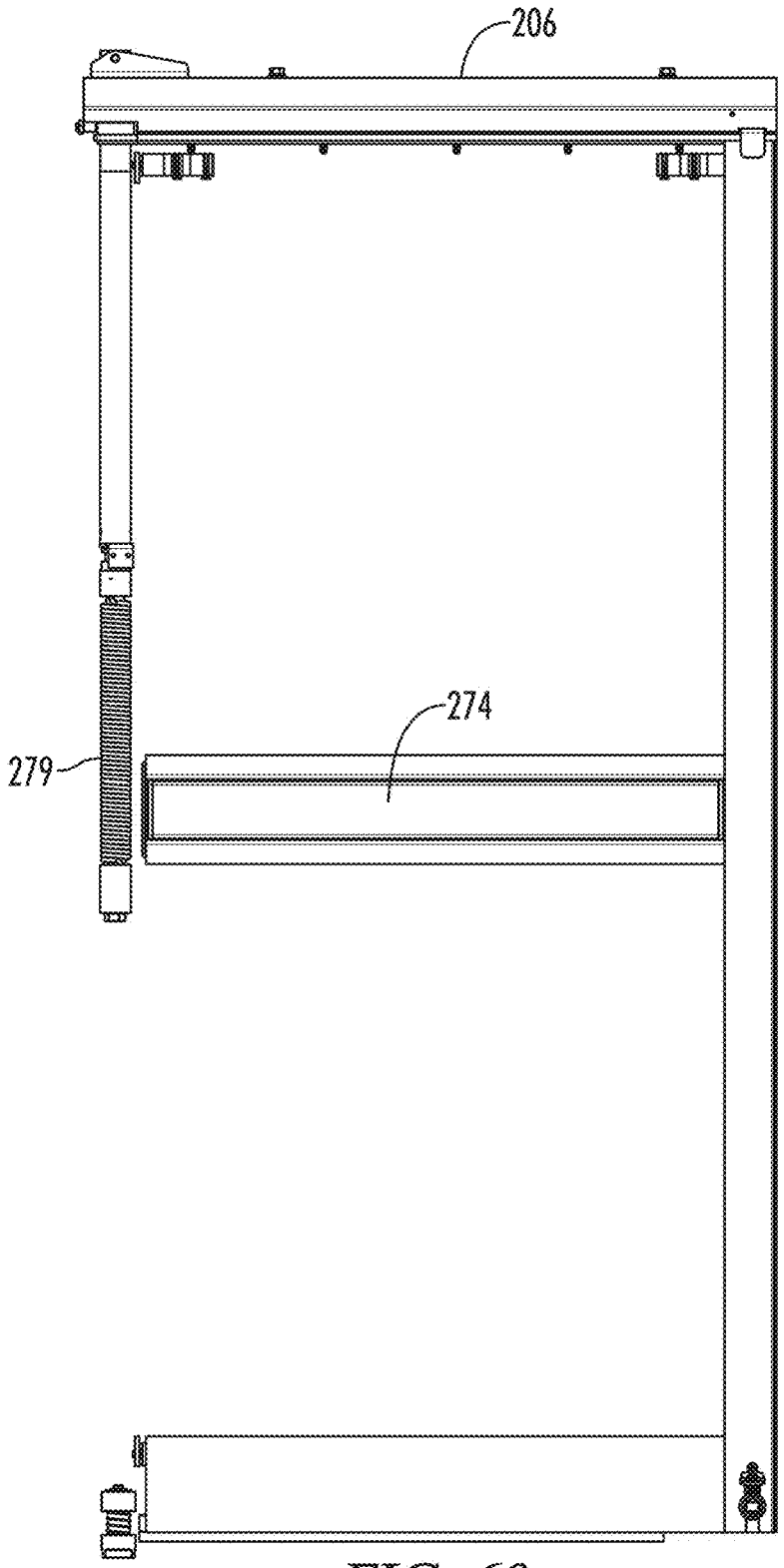
FIG. 60 illustrates a rear, elevation view of the single breakout sliding door system FIG. 30.
Figure 61:
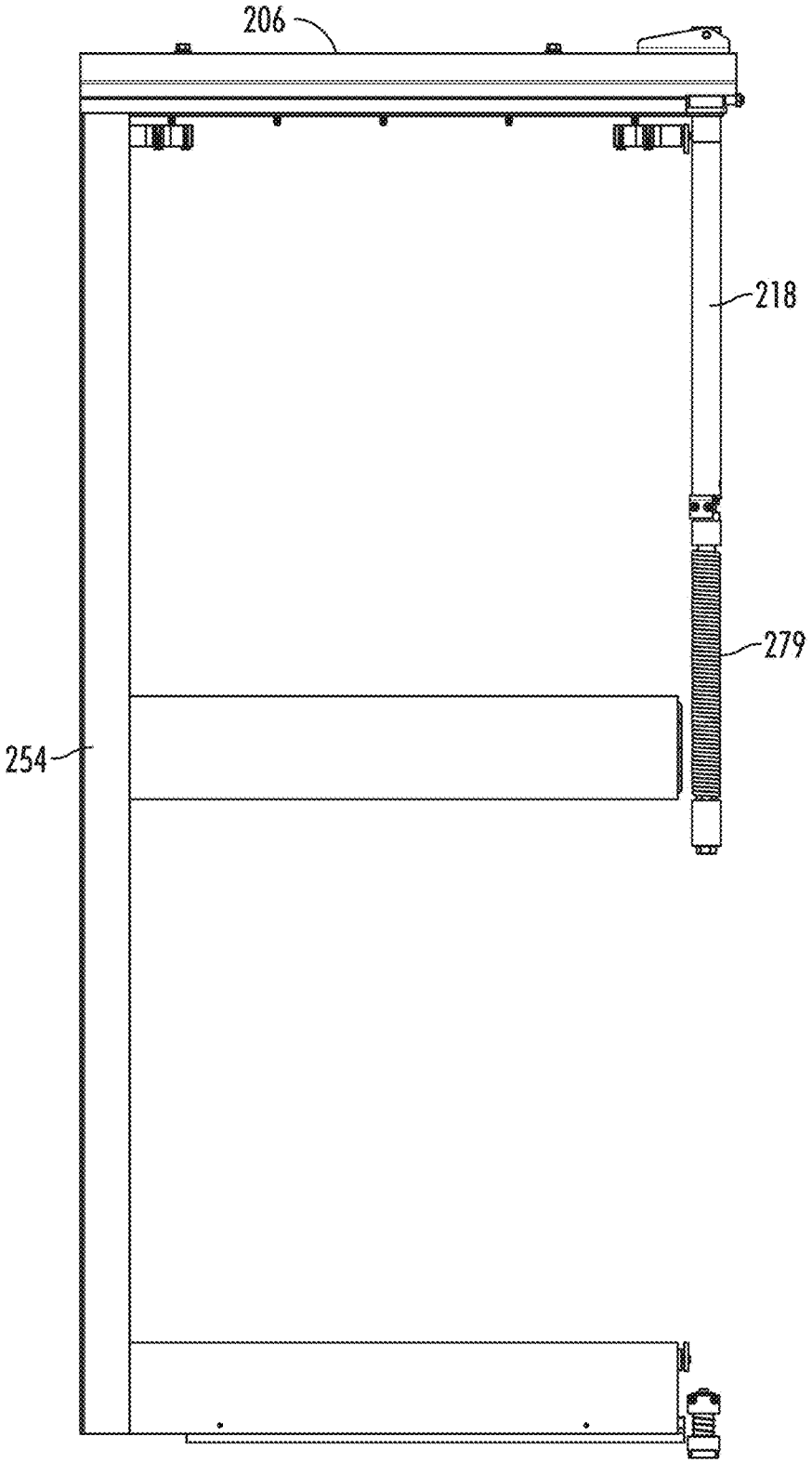
FIG. 61 illustrates a front, elevation view of the single breakout sliding door system of FIG. 30.

An example of the bottom lock 270 is best seen in FIGS. 42, 45, 48-51, and 57-59. As shown in FIGS. 42, 45, 48-51, and 57-59, the bottom lock 270 may include a bottom lock pin 284 located below the bottom lock rod 276 and having a bottom lock pin height 286, a bottom lock pin upper flange 288 and a bottom lock pin lower flange 290 and a bottom lock pin tip 292 located at a bottom of the bottom lock pin 284, a bottom lock pin recess 400 configured to receive the bottom lock pin tip 284, a bracket 294 having an upper horizontal portion/plate 296 fixed to the bottom lock rod 276 and a lower horizontal portion/plate 298 located below the upper horizontal portion 296, the upper and lower horizontal portions 296 and 298 separated by a gap 300, the lower horizontal portion 298 having an aperture 402 receiving the bottom lock pin 284 and configured to slide along a portion of the bottom lock pin height 286 between the bottom lock pin upper flange 288 and bottom lock pin lower flange 290. Optionally, the bottom lock 270 has a bottom lock inactive state in which the bottom lock pin tip 292 is located above the bottom lock recess 400 and in which depressing the panic bar 274 is configured to cause the gear 278 to rotate and move the bottom lock rod 276 upwardly and further wherein moving the bottom lock rod 276 upwardly is configured to cause the bracket 294 to move upwardly toward the bottom lock pin upper flange 288 without moving the bottom lock pin 284 upwardly, as seen in FIG. 48. Optionally, the bottom lock 270 has a bottom lock active state in which the bottom lock pin tip 292 is located in the bottom lock recess 400 and in which depressing the panic bar 274 is configured to cause the gear 278 to rotate and move the bottom lock rod 276 upwardly and further wherein moving the bottom lock rod 276 upwardly in the active state is configured to cause the bracket 294 to move the bottom lock pin upper flange 290 upwardly and the bottom lock pin 284 upwardly so that the bottom lock pin tip 292 moves out of the bottom lock recess 400, as best seen by comparing FIG. 51 (where the panic bar 274 has been depressed) with FIG. 50 (where the panic bar 274 has not been depressed). Optionally, when the bottom lock pin tip 292 is in the bottom lock recess 400, the door 202 is unable to move from the sliding plane to the door front open position and the door is unable to move from the sliding closed position to the sliding open position. Optionally, the bottom lock 270 further comprises a depressible bottom lock button 306 configured to move the bottom lock 270 from the inactive state to the active state (i.e., to drop the bottom lock pin tip 292 into the bottom lock recess 400), a moveable support/plate 308, a spring flange 310 located on the bottom lock pin 284 and a bottom lock spring 312 having a bottom end 314 confronting the spring flange 310, and further wherein depressing the depressible bottom lock button 306 while the bottom lock 270 is in the inactive state is configured to cause i) the moveable support 308 to move horizontally out of the path of the spring flange 310, ii) the bottom end of the bottom lock spring 314 to move downwardly, iii) the bottom lock pin tip 292 to move downwardly into the bottom lock recess 400; and iv) to move the bottom lock 270 to the active state, as shown by comparing FIG. 58 (which shows the depressible bottom lock button 306 depressed) with FIG. 57 (which shows the depressible bottom lock button 306 not depressed). The moveable support 308 also serves to hold the bottom lock pin 284 upward in the inactive state (as shown in FIG. 57) until the depressible bottom lock button 306 is depressed. Depressing the panic bar 274 may reset the depressible lock button 306 and bottom lock pin tip 292, as shown in FIG. 59. More particularly, when the bottom lock button 306 is depressed, this causes the button spring 320 to compress which causes the moveable support 308 to move horizontally out from underneath the spring flange 310. The bottom lock spring 312 then is allowed to de-energize/decompress/stretch/expand downward and therefore move the bottom lock 270 downward to engage the bottom lock pin tip 292 into the bottom lock recess 400. As the bottom lock spring 312 is de-energizing/decompressing/stretching/expanding and simultaneously moving the spring flange 310 downward below the top surface of the moveable support 308, the spring flange 310 also acts as a stop preventing the moveable support 308 and likewise the bottom lock button 306 from fully resetting to its normal position. When the panic bar 274 is depressed, the bottom lock pin 284 moves upwardly and likewise the spring flange 310 also moves upward until the panic bar 274 has reached its full travel depth and likewise the bottom lock rod 276 has reached its full travel height and likewise the spring flange 310 has reached its full travel height above the top surface of the moveable support 308 thereby simultaneously allowing the button spring 320 to de-energize/decompress/stretch/expand and likewise cause the moveable support 308 to move horizontally passing under the spring flange 310 until the bottom lock button 306 has reached its normal state and the moveable support 308 prevents the spring flange 310 from moving downward to re-engage the bottom lock pin tip 292 into the bottom lock recess 400 until the next time a person purposely and manually depresses the bottom lock button 306 and thus engaging the bottom lock pin tip 294 into the bottom lock recess 400.

Optionally, the bottom lock 270 further includes a button spring 320 to reset the moveable support 308. In other words, the bracket 294 acts as a slip-joint and slides along a portion of the bottom lock pin height 286 between the top flange 288 and the bottom flange 290 when the depressible bottom lock button has not been depressed, and the bracket 294 lifts the bottom lock pin tip 292 only when the bottom lock pin tip 292 is in the bottom lock recess 400 (i.e., when the depressible bottom lock button 306 has been depressed). Optionally, the previously mentioned shield 272 is in the form of a cover plate 316 and a hinge 318, the cover plate 316 is configured to pivot along the hinge 318 from a closed position in which the cover plate 316 covers the depressible bottom lock button 306 to an open position in which the cover plate 316 does not cover the depressible bottom lock button 306.

The bottom lock 270 is believed to be novel independent of the pivoting rod 208. Thus, the bottom lock 270 having any of the features described herein may be used in doors, particularly doors that move in a sliding plane by a motor and break open, that don't utilize the pivoting rod 208.

Optionally, a top lock 280 is employed. Top locks are well-known in the art and any suitable top lock 280 may be employed, including for example, a cam 322 that rotates when depressing the panic bar 274 causes the top lock rod 282 to move downwardly (see FIGS. 62-68), thereby allowing the door 202 to move from the sliding plane to the front open position. Optionally, when the panic bar 274 is depressed and the top lock rod 282 moves downwardly, there is a positive locking device intended to keep the top lock rod 282 downwardly until the door 202 returns to the sliding plane at which point a reset bracket/plate affixed to the top panel 206 depresses a button and causes the top lock rod 282 to travel upwardly into an aperture in the top panel 206 thereby preventing the door 202 from moving from the sliding plane to the front open position until the panic bar 274 is depressed. Such top lock positive locking devices and reset bracket/plates are known to those of ordinary skill in the art.

Both the height of the top lock rod 282 and bottom lock rod 276 may be adjustable to accommodate varying distances between the panic bar 274 location and the door bottom 224 and also varying distances between the panic bar 274 location and the door top. An exemplary mechanisms for rod adjustment known to those in the art utilize threaded rods—i.e., a male threaded rod that threads into a hollow female threaded rod to accommodate different panel heights. It is also known to use a slide mechanism with locking set screw. For the threaded rod, which is utilized in the illustrated FIGS. 30-68, the aperture 402 in the bottom of the bracket 294 is a non-round shape/polygonal (e.g., square-shaped in the case of FIGS. 62-68) and likewise the joint is also a polygonal shape to prevent the threaded components of the bottom lock rod 276 from rotating and therefore prevent the bottom lock rod 276 from extending or shortening (which would cause the bottom lock 270 to not function) when in use. Similarly, in the illustrated embodiment, the top lock rod 282 top end 303 is polygonal shaped and likewise the top rod guide holes in C-shaped bracket 324 are polygonal shaped with large tolerance gaps to allow for any misalignment between the centerline of the bracket 324 on one end (the top end 303) of the top lock rod 282 and the centerline of the rod mounting pin 406 on the opposite end (the bottom end 301) of the top lock rod 282 which are located on gear 278 shown in FIG. 43.

As mentioned, a C-shaped bracket 324 may be employed in such systems. The C-shaped bracket 324 may be attached to the inside of the door frame whose top horizontal member provides a mounting surface for the cam 322 and whose top and bottom members act only as a guide for the polygonal-shaped rod top end 303 or dually as support members for mounting other optional components such as the locking button mechanism 306 (similarly shown in FIGS. 57-59) or the cam 322 in FIGS. 62-68. The polygonal shape is required in some embodiments to prevent the length of the top lock rod 282 from adjusting after its height is set and the bracket 324 is secured to the inside of the door frame.

Figure 62:
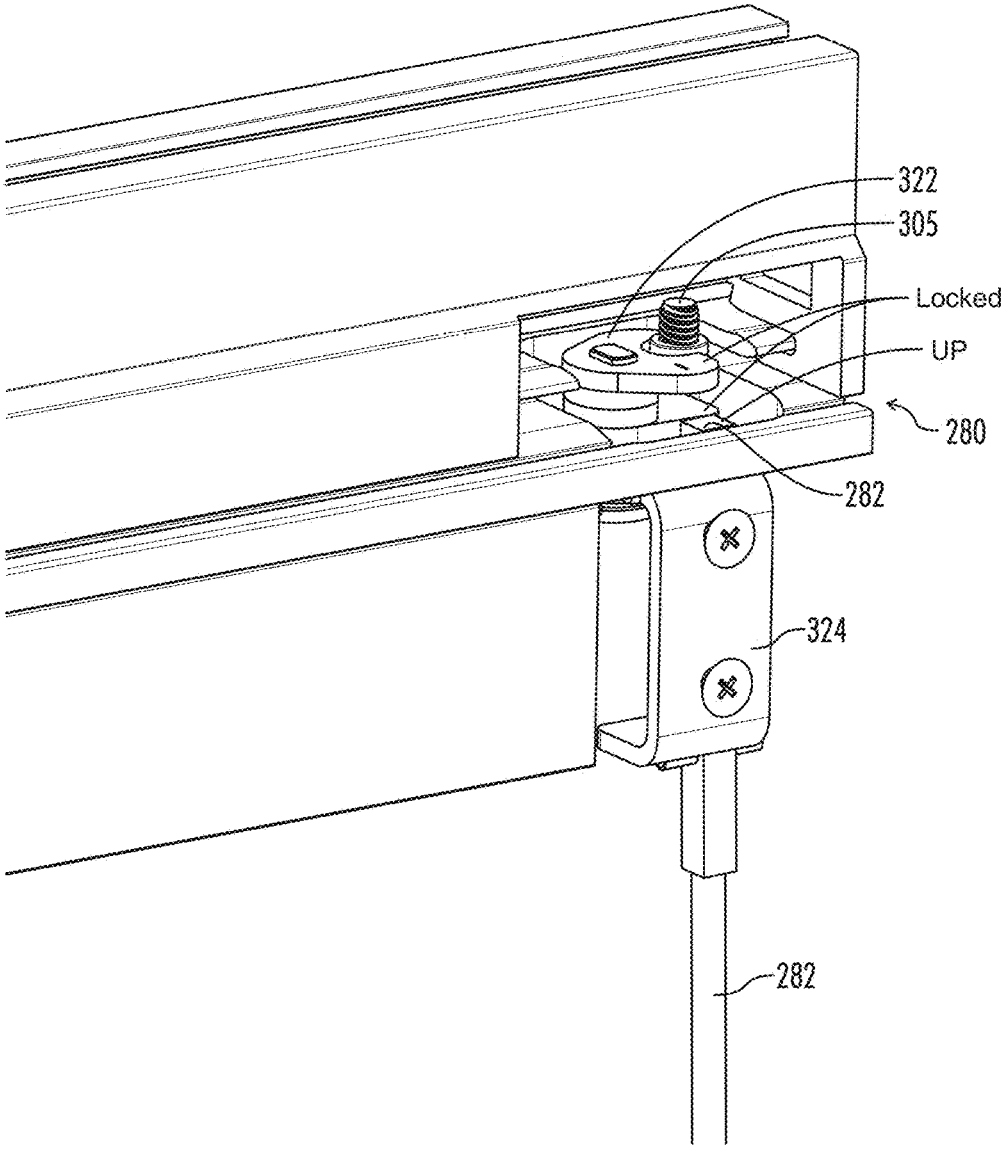
FIG. 62 illustrates a rear perspective view of the top lock of a single breakout sliding door system of another embodiment of the present invention.
Figure 63:
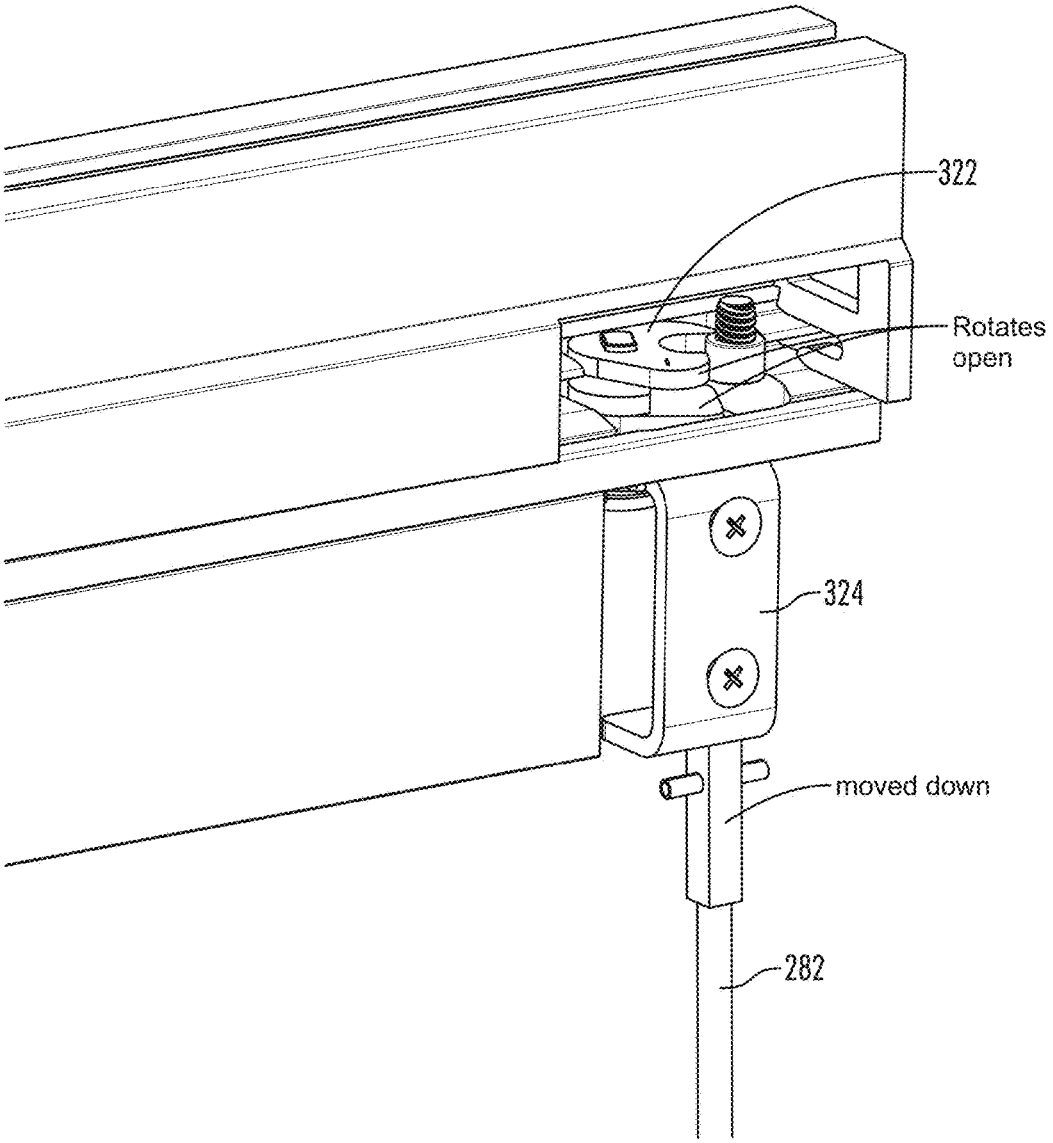
FIG. 63 illustrates a rear perspective view of the top lock of FIG. 62.
Figure 64:
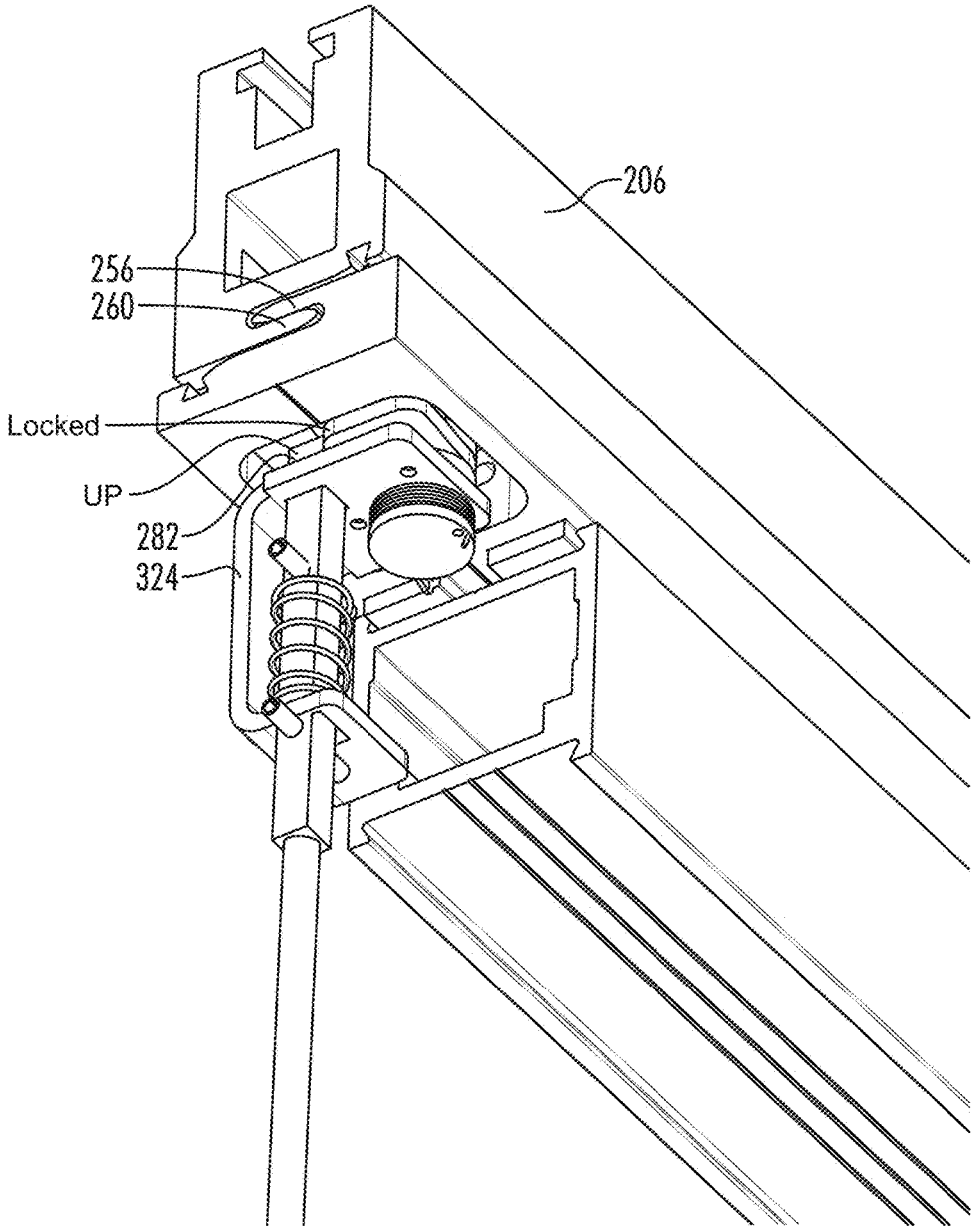
FIG. 64 illustrates a front bottom perspective view of the top lock of FIG. 62.
Figure 65:
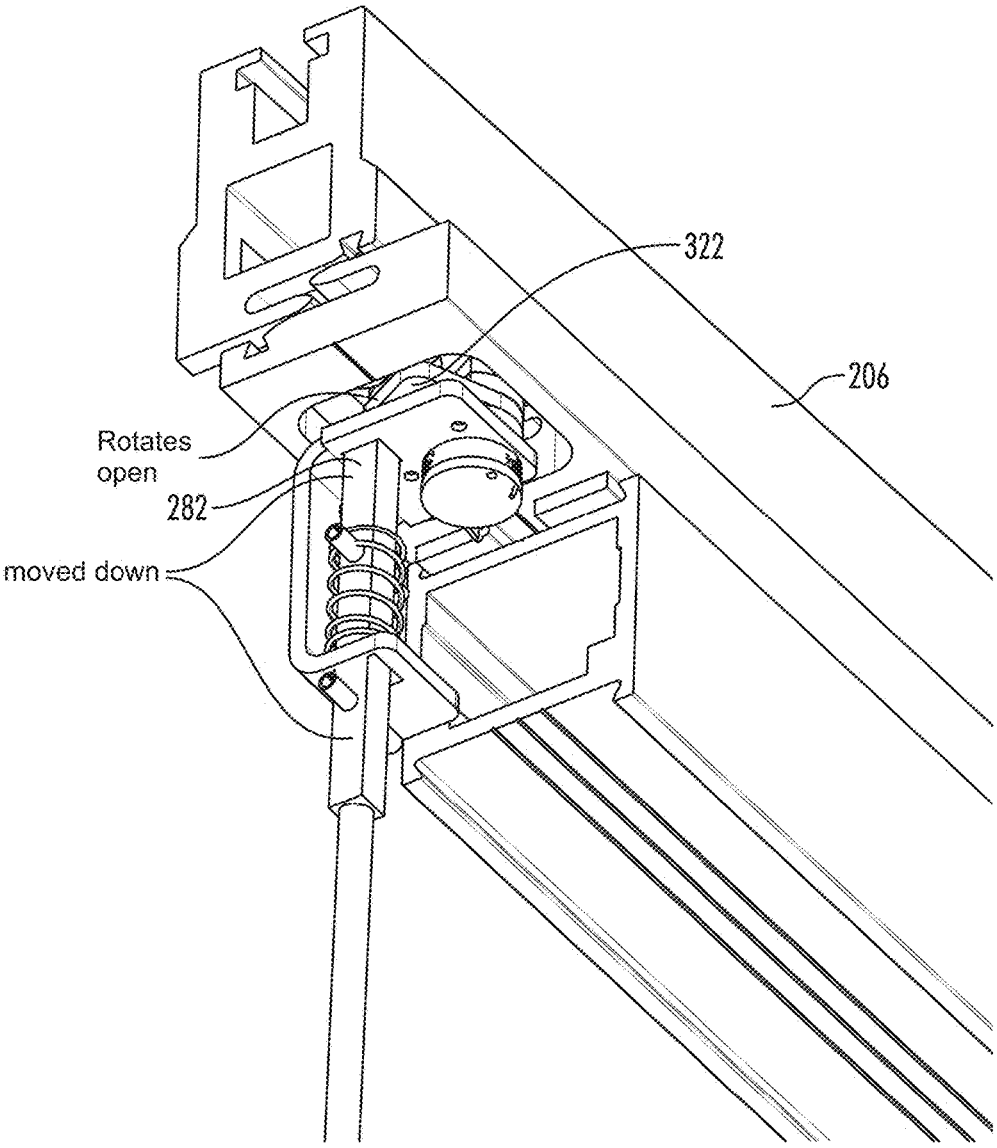
FIG. 65 illustrates a front bottom perspective view of the top lock of FIG. 63.
Figure 66:
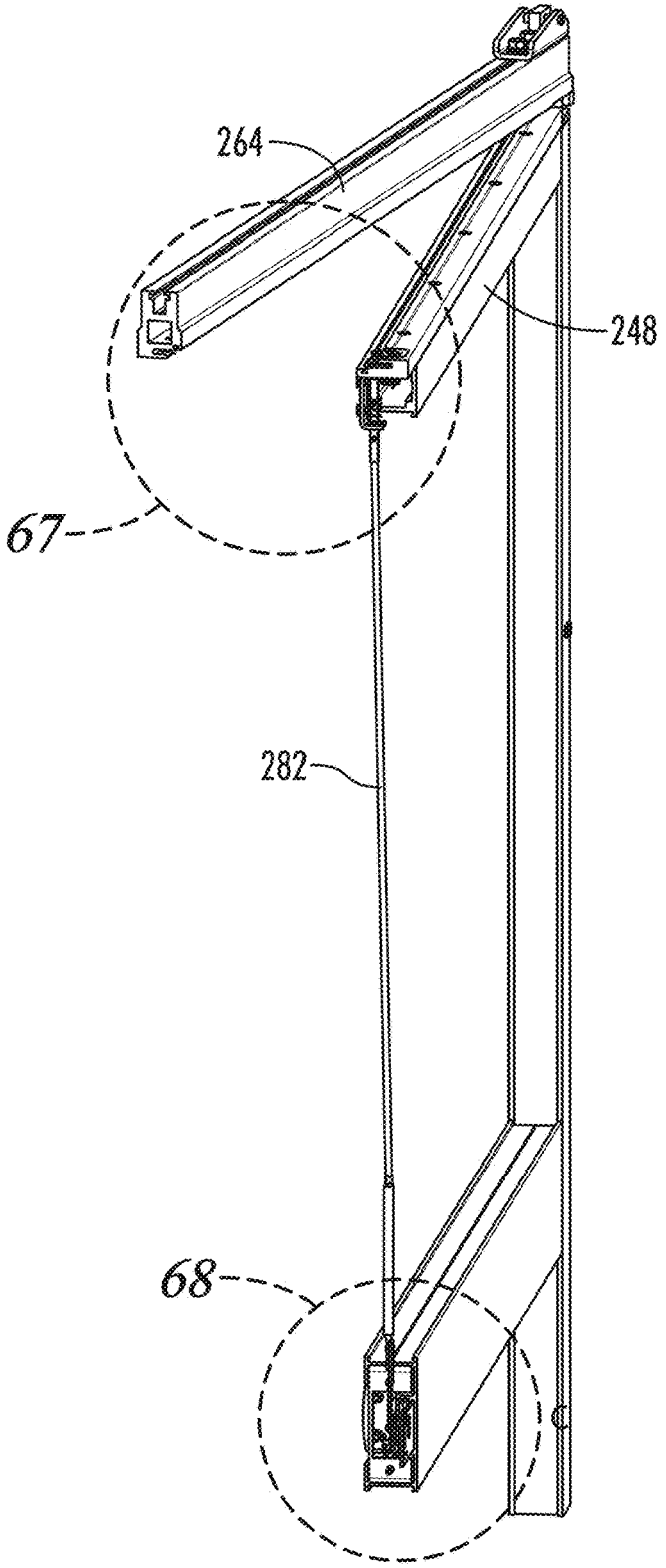
FIG. 66 illustrates a right side perspective view of the door of the single breakout sliding door system of FIG. 62 with the door located between the sliding plane and the front open position and with portions of the door frame removed to better show the internal components.
Figure 67:
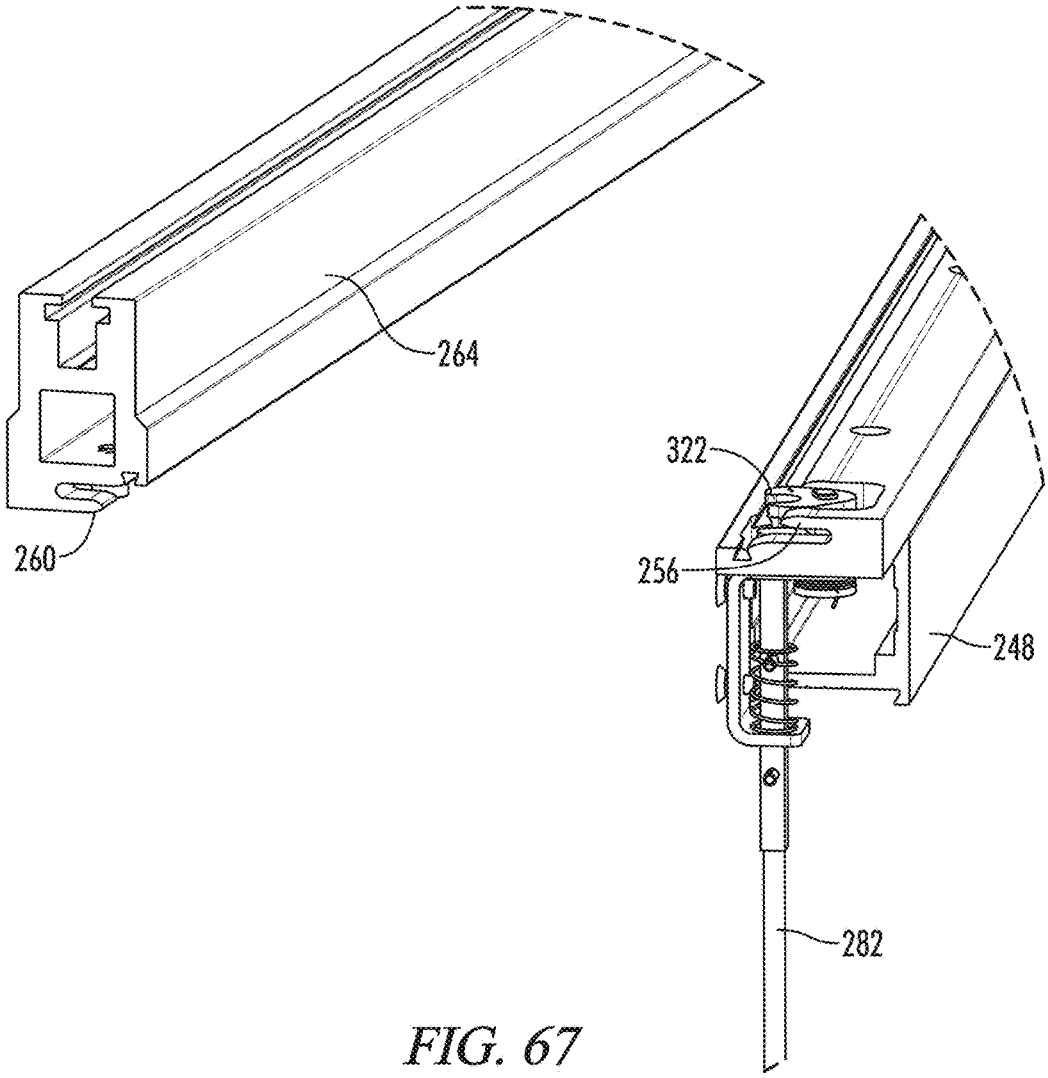
FIG. 67 illustrates a left side perspective view of the circled area labelled 67 in FIG. 66.
Figure 68:
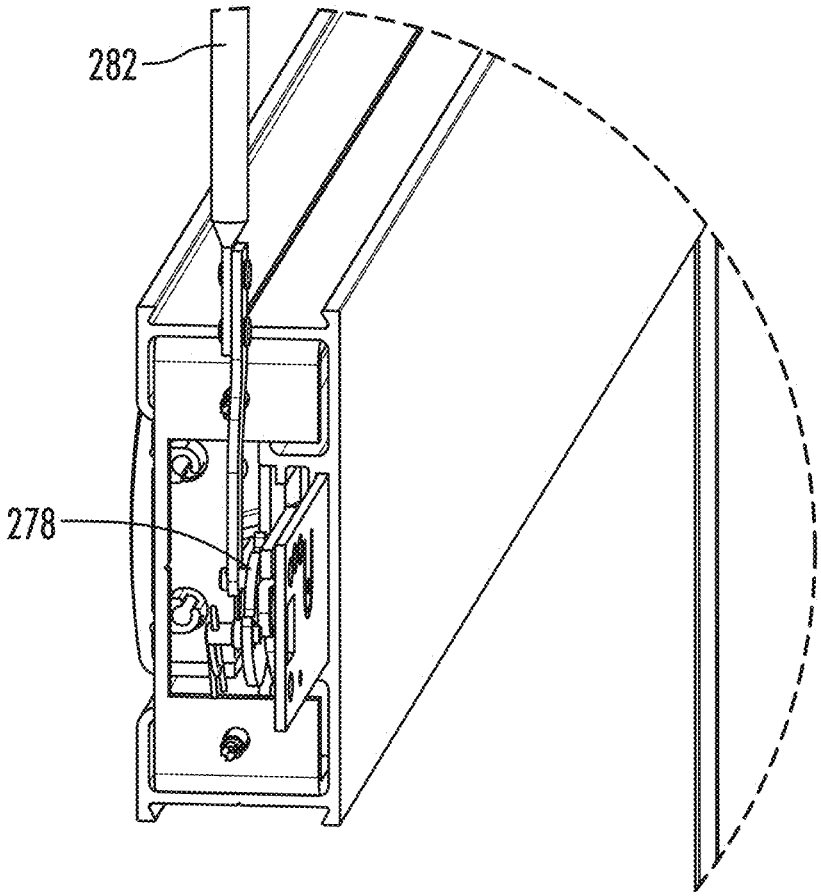
FIG. 68 illustrates a left side perspective view of the circled area labelled 68 in FIG. 66.

Re-setting of the cam 322 may be accomplished automatically by a resetting pin 305, shown in FIG. 62, which is activated at the instant the door 202 moves from the front open position to the sliding plane. Alternatively, the top lock 280 may just include a top lock rod 282 that moves downwardly 282 to allow the door 202 to move from the sliding plane to the front open position. A reset button (not identified by number but shown in FIG. 55 and similar in detail to the bottom lock button 306 may also be employed in such systems. Resetting of this button may be accomplished automatically via a reset bracket/plate (not identified but shown in FIG. 55) affixed to the top panel 206 which depresses the button at the instant the door 202 moves from the front open position to the sliding plane. Depressing of the button causes the top rod 282 to travel upwardly into an aperture in the top panel 206 thus preventing the door 202 from moving from the sliding plane to the front open position. The top 303 of the top lock rod 282 is shown as polygonal shaped and likewise the top rod guide holes in bracket 324 are polygonal shaped with large tolerance gaps to allow for any misalignment between the centerline of the bracket 324 on one end (namely, the top end 303) of the top lock rod 282 and the centerline of the rod mounting pin on the opposite end (namely the bottom end 301) of the top lock rod 282 which are located on gear 278 shown in FIG. 43.

The top lock rod 282 and bottom lock rod 276 may be attached to the gear 278 via pins 406, which allow for rotation of the bottom end 301 of the top lock rod 282 and the top end 302 of the bottom lock rod 276 around the pin 406 while the gear 278 is rotating and likewise moving the top lock rod 282 down and likewise moving the bottom rod 276 up (i.e., unlocking). This ability for the bottom end 301 of the top lock rod 282 and the top end 302 of the bottom lock rod 276 to rotate around the pins 406 allows for any misalignment between the centerline of the pin 406/engagement point in one end of the rod 301 and 302 and the centerline of the guide bracket 294 and 324 at the opposite end 303 and 304 of the rod 282 and 276.

The skilled artisan will be aware of the operation of such systems.

The top lock 280 and bottom lock 270 are generally present in both doors if the system 200 has two sliding doors.

The system 200 may also include an electric lock that also serves to prevent the door(s) 202 from sliding from the sliding closed position to the sliding open position. More particularly, a top lock rod 282 may only prevent the door 202 from breaking to the front open position. An electric lock inside the head (in communication with the motor) will prevent the door 202 from moving from the sliding closed position to the sliding open position. (The bottom lock 270 also prevents the door 202 from moving from the sliding closed position to the sliding open position but the depressible bottom lock button 306 is only depressed generally in the case of a hurricane or other emergency).

Optionally, the system 200 further comprises a door panel configured to remain fixed relative to the rectangular door system frame when the door 202 moves from the sliding closed position to the sliding open position, the door panel located to the side of the door 202 when the door 202 is in the sliding closed position, wherein the door 202 is configured to slide to the rear of the door panel when the door slides from the sliding closed position to the sliding open position, wherein the door panel is configured to move with the door 202 when the door 202 moves from the sliding plane to the door front open position.

Optionally, the system further comprises a track (not shown) located above the top panel and further wherein the system comprises a wheel (not shown) connected to the top panel and located in the track (not shown) and further wherein the wheel (not shown) is configured to move along the track (not shown) when the top panel and door slide from the sliding closed position to the sliding open position.

Optionally, the motor (not shown) is configured to move the wheel (not shown) along the track (not shown).

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A breakout sliding door system comprising:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a left door comprising a left door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness;

c) a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness;

d) a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width;

e) a top right panel located above the right door, the top right panel connected to the right door and comprising a top right panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right panel height perpendicular to the right door thickness, the top right panel thickness and the top right panel width;

f) a motor;

g) a left rod having a left rod top pivotally attached to the top left panel by a left pivot pin forming a left pivot pin axis, a left rod bottom attached to the left door left side, and a left rod longitudinal axis extending from the left rod top to the left rod bottom, the left rod extending in a general downward direction from the top left panel at least partially through the left door, the left pivot pin transverse to the left rod longitudinal axis and attached to the top left panel; and h) a right rod having a right rod top pivotally attached to the top right panel by a right pivot pin forming a right pivot pin axis, a right rod bottom attached to the right door right side, and a right rod longitudinal axis extending from the right rod top to the right rod bottom, the right rod extending in a general downward direction from the top right panel at least partially through the right door, the right pivot pin transverse to the right rod longitudinal axis and attached to the top right panel, wherein the motor is configured to slide the left door and right door in a sliding plane parallel to the system frame width from a sliding open position in which the left and right doors are apart and do not close the system frame opening to a sliding closed position in which the left door moves rightwardly and the right door moves leftwardly and in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein, when the left door moves from the sliding plane to a left door front open position when a force is exerted on the left door rear side perpendicular to the left door rear side when the left door is in the sliding plane, i) the left door is configured to rotate around the left rod about a left rotational plane generally perpendicular to the left rod longitudinal axis, ii) the left door is configured to rotate relative to the top left panel and iii) the left rod is configured to remain stationary relative to the top left panel, wherein the left door right side is in front of the rectangular door system frame and in front of the left door left side in the left door front open position, wherein, when the right door moves from the sliding plane to a right door front open position when a force is exerted on the right door rear side perpendicular to the right door rear side when the right door is in the sliding plane, i) the right door is configured to rotate around the right rod about a right rotational plane generally perpendicular to the right rod longitudinal axis, ii) the right door is configured to rotate relative to the top right panel and iii) the right rod is configured to remain stationary relative to the top right panel, and further wherein the right door left side is in front of the rectangular door system frame and in front of the right door right side in the right door front open position.

2. The breakout sliding door system of claim 1 wherein the bottom of the left door right side is configured to remain at substantially the same height relative to the rectangular door system frame when the left door rotates around the left rod from the sliding plane to the left door front open position and further wherein the bottom of the right door left side is configured to remain at substantially the same height relative to the rectangular door system frame when the left door rotates around the left rod from the sliding plane to the left door front open position.

3. The breakout sliding door system of claim 1 wherein the left rod bottom is configured to be the sole point of attachment of the left door to the top left panel when the left door is in the left door front open position and further wherein the right rod bottom is configured to be the sole point of attachment of the right door to the top right panel when the right door is in the right door front open position.

4. The breakout sliding door system of claim 1 wherein the left pivot pin axis and the right pivot pin axis are perpendicular to the system frame front side and the system frame rear side.

5. The breakout sliding door system of claim 1 wherein the top left panel further comprises a left adjustment fastener configured to engage the left rod and cause the left rod to move about the left pivot pin axis in a plane generally perpendicular to the left rotational plane and further wherein the top right panel further comprises a right adjustment fastener configured to engage the right rod and cause the right rod to move about the right pivot pin axis in a plane generally perpendicular to the right rotational plane.

6. The breakout sliding door system of claim 5 wherein moving the left rod about the left pivot pin axis is configured to cause the bottom of the left door right side to move vertically relative to the top left panel and further wherein moving the right rod about the right pivot axis is configured to cause the bottom of the right door left side to move vertically relative to the top right panel.

7. The breakout sliding door system of claim 1 wherein the left door comprises a left door frame comprising an interior and further wherein the left rod is located within the left door frame interior and further wherein the right door comprises a right door frame comprising an interior and further wherein the right rod is located within the right door frame interior.

8. The breakout sliding door system of claim 7 wherein the left rod bottom is hollow and surrounds a threaded shank of a left threaded bolt comprising a head and the threaded shank, wherein the left rod is fixed to the threaded shank of the left threaded bolt, wherein the left door further comprises a left door bracket located between the head of the left threaded bolt and the left rod bottom, wherein the left door bracket is attached to the left door frame, wherein the left door bracket is configured to rotate about the left rod and the left threaded bolt while the left rod and the left threaded bolt remain stationary as the left door moves from the sliding plane to the left door front open position and further wherein the bottom of the right rod is hollow and surrounds a threaded shank of a right threaded bolt comprising a head and the threaded shank, wherein the right rod is fixed to the threaded shank of the right threaded bolt, wherein the right door further comprises a right door bracket located between the head of the right threaded bolt and the bottom of the right rod, wherein the right door bracket is attached to the left door frame, wherein the right door bracket is configured to rotate about the right rod and the right threaded bolt while the right rod and the right threaded bolt remain stationary as the right door moves from the sliding plane to the right door front open position.

9. The breakout sliding door system of claim 1 wherein the system further comprises a left door top latch extending from the left door top, wherein the system further comprises a top left panel bottom latch extending from the top left panel bottom, wherein the left door top latch and the top left panel bottom latch are configured to mate when the left door is in the sliding plane and further wherein the left door top latch and the top left panel bottom latch are not configured to mate when the left door is in the left door front open position.

10. The breakout sliding door system of claim 9 wherein the top left panel bottom latch is configured to support the left door when the left door is in the sliding plane and further wherein the top left panel bottom latch is not configured to support the left door when the left door is in the left door front open position.

11. The breakout sliding door system of claim 1 wherein the left rod is attached to a left spring having a top end attached to the left rod bottom and a bottom end attached to the left door frame and further wherein the rotation of the left door around the left rod about the left rotational plane generally perpendicular to the left rod longitudinal axis when the left door moves from the sliding plane to the left door front open position beyond a pre-determined angle is configured to cause said left spring to bias the left door to the sliding plane, and further wherein the right rod is attached to a right spring having a top end attached to the right rod bottom and a bottom end attached to the right door frame and further wherein the rotation of the right door around the right rod about the right rotational plane generally perpendicular to the right rod longitudinal axis when the right door moves from the sliding plane to the right door front open position beyond a pre-determined angle is configured to cause said right spring to bias the right door to the sliding plane.

12. The breakout sliding door system of claim 1 wherein the left door further comprises a lock system comprising a depressible panic bar coupled to a gear coupled to a top lock rod, and further wherein the depressible panic bar has a resting state in which the left door is unable to move from the sliding plane to the left door front open position and a depressed state in which the left door is able to move from the sliding plane to the left door front open position, and further wherein depressing the panic bar when the panic bar is in the resting state is configured to cause the panic bar to rotate the gear and further wherein rotation of the gear is configured to cause the top lock rod to move downwardly so that the left door may move from the sliding plane to the front open position.

13. The breakout sliding door system of claim 12 wherein the lock system further comprises a bottom lock rod coupled to the gear and further wherein depressing the panic bar when the panic bar is in the resting state is configured to cause the panic bar to rotate the gear and further wherein rotation of the gear is configured to cause the bottom lock rod to move upwardly.

14. The breakout sliding door system of claim 13 wherein the lock system further comprises a bottom lock pin located below the bottom lock rod and having a bottom lock pin height, a bottom lock pin upper flange and a bottom lock pin lower flange and a bottom lock pin tip located at a bottom of the bottom lock pin, a bottom lock recess configured to receive the bottom lock pin tip, a bracket comprising an upper portion fixed to the bottom lock rod and a lower portion located below the upper portion and having an aperture receiving the bottom lock pin, the lower portion configured to slide along a portion of the bottom lock pin height between the bottom lock pin upper flange and bottom lock pin lower flange, and further wherein the lock system comprises a bottom lock inactive state in which the bottom lock pin tip is located above the bottom lock recess and in which depressing the panic bar is configured to cause the gear to rotate and move the bottom lock rod upwardly and further wherein moving the bottom lock rod upwardly is configured to cause the bracket to move upwardly toward the bottom lock pin upper flange without moving the bottom lock pin upwardly and a bottom lock active state in which the bottom lock pin tip is located in the bottom lock recess and in which depressing the panic bar is configured to cause the gear to rotate and move the bottom lock rod upwardly and further wherein moving the bottom lock rod upwardly in the active state is configured to cause the bracket to move the bottom lock pin upper flange upwardly and the bottom lock pin upwardly to a positive locked position so that the bottom lock pin tip moves out of the bottom lock recess.

15. The breakout sliding door system of claim 14 wherein when the bottom lock pin tip is in the bottom lock recess, the left door is unable to move from the sliding plane to the left door front open position and the left door is unable to move from the sliding closed position to the sliding open position.

16. The breakout sliding door system of claim 15 wherein the lock system further comprises a depressible bottom lock button configured to move the bottom lock from the inactive state to the active state, a moveable support, a spring flange located on the bottom lock pin and a bottom lock spring having a bottom end confronting the spring flange, and further wherein depressing the bottom lock button while the bottom lock is in the inactive state is configured to cause i) the moveable support to move, ii) the bottom end of the bottom lock spring and the spring flange to move downwardly, iii) the bottom lock pin to move downwardly; and iv) to move the bottom lock to the active state.

17. The breakout sliding door system of claim 16 further comprising a cover plate and a hinge, the cover plate configured to pivot along the hinge from a closed position in which the cover plate covers the depressible bottom lock button to an open position in which the cover plate does not cover the depressible bottom lock button.

18. The breakout sliding door system of claim 13 wherein the bottom lock rod and the top lock rod are at least partially located on the right side of the left door.

19. The breakout sliding door system of claim 1 further comprising a left door panel configured to remain fixed relative to the rectangular door system frame when the left door moves from the sliding closed position to the sliding open position, the left door panel located to the left of the left door when the left door is in the sliding closed position, wherein the left door is configured to slide to the rear of the left door panel when the left door slides from the sliding closed position to the sliding open position, and further wherein the left door panel is configured to move with the left door when the left door moves from the sliding plane to the left door front open position.

20. The breakout sliding door system of claim 1 further comprising a left track located above the top left panel and further wherein the system comprises a left wheel connected to the top left panel and located in the left track and further wherein the left wheel is configured to move along the left track when the top left panel and left door slide from the sliding closed position to the sliding open position and further wherein the system further comprises a right track located above the top right panel and further wherein the system comprises a right wheel connected to the top right panel and located in the right track and further wherein the right wheel is configured to move along the right track when the top right panel and right door slide from the sliding closed position to the sliding open position, and further wherein the motor is configured to move the left wheel along the left track and the right wheel along the right track.

21. A breakout sliding door system comprising:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a door comprising a front side, a rear side, a door thickness extending from the front side to the rear side, a left side, a right side, a width extending from the left side to the right side, the width perpendicular to the thickness, a top, a bottom, and a height extending from the top to the bottom, the height perpendicular to the width and the thickness;

c) a top panel located above the door, the top panel connected to the door and comprising a top panel left side, a top panel right side, a top panel top, a top panel bottom located below the system frame top, a top panel height extending from the top panel top to the top panel bottom, a top panel front side, a top panel rear side, and a top panel thickness extending from the top panel front side to the top panel rear side, the top panel height perpendicular to the door thickness, the top panel thickness and the top panel width;

d) a motor; and e) a rod having a rod top pivotally attached to the top panel by a pivot pin forming a pivot pin axis, a rod bottom attached to the door, and a rod longitudinal axis extending from the rod top to the rod bottom, the rod extending in a general downward direction from the top panel at least partially through the door, the pivot pin transverse to the rod longitudinal axis and attached to the top panel, wherein the motor is configured to slide the door in a sliding plane parallel to the system frame width from a sliding open position to a sliding closed position, wherein the top panel is configured to slide with the door from the sliding open position to the sliding closed position, wherein, when the door moves from the sliding plane to a door front open position when a force is exerted on the door rear side perpendicular to the door rear side when the door is in the sliding plane, i) the door is configured to rotate around the rod about a rotational plane generally perpendicular to the rod longitudinal axis, ii) the door is configured to rotate relative to the top panel and iii) the rod is configured to remain stationary relative to the top panel, wherein the door right side or the door left side is in front of the rectangular door system frame in the door front open position.

22. The breakout sliding door system of claim 21 wherein the bottom of the door is configured to remain at substantially the same height relative to the rectangular door system frame when the door rotates around the rod from the sliding plane to the door front open position.

23. The breakout sliding door system of claim 21 wherein the rod bottom is configured to be the sole point of attachment of the door to the top panel when the door is in the door front open position.

24. The breakout sliding door system of claim 21 wherein the pivot pin axis is perpendicular to the system frame front side and the system frame rear side.

25. The breakout sliding door system of claim 21 wherein the top panel further comprises an adjustment fastener configured to engage the rod and cause the rod to move about the pivot pin axis in a plane generally perpendicular to the rotational plane.

26. The breakout sliding door system of claim 21 wherein moving the rod about the pivot pin axis is configured to cause the bottom of the side of the door opposite the rod to move vertically relative to the top panel.

27. The breakout sliding door system of claim 21 wherein the door comprises a door frame comprising an interior and further wherein the rod is located within the door frame interior.

28. The breakout sliding door system of claim 27 wherein the rod bottom is hollow and surrounds a threaded shank of a left threaded bolt comprising a head and the threaded shank, wherein the rod is fixed to the threaded shank of the threaded bolt, wherein the door further comprises a door bracket located between the head of the threaded bolt and the rod bottom, wherein the door bracket is attached to the door frame, wherein the door bracket is configured to rotate about the rod and the threaded bolt while the rod and the threaded bolt remain stationary as the door moves from the sliding plane to the door front open position.

29. The breakout sliding door system of claim 28 further comprising a fastener fixing the rod to the threaded shank of the threaded bolt.

* * * * *